US010780690B2

(12) United States Patent
Takagi

(10) Patent No.: US 10,780,690 B2
(45) Date of Patent: Sep. 22, 2020

(54) LIQUID EJECTING APPARATUS AND DRIVE SIGNAL GENERATION CIRCUIT

(71) Applicant: SEIKO EPSON CORPORATION, Tokyo (JP)

(72) Inventor: Tetsuo Takagi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/356,000

(22) Filed: Mar. 18, 2019

(65) Prior Publication Data

US 2019/0291416 A1 Sep. 26, 2019

(30) Foreign Application Priority Data

Mar. 20, 2018 (JP) ..... 2018-052191
Jul. 26, 2018 (JP) ..... 2018-140427

(51) Int. Cl.
*B41J 2/045* (2006.01)
*B41J 2/14* (2006.01)

(52) U.S. Cl.
CPC ..... *B41J 2/04541* (2013.01); *B41J 2/0455* (2013.01); *B41J 2/04548* (2013.01); *B41J 2/04551* (2013.01); *B41J 2/04555* (2013.01); *B41J 2/04581* (2013.01); *B41J 2/04588* (2013.01); *B41J 2/04593* (2013.01); *B41J 2/04596* (2013.01); *B41J 2/14233* (2013.01); *B41J 2002/14241* (2013.01); *B41J 2002/14362* (2013.01); *B41J 2002/14419* (2013.01)

(58) Field of Classification Search
CPC .. B41J 2/04548; B41J 2/0455; B41J 2/04551; B41J 2/04555; B41J 2/04581; B41J 2/04588; B41J 2/04541
See application file for complete search history.

(56) References Cited

U.S. PATENT DOCUMENTS

2013/0229678 A1 9/2013 Ishikawa et al.
2017/0057221 A1 3/2017 Nozawa
2017/0173951 A1 6/2017 Hayashi
2017/0182773 A1 6/2017 Fujisawa et al.

FOREIGN PATENT DOCUMENTS

JP 2013-180480 A 9/2013
JP 2017-043007 A 3/2017
JP 2017-081183 A 5/2017

OTHER PUBLICATIONS

The Extended European Search Report for the corresponding European Patent Application No. 19164074.7 dated Jul. 31, 2019.

*Primary Examiner* — Lamson D Nguyen
(74) *Attorney, Agent, or Firm* — Global IP Counselors, LLP

(57) ABSTRACT

A liquid ejecting apparatus includes a drive circuit that outputs a drive signal, a piezoelectric element that includes a first electrode to which the drive signal is supplied and a second electrode to which a reference voltage signal is supplied and that is displaced by a potential difference between the first electrode and the second electrode, a cavity that is filled with a liquid ejected from a nozzle according to the displacement of the piezoelectric element, a vibration plate that is provided between the cavity and the piezoelectric element, a detection circuit that detects whether or not a voltage variation of the drive signal is within a predetermined range, and a determination circuit that determines whether or not the drive signal is normal based on a detection result of the detection circuit.

7 Claims, 33 Drawing Sheets

FIG. 10

| OPERATION MODE | | PRINT MODE | | | | STANDBY MODE | TRANSITION MODE | SLEEP MODE |
|---|---|---|---|---|---|---|---|---|
| | | LARGE DOT | MEDIUM DOT | SMALL DOT | MINUTE VIBRATION | | | |
| [SIH, SIL] | | [1, 1] | [1, 0] | [0, 1] | [0, 0] | – | – | – |
| [MCH, MCL] | | [1, 1] | | | | [1, 0] | [0, 0] | [0, 1] |
| S | T1 | H | H | L | L | H | L | L |
| | T2 | H | L | H | L | | | |
| | T3 | L | L | L | H | | | |

LIQUID EJECTING APPARATUS AND DRIVE SIGNAL GENERATION CIRCUIT

The entire disclosure of Japanese Patent Application No. 2018-052191, filed Mar. 20, 2018 and 2018-140427, filed Jul. 26, 2018 are expressly incorporated by reference herein.

BACKGROUND

1. Technical Field

The present invention relates to a liquid ejecting apparatus and a drive signal generation circuit.

2. Related Art

It is known that a piezoelectric element such as a piezo element is used as an ink jet printer (liquid ejecting apparatus) which ejects a liquid such as ink to print an image or a document. The piezoelectric element is provided in the print head, corresponding to a plurality of nozzles that eject the ink and a cavity that stores the ink ejected from the nozzles. As the piezoelectric element is displaced according to a drive signal, a vibration plate provided between the piezoelectric element and the cavity is displaced, and the volume of the cavity changes. Thereby, the predetermined amount of ink is ejected from the nozzle at a predetermined timing, and dots are formed on a medium.

JP-A-2017-43007 discloses a liquid ejecting apparatus in which a drive signal generated based on print data is supplied to an upper electrode and a reference voltage is supplied to a lower electrode for a piezoelectric element that is displaced based on a potential difference between the upper electrode and the lower electrode, and which controls a displacement of the piezoelectric element by controlling whether or not the drive signal is supplied by a selection circuit (switch circuit) and ejects ink.

In a liquid ejecting apparatus that ejects ink based on a displacement of a piezoelectric element described in JP-A-2017-43007, in a case where an unintentional DC voltage is supplied to the piezoelectric element, an unintentional displacement continuously occurs in the piezoelectric element. In a case where the unintentional displacement occurs in the piezoelectric element, a vibration plate is also displaced based on the displacement. As a result, the vibration plate is bent more than expected, and unintentional stress is applied to the vibration plate.

In a case where the unintentional stress occurring in such a vibration plate is continuously applied for a long time, stress concentrates around a contact point between the vibration plate and a cavity, and a crack or the like may occur in the vibration plate.

Furthermore, in a case where a state in which the vibration plate is unintentionally bent is shifted to an ejection operation, an unnecessary load is applied to the vibration plate, and cracks or the like may occur in the vibration plate due to the load.

If the crack occurs in the vibration plate, ink stored in the cavity leaks out through the crack, and the amount of ejected ink fluctuates depending on a change in a volume of the cavity. As a result, an ink ejection accuracy is reduced.

Furthermore, in a case where the ink leaking through the crack adheres to both an upper electrode and a lower electrode of the piezoelectric element, a current path passing through the ink is formed between the upper electrode and the lower electrode. As a result, a potential of a reference voltage signal supplied to the lower electrode varies. In a case where the reference voltage signal is commonly supplied to a plurality of piezoelectric elements, a variation of the potential of the reference voltage signal influences displacements of the plurality of piezoelectric elements. That is, an ink ejection accuracy of the entire liquid ejecting apparatus may be influenced without being limited to an ejection accuracy from the nozzle corresponding to the vibration plate in which a crack occurs.

A problem of the displacement occurring in the piezoelectric element and the vibration plate due to an unintentional voltage continuously applied to such a piezoelectric element for a long time is a new problem not disclosed also in JP-A-2017-43007.

SUMMARY

According to an aspect of the invention, a liquid ejecting apparatus includes a drive circuit that outputs a drive signal, a piezoelectric element that includes a first electrode to which the drive signal is supplied and a second electrode to which a reference voltage signal is supplied and that is displaced by a potential difference between the first electrode and the second electrode, a cavity that is filled with a liquid ejected from a nozzle according to the displacement of the piezoelectric element, a vibration plate that is provided between the cavity and the piezoelectric element, a detection circuit that detects whether or not a voltage variation of the drive signal is within a predetermined range, and a determination circuit that determines whether or not the drive signal is normal based on a detection result of the detection circuit.

In the liquid ejecting apparatus, in a case where the detection circuit detects that the voltage variation of the drive signal is within the predetermined range while continuing for a predetermined period, the determination circuit may determine that the drive signal is not normal.

In the liquid ejecting apparatus, in a case where the determination circuit determines that the drive signal is not normal, the drive circuit may control a voltage value of the drive signal to approach a voltage value of the reference voltage signal.

In the liquid ejecting apparatus, in a case where the determination circuit determines that the drive signal is not normal, the determination circuit may output a signal for discharging an electric charge of at least one of the first electrode and the second electrode.

In the liquid ejecting apparatus, the detection circuit may detect whether or not the voltage variation of the drive signal is within the predetermined range, based on an original drive signal which is origin of the drive signal.

In the liquid ejecting apparatus, the detection circuit may detect whether or not the voltage variation of the drive signal is within the predetermined range, based on the drive signal.

According to another aspect of the invention, a drive signal generation circuit which is used for a liquid ejecting apparatus including a piezoelectric element that is displaced by a potential difference that is generated between a first electrode and a second electrode, a cavity that is filled with a liquid ejected from a nozzle according to the displacement of the piezoelectric element, and a vibration plate which is provided between the cavity and the piezoelectric element, includes a drive circuit that outputs a drive signal which is to be supplied to the first electrode of the piezoelectric element, a detection circuit that detects whether or not a voltage variation of the drive signal is within a predetermined range, and a determination circuit that determines whether or not the drive signal is normal based on a detection result of the detection circuit.

BRIEF DESCRIPTION OF THE DRAWINGS

The invention will be described with reference to the accompanying drawings, wherein like numbers reference like elements.

FIG. 10 is a diagram illustrating decode content in a decoder.

DESCRIPTION OF EXEMPLARY EMBODIMENTS

Preferred embodiments of the invention will be described below with reference to the drawings. The drawings which are used are for the sake of convenient description. The embodiments which will be described below do not unduly limit the content of the invention described in the claims. In addition, not all configurations which will be described below are essential configuration elements of the invention.

Hereinafter, an ink jet printer, which is a print apparatus that ejects ink as a liquid, will be described as an example of a liquid ejecting apparatus according to the invention.

For example, a print apparatus such as an ink jet printer, a color material ejecting apparatus used for manufacturing a color filter such as a liquid crystal display, an organic EL display, an electrode material ejecting apparatus used for forming an electrode such as a surface emitting display, a bioorganic ejecting apparatus used for manufacturing a biochip, or the like can be used as the liquid ejecting apparatus.

1 First Embodiment

1.1 Configuration of Liquid Ejecting Apparatus

A print apparatus as an example of the liquid ejecting apparatus according to a first embodiment is an ink jet printer that forms dots on a print medium such as paper by ejecting ink according to image data supplied from an external host computer and prints an image including a character, a graphic, and the like according to the image data.

Figure 1:
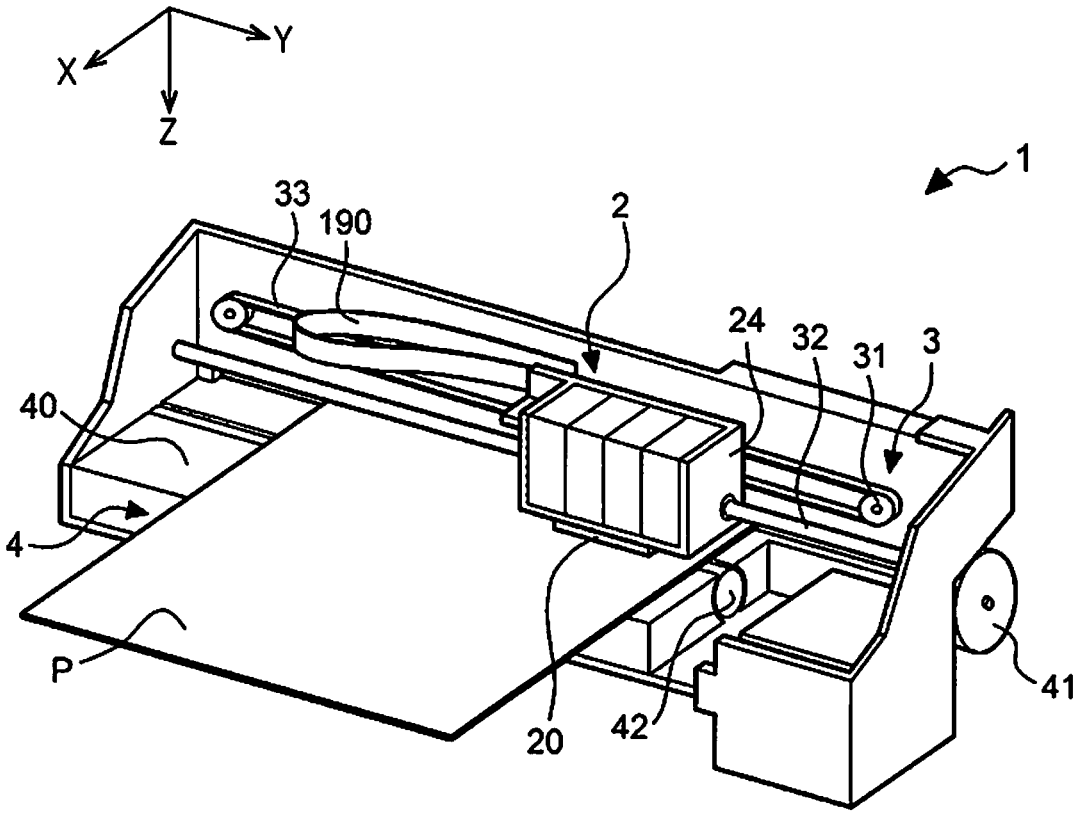
FIG. 1 is a perspective view illustrating a schematic configuration of a liquid ejecting apparatus.

FIG. 1 is a perspective view illustrating a schematic configuration of a liquid ejecting apparatus 1. FIG. 1 illustrates a direction X in which a medium P is transported, a direction Y which crosses the direction X and in which a moving object 2 reciprocates, and a direction Z in which ink is ejected. In the first embodiment, the direction X, the direction Y, and the direction Z are described as axes orthogonal to each other.

As illustrated in FIG. 1, the liquid ejecting apparatus 1 includes the moving object 2 and a moving mechanism 3 for making the moving object 2 reciprocate in the direction Y.

The moving mechanism 3 includes a carriage motor 31 which is a drive source of the moving object 2, a carriage guide shaft 32 having both ends fixed, and a timing belt 33 that extends substantially in parallel with the carriage guide shaft 32 and is driven by the carriage motor 31.

The carriage 24 included in the moving object 2 is supported by the carriage guide shaft 32 reciprocably and is fixed to a part of the timing belt 33. By driving the timing belt 33 by using the carriage motor 31, the moving object 2 reciprocates along the direction Y while being guided by the carriage guide shaft 32.

A head unit 20 is provided in a portion of the moving object 2 facing the medium P. The head unit 20 includes many nozzles, and ink is ejected from each of the nozzles in the direction Z. A control signal and the like are also supplied to the head unit 20 via a flexible cable 190.

The liquid ejecting apparatus 1 includes a transport mechanism 4 for transporting the medium P on a platen 40 in the direction X. The transport mechanism 4 includes a transport motor 41 which is a drive source and a transport roller 42 which is rotated by the transport motor 41 and transports the medium P in the direction X.

At the timing when the medium P is transported by the transport mechanism 4, the head unit 20 ejects ink onto the medium P, and thereby, an image is formed on a surface of the medium P.

Figure 2:
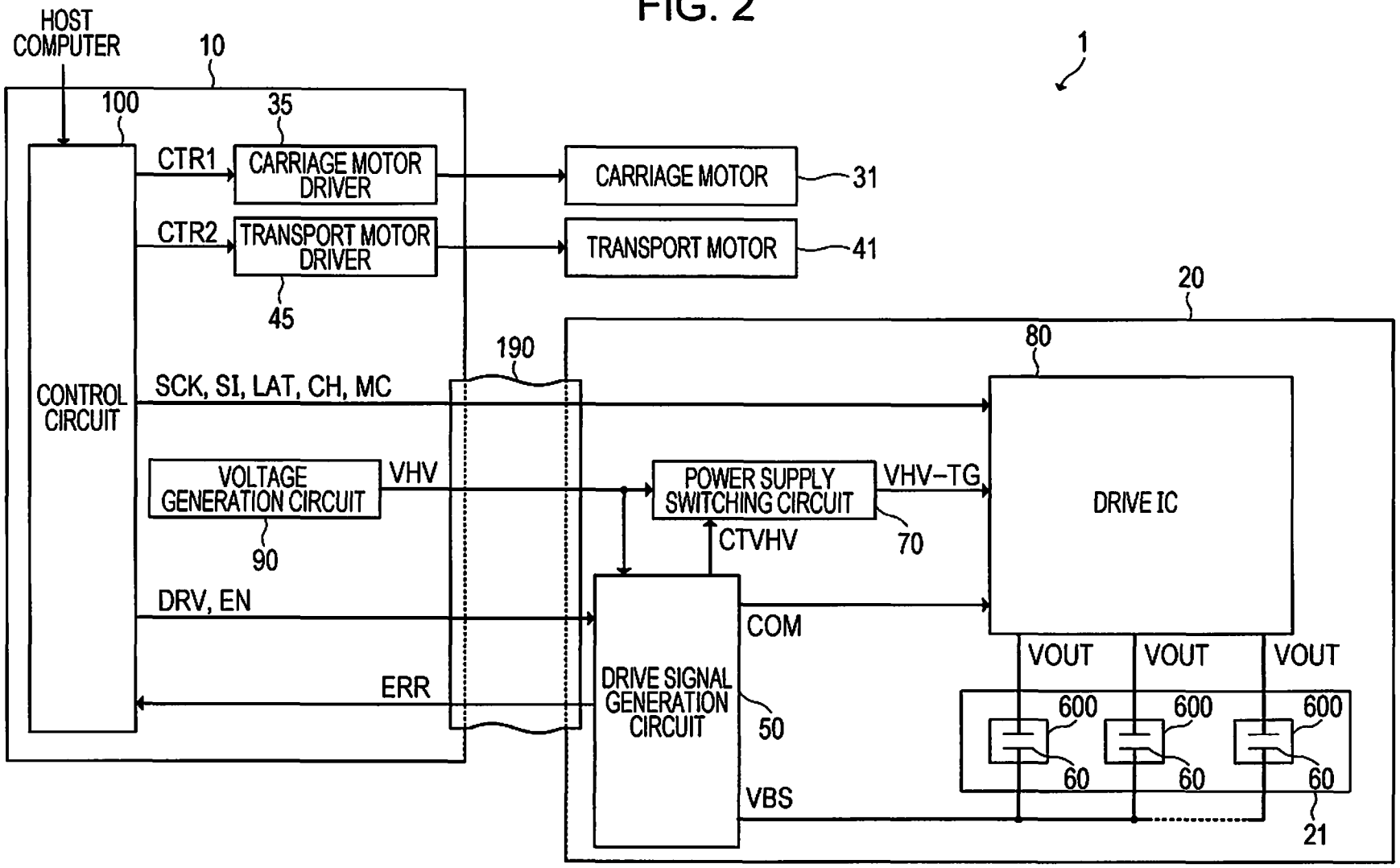
FIG. 2 is a block diagram illustrating an electric configuration of the liquid ejecting apparatus.

FIG. 2 is a block diagram illustrating an electric configuration of the liquid ejecting apparatus 1.

As illustrated in FIG. 2, the liquid ejecting apparatus 1 includes a control unit 10 and the head unit 20. The control unit 10 and the head unit 20 are connected to each other via the flexible cable 190.

The control unit 10 includes a control circuit 100, a carriage motor driver 35, a transport motor driver 45, and a voltage generation circuit 90.

The control circuit 100 supplies a plurality of control signals and the like for controlling various configurations, based on image data supplied from a host computer.

Specifically, the control circuit 100 supplies a control signal CTR1 to the carriage motor driver 35. The carriage motor driver 35 drives the carriage motor 31 in response to the control signal CTR1. Thereby, movement of the carriage 24 in the direction Y illustrated in FIG. 1 is controlled.

In addition, the control circuit 100 supplies a control signal CTR2 to the transport motor driver 45. The transport motor driver 45 drives the transport motor 41 in response to the control signal CTR2. Thereby, movement of the medium P by the transport mechanism 4 in the direction X illustrated in FIG. 1 is controlled.

In addition, the control circuit 100 supplies a clock signal SCK, a print data signal SI, a latch signal LAT, a change signal CH, an operation mode signal MC, a drive data signal DRV, and a select signal EN to the head unit 20.

The voltage generation circuit 90 generates a voltage VHV of, for example, DC 42 V to supply to the head unit 20. The voltage VHV may also be supplied to various configurations included in the control unit 10.

The head unit 20 includes a drive signal generation circuit 50, a power supply switching circuit 70, a drive IC 80, and an ejection module 21.

The drive signal generation circuit 50 is supplied with the voltage VHV, the drive data signal DRV, and the select signal EN.

The drive signal generation circuit 50 generates a drive signal COM by performing class-D amplification so as to increase a voltage of a signal based on the drive data signal DRV to a voltage based on the voltage VHV, and supplies the amplified voltage to the drive IC 80. In addition, the drive signal generation circuit 50 generates a reference voltage signal VBS of, for example, DC 5 V obtained by stepping down the voltage VHV and supplies the reference voltage signal to the ejection module 21. In addition, the drive signal generation circuit 50 generates a power supply control signal CTVHV, based on the drive data signal DRV and supplies the generated power supply control signal to the power supply switching circuit 70. Here, the select signal EN indicates whether the drive data signal DRV supplied to the drive signal generation circuit 50 is a data signal for generating the drive signal COM or a data signal for generating the power supply control signal CTVHV.

In a case where the generated drive signal COM is not normal, the drive signal generation circuit 50 supplies an error signal ERR to the control circuit 100.

The power supply switching circuit 70 is supplied with the voltage VHV and the power supply control signal CTVHV. In accordance with the power supply control signal CTVHV. The power supply switching circuit 70 switches between a potential based on the voltage VHV and a ground potential, for a potential of a voltage VHV-TG supplied to the drive IC 80.

The drive IC 80 is supplied with the clock signal SCK, the print data signal SI, the latch signal LAT, the change signal CH, the operation mode signal MC, the voltage VHV-TG, and the drive signal COM.

The drive IC 80 determines whether or not to select the drive signal COM during a predetermined period, based on the clock signal SCK, the print data signal SI, the operation mode signal MC, the latch signal LAT, and the change signal CH. Then, the drive signal COM selected by the drive IC 80 is supplied to the ejection module 21 as a drive signal VOUT. The voltage VHV-TG is used for generating a signal of a high voltage logic for selecting, for example, the drive signal COM.

The ejection module 21 includes a plurality of ejection units 600 including piezoelectric elements 60.

The drive signal VOUT supplied to the ejection module 21 is supplied to one terminal of the piezoelectric element 60. The reference voltage signal VBS is supplied to the other terminal of the piezoelectric element 60. The piezoelectric element 60 is displaced according to a potential difference between the drive signal VOUT and the reference voltage signal VBS. The amount of ink according to the displacement is ejected from the ejection unit 600.

Details of the drive signal generation circuit 50, the power supply switching circuit 70, the drive IC 80, and the ejection module 21 will be described below. In FIG. 2, although the liquid ejecting apparatus 1 is described as including one head unit 20, but a plurality of head units 20 may be provided. In FIG. 2, although it is described that the head unit 20 includes one ejection module 21, a plurality of ejection modules 21 may be provided.

The liquid ejecting apparatus 1 described above has a plurality of operation modes including a print mode, a standby mode, a transition mode, and a sleep mode.

The print mode is an operation mode in which printing can be performed by ejecting ink onto the medium P, based on the supplied image data. The standby mode is an operation mode in which printing can be performed in a short time in a case where image data is supplied while reducing power consumption for the print mode. The transition mode is an operation mode in which transition is made from the standby mode to the sleep mode. The sleep mode is an operation mode in which power consumption can be further reduced for the standby mode.

Figure 3:
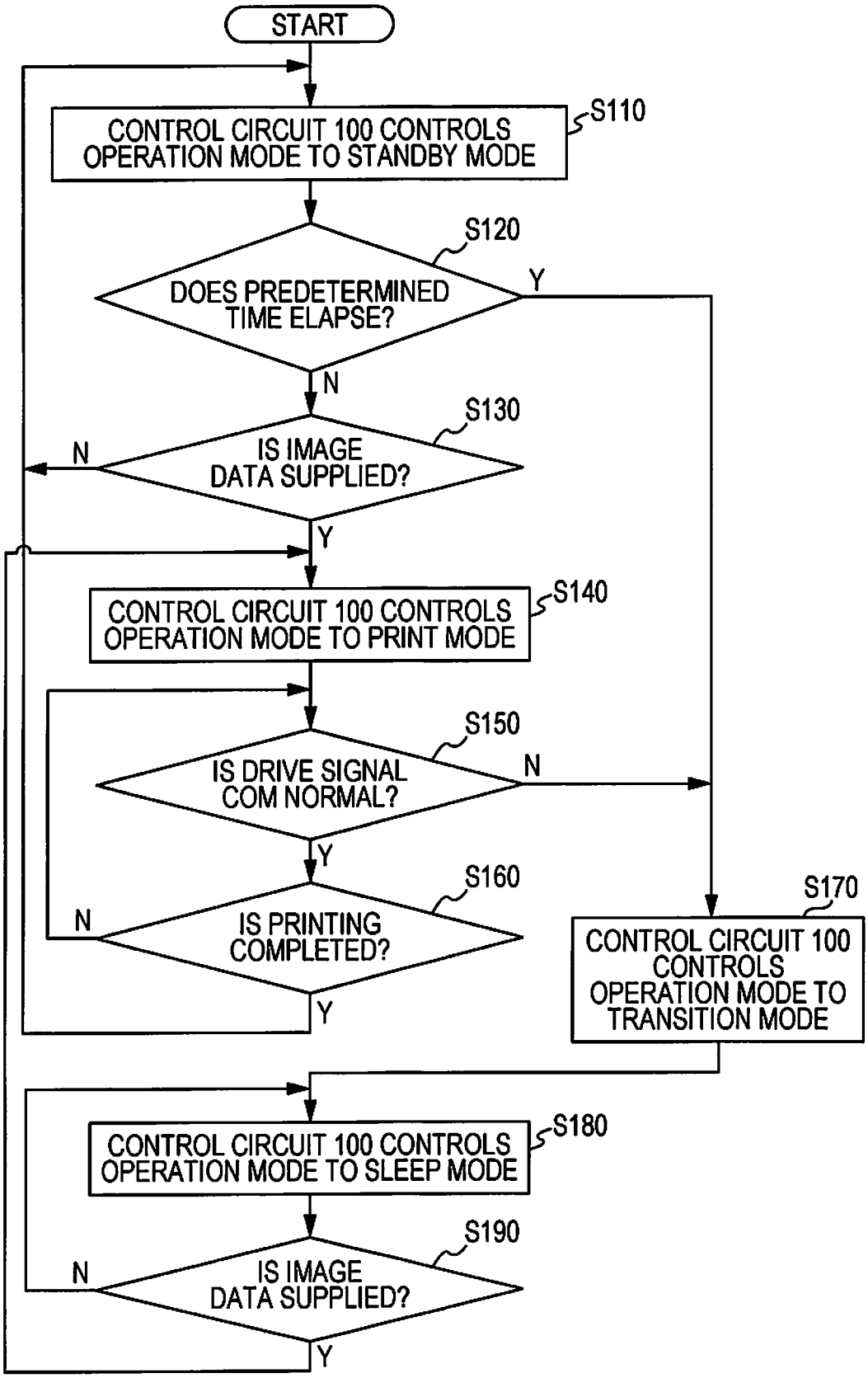
FIG. 3 is a flowchart illustrating a mode transition between the respective operation modes of the liquid ejecting apparatus.

Here, a relationship between the respective operation modes of the liquid ejecting apparatus 1 will be described with reference to FIG. 3. FIG. 3 is a flowchart illustrating mode transitions between the respective operation modes of the liquid ejecting apparatus 1.

As illustrated in FIG. 3, if power is supplied to the liquid ejecting apparatus 1, the control circuit 100 controls an operation mode to become the standby mode (S110). After shifting to the standby mode, the control circuit 100 determines whether or not a predetermined time elapses (S120).

In a case where the predetermined time does not elapse (N of S120), the control circuit 100 determines whether image data is supplied to the liquid ejecting apparatus 1 (S130).

In a case where the image data is not supplied (N of S130), the standby mode is maintained. Meanwhile, in a case where the image data is supplied (Y of S130), the control circuit 100 controls an operation mode to become the print mode (S140).

In the print mode, the drive signal generation circuit 50 determines whether or not the drive signal COM is normal (S150). In a case where the drive signal COM is normal (Y of S150), the drive signal generation circuit determines whether or not printing corresponding to the supplied image data is completed (S160). In a case where the printing is completed (N of S160), the drive signal generation circuit 50 determines whether or not the drive signal COM is normal (S150).

In the print mode, in a case where the printing corresponding to the supplied image data is completed (Y of S160), the control circuit 100 controls the operation mode to become the standby mode (S110).

In a case where the predetermined time elapses (Y of S120) and the drive signal COM is not normal (N of S150), the control circuit 100 controls the operation mode to become the transition mode (S170). After the transition mode ends, the control circuit 100 controls the operation mode to become the sleep mode (S180).

After shifting to the sleep mode, the control circuit 100 determines whether or not image data is supplied to the liquid ejecting apparatus 1 (S190).

In a case where the image data is not supplied (N of S190), the sleep mode is continued. Meanwhile, in a case where the image data is supplied (Y of S190), the control circuit 100 controls the operation mode to become the print mode (S140).

The liquid ejecting apparatus 1 may include operation modes other than the above-described operation modes as the plurality of operation modes. For example, the liquid ejecting apparatus 1 may have operation modes such as a test print mode in which test printing is performed on the medium P, and a stop mode in which an operation stops due to running out of ink, poor transport of the medium P, or the like.

1.2 Configuration and Operation of Drive Signal Generation Circuit

Figure 4:
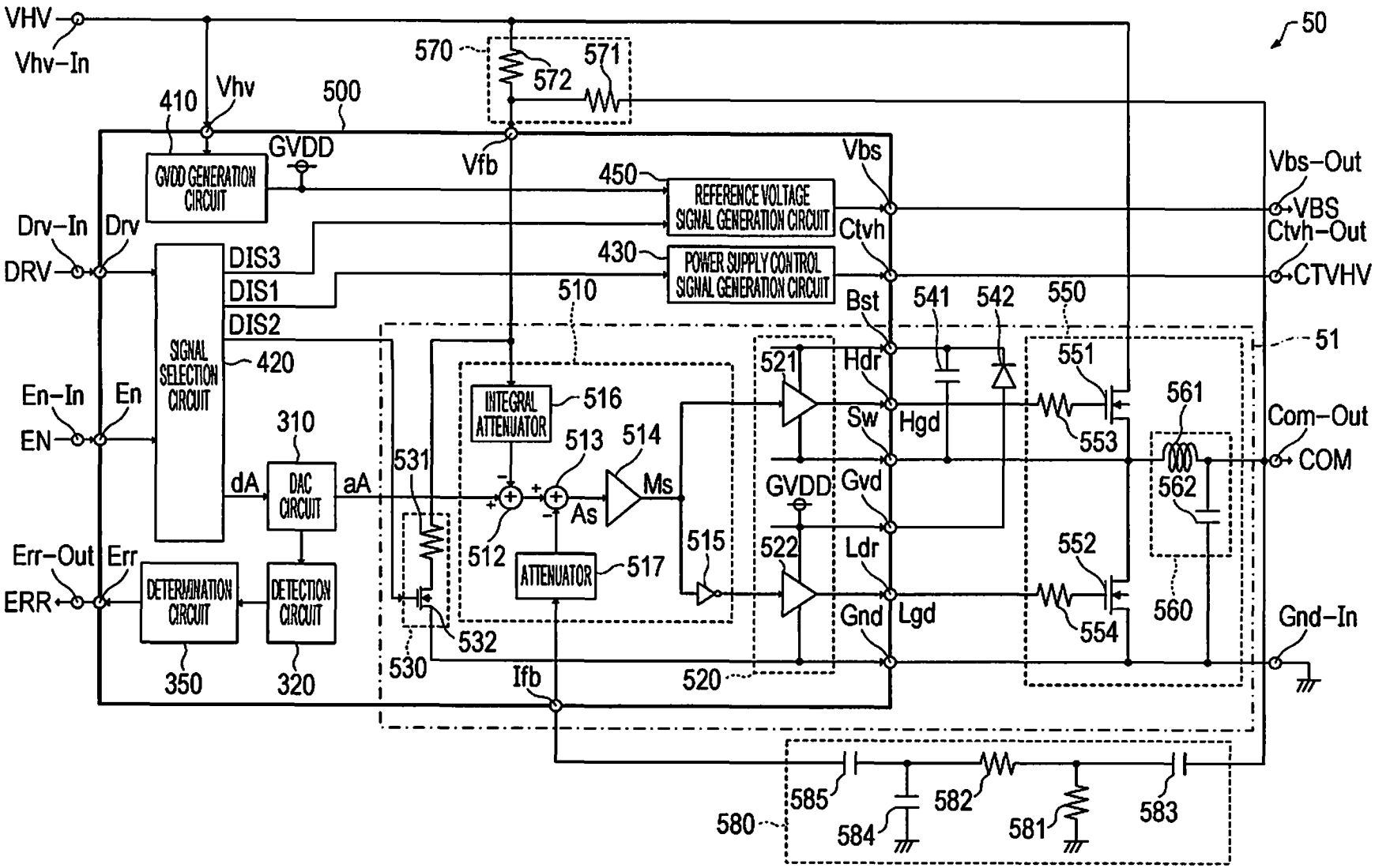
FIG. 4 is a block diagram illustrating a circuit configuration of a drive signal generation circuit.

Next, the drive signal generation circuit 50 will be described with reference to FIG. 4. FIG. 4 is a block diagram illustrating a circuit configuration of the drive signal generation circuit 50. As illustrated in FIG. 4, the drive signal generation circuit 50 includes an integrated circuit 500, an output circuit 550, a first feedback circuit 570, a second feedback circuit 580, and a plurality of other circuit elements.

The drive signal generation circuit 50 includes a plurality of terminals including terminals Drv-In, En-In, Err-Out, Vhv-In, Vbs-Out, Ctvh-Out, Com-Out, and Gnd-In, which are electrically connected to various external configurations. Among the terminals, a ground potential (for example, 0 V) of the liquid ejecting apparatus 1 is supplied to the terminal Gnd-In.

The integrated circuit 500 includes a GVDD generation circuit 410, a signal selection circuit 420, a power supply control signal generation circuit 430, a reference voltage signal generation circuit 450, a digital to analog converter (DAC) circuit 310, a detection circuit 320, a determination circuit 350, a modulation circuit 510, a gate drive circuit 520, and an LC discharge circuit 530.

The integrated circuit 500 includes a plurality of terminals including terminals Dry, En, Err, Vhv, Vfb, Vbs, Ctvh, Bst, Hdr, Sw, Gvd, Ldr, and Gnd, which are electrically connected to the various configurations of the drive signal generation circuit 50.

The voltage VHV is supplied to the GVDD generation circuit 410 via the terminals Vhv-In and Vhv. The GVDD generation circuit 410 transforms the voltage VHV to generate the voltage GVDD and supplies the voltage GVDD to the reference voltage signal generation circuit 450 and the gate drive circuit 520.

The GVDD generation circuit 410 is configured by, for example, a linear regulator circuit or a switching regulator circuit. The GVDD generation circuit 410 may be provided outside the integrated circuit 500.

The drive data signal DRV is supplied to the signal selection circuit 420 via the terminals Drv-In and Dry and the select signal EN is supplied to the signal selection circuit 420 via terminals En-In and En. The signal selection circuit 420 determines whether the drive data signal DRV is a signal to be supplied to the DAC circuit 310 or a signal to be supplied to each of the reference voltage signal generation circuit 450, the power supply control signal generation circuit 430, and the LC discharge circuit 530, based on the select signal EN and supplies the drive data signal to each of the configurations.

Specifically, the signal selection circuit 420 includes a plurality of registers (not illustrated). In a case where the drive data signal DRV is a signal to be supplied to the DAC circuit 310, the signal selection circuit 420 holds the drive data signal DRV in a plurality of registers corresponding to the DAC circuit 310 in response to the select signal EN. Then, the signal selection circuit 420 supplies the held signal to the DAC circuit 310 as a digital original drive signal dA.

Meanwhile, in a case where the drive data signals DRV are supplied to the reference voltage signal generation circuit 450, the power supply control signal generation circuit 430, and the LC discharge circuit 530, the signal selection circuit 420 holds data corresponding to each of the reference voltage signal generation circuit 450, the power supply control signal generation circuit 430, and the LC discharge circuit 530 among the drive data signals DRV in response to the select signal EN in a predetermined register. Then, the signal selection circuit 420 supplies the held signals to the power supply control signal generation circuit 430, the LC discharge circuit 530, and the reference voltage signal generation circuit 450 as discharge control signals DIS1, DIS2, and DIS3.

The power supply control signal generation circuit 430 is supplied with the discharge control signal DIS1. The power supply control signal generation circuit 430 includes an open-drain circuit (not illustrated). In a case where the supplied discharge control signal DIS1 is a signal indicating active, the power supply control signal generation circuit 430 turns off the open-drain circuit and sets the terminal Ctvh to high impedance.

Meanwhile, in a case where the discharge control signal DIS1 is a signal indicating inactive, the power supply control signal generation circuit 430 turns on the open-drain circuit and sets the terminal Ctvh to a ground potential. At this time, the power supply control signal CTVHV of an L level is supplied to the power supply switching circuit 70 illustrated in FIG. 2 via the terminals Ctvh and Ctvh-Out.

Description on FIG. 20 and the like which will be described below will be made in which the open-drain circuit included in the power supply control signal generation circuit 430 is configured with an NMOS transistor. In addition, it will be described that the discharge control signal DIS1 is supplied to a gate terminal of the NMOS transistor via an inverter circuit. Thus, in the first embodiment, a signal indicating that the discharge control signal DIS1 is in an active state is a signal of an H level, and a signal indicating that the discharge control signal DIS1 is in an inactive state is a signal of an L level. The power supply control signal generation circuit 430 is not limited to the open-drain circuit, and may be configured by, for example, a push-pull circuit.

The reference voltage signal generation circuit 450 is supplied with the voltage GVDD. The reference voltage signal generation circuit 450 steps down the supplied voltage GVDD to generate the reference voltage signal VBS.

Figure 5:
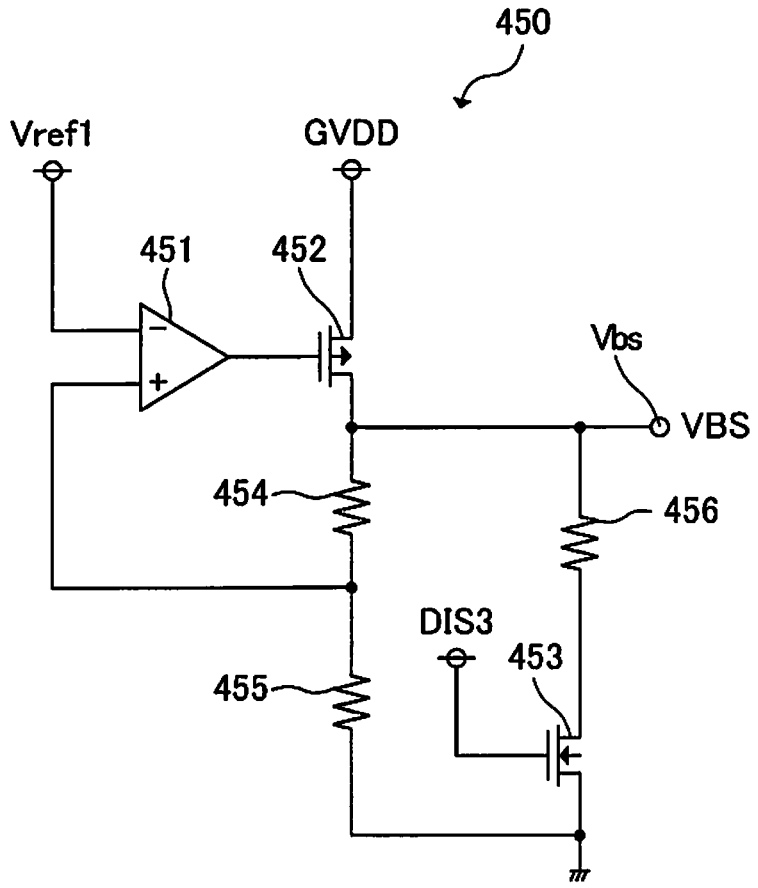
FIG. 5 is a circuit diagram illustrating a circuit configuration of a reference voltage signal generation circuit.

FIG. 5 is a circuit diagram illustrating a circuit configuration of the reference voltage signal generation circuit 450. The reference voltage signal generation circuit 450 includes a comparator 451, transistors 452 and 453, and resistors 454, 455, and 456. In the following description, the transistor 452 will be described as a PMOS transistor, and the transistor 453 will be described as an NMOS transistor.

The voltage Vref1 is supplied to an input terminal (−) of the comparator 451. An input terminal (+) of the comparator 451 is connected to one terminal of the resistor 454 and one terminal of the resistor 455 in common. An output terminal of the comparator 451 is connected to a gate terminal of the transistor 452.

The voltage GVDD is supplied to a source terminal of the transistor 452. A drain terminal of the transistor 452 is commonly connected to the other terminal of the resistor 454, one terminal of the resistor 456 and the terminal Vbs from which the reference voltage signal Vbs is output.

The other terminal of the resistor 456 is connected to a drain terminal of the transistor 453.

The discharge control signal DIS3 is supplied to a gate terminal of the transistor 453. A ground potential is supplied to the source terminal of the transistor 453.

The ground potential is supplied to the other terminal of the resistor 455.

As described above, the reference voltage signal generation circuit 450 configures a series regulator circuit.

A voltage obtained by dividing the reference voltage signal VBS by the resistors 454 and 455 is supplied to the input terminal (+) of the comparator 451. In a case where the voltage supplied to the input terminal (+) of the comparator 451 is larger than a voltage Vref1 supplied to the input terminal (−) of the comparator 451, the comparator 451 outputs a signal of an H level. At this time, the transistor 452 is turned off. Thus, the voltage GVDD is not supplied to the terminal Vbs.

Meanwhile, in a case where the voltage supplied to the input terminal (+) of the comparator 451 is smaller than the voltage Vref1 supplied to the input terminal (−) of the comparator 451, the comparator 451 outputs a signal of an L level. At this time, the transistor 452 is turned on. Thus, the voltage GVDD is supplied to the terminal Vbs.

As described above, in the reference voltage signal generation circuit 450, the comparator 451 compares a signal based on the reference voltage signal VBS with the voltage Vref1 and controls the transistor 452 to step down the voltage GVDD, and thereby, the reference voltage signal VBS of a targeted voltage value is generated.

In a case where the discharge control signal DIS3 supplied to the gate terminal of the transistor 453 is a signal of an H level, the transistor 453 is turned on. At this time, the ground potential is supplied to the terminal Vbs via the resistor 456. In other words, the transistor 453 is provided to be capable of switching an electrical connection between the terminals Vbs and Vbs-Out and the ground potential.

Referring back to FIG. 4, the reference voltage signal VBS generated by the reference voltage signal generation circuit 450 is supplied to the ejection module 21 illustrated in FIG. 2 via the terminals Vbs and Vbs-Out. The reference voltage signal VBS functions as a reference voltage serving as a reference for displacing the piezoelectric element 60.

The reference voltage signal generation circuit 450 may be provided outside the integrated circuit 500, and furthermore, may be provided outside the drive signal generation circuit 50.

The DAC circuit 310 converts the original drive signal dA into an analog original drive signal aA and supplies the analog original drive signal to the modulation circuit 510. In addition, the DAC circuit 310 supplies a digital signal based on the original drive signal dA to the detection circuit 320.

The detection circuit 320 detects whether or not a signal based on the original drive signal dA supplied from the DAC circuit 310 is within a predetermined range.

The determination circuit 350 determines whether or not the original drive signal dA is normal according to a detection result of the detection circuit 320. In a case where it is determined that the original drive signal dA is not normal, the determination circuit 350 generates the error signal ERR and supplies the error signal to the control circuit 100 illustrated in FIG. 2 via the terminals Err and Err-Out.

Operations and configurations of the DAC circuit 310, the detection circuit 320, and the determination circuit 350 described above will be described in detail below.

The modulation circuit 510 includes the adder 512, an adder 513, a comparator 514, an inverter 515, an integral attenuator 516, and an attenuator 517.

The integral attenuator 516 attenuates and integrates a voltage signal of the drive signal COM supplied via the terminal Vfb and supplies the voltage signal to the input terminal (−) of the adder 512.

The original drive signal aA is supplied to an input terminal (+) of the adder 512. The adder 512 subtracts the voltage signal supplied from the integral attenuator 516 to the input terminal (−) thereof, from the original drive signal aA supplied to the input terminal (+) thereof and integrates obtained by subtracting the voltage signal. Then, the adder 512 supplies the subtracted and integrated voltage signal is supplied to an input terminal (+) of the adder 513.

Here, there is a case where a maximum voltage of the original drive signal aA is a low voltage of, for example, approximately 2 V, whereas a maximum voltage of the drive signal COM is a high voltage of, for example, approximately 40 V. Accordingly, the integral attenuator 516 attenuates a voltage of the drive signal COM so as to match amplitude ranges of both voltages in obtaining a deviation.

The attenuator 517 attenuates a high frequency component of the voltage signal of the drive signal COM input via the terminal Ifb and supplies the voltage to the input terminal (−) of the adder 513.

The adder 513 outputs a voltage signal As obtained by subtracting a voltage supplied from the attenuator 517 to the input terminal (−) thereof, from the voltage supplied to the input terminal (+) thereof from the adder 512, to the comparator 514.

The voltage signal As output from the adder 513 is a voltage obtained by subtracting a voltage supplied to the terminal Vfb from the voltage of the original drive signal aA, and further, subtracting a voltage supplied to the terminal Ifb. That is, the voltage signal As is a voltage signal obtained by correcting a deviation obtained by subtracting the attenuated voltage of the output drive signal COM from the voltage of the original drive signal aA which is a target, using a high frequency component of the drive signal COM.

The comparator 514 generates a modulation signal Ms based on the voltage signal As supplied from the adder 513. Specifically, in a case where a voltage of the voltage signal As supplied from the adder 513 steps up to a voltage higher than or equal to a predetermined threshold Vth1, the comparator 514 generates the modulation signal Ms of an H level. In addition, in a case where the voltage of the voltage signal As steps down to a voltage lower than the predetermined threshold Vth2, the comparator 514 generates the modulation signal Ms of an L level. The threshold Vth1 and the threshold Vth2 are set to a relation of threshold Vth1>threshold Vth2.

The comparator 514 supplies the generated modulation signal Ms to a first gate driver 521 included in the gate drive circuit 520. In addition, the comparator 514 supplies the generated modulation signal Ms to a second gate driver 522 included in the gate drive circuit 520 via the inverter 515. Thus, the signal supplied from the comparator 514 to the first gate driver 521 and the signal supplied from the comparator 514 to the second gate driver 522 have mutually exclusive logic levels.

Here, the fact that the logic levels of the signals supplied to the first gate driver 521 and the second gate driver 522 have an exclusive relationship means that the logic levels of the signals supplied to the first gate driver 521 and the second gate driver 522 are controlled so as not to be at an H level at the same time.

The gate drive circuit 520 includes the first gate driver 521 and the second gate driver 522.

The first gate driver 521 shifts a level of a voltage value of the modulation signal Ms output from the comparator 514 and outputs the modulation signal as a first amplification control signal Hgd from the terminal Hdr.

Specifically, among power supply voltages of the first gate driver 521, the voltage on a high potential side is supplied via the terminal Bst and the voltage on a low potential side is supplied via the terminal Sw. The terminal Bst is commonly connected to one terminal of a capacitor 541 provided outside the integrated circuit 500 and a cathode terminal of a diode 542 for blocking a reverse current. The other terminal of the capacitor 541 is connected to the terminal Sw. An anode terminal of the diode 542 is connected to the terminal Gvd to which the voltage GVDD is supplied. Thus, a potential difference between the terminal Bst and the terminal Sw is approximately equalized to a potential difference between both terminals of the capacitor 541, that is, the voltage GVDD. The first gate driver 521 generates the first amplification control signal Hgd having a voltage higher than a voltage of the terminal Sw by the voltage GVDD in response to the input modulation signal Ms, and outputs the first amplification control signal from the terminal Hdr.

The second gate driver 522 operates on a lower potential side than a potential of the first gate driver 521. The second gate driver 522 shifts a level of a voltage value of the signal obtained by inverting the modulation signal Ms output from the comparator 514 using the inverter 515, and outputs the modulation signal from the terminal Ldr as a second amplification control signal Lgd.

Specifically, among power supply voltages of the second gate driver 522, a high potential side is supplied with the voltage GVDD and a low potential side is supplied with the ground potential. The second gate driver 522 generates the second amplification control signal Lgd having a voltage higher than a voltage of the terminal Gnd by the voltage GVDD in response to an inverted signal of the supplied modulation signal Ms, and outputs the second amplification control signal from the terminal Ldr.

The LC discharge circuit 530 includes a resistor 531 and a transistor 532. In the following description, the transistor 532 will be described as an NMOS transistor.

One terminal of the resistor 531 is connected to the terminal Vfb. The other terminal of the resistor 531 is connected to a drain terminal of the transistor 532.

The discharge control signal DIS2 is supplied to a gate terminal of the transistor 532. In addition, a ground potential is supplied to a source terminal of the transistor 532.

In a case where the discharge control signal DIS2 of an H level is supplied to the gate terminal of the transistor 532, the transistor 532 is turned on. At this time, the ground potential is supplied to the terminal Com-Out from which the drive signal COM is output, via the resistors 531 and 571 and the transistor 532. In other words, the transistor 532 is provided to be capable of switching an electrical connection between the terminal Com-Out and the ground potential.

The output circuit 550 includes transistors 551 and 552, resistors 553 and 554, and a low pass filter 560. In the following description, the transistors 551 and 552 are described as NMOS transistors.

A voltage VHV is supplied to a drain terminal of the transistor 551. A gate terminal of the transistor 551 is connected to one terminal of the resistor 553. A source terminal of the transistor 551 is connected to the terminal Sw. The other terminal of the resistor 553 is connected to the terminal Hdr. Thus, the first amplification control signal Hgd is supplied to the gate terminal of the transistor 551.

A drain terminal of the transistor 552 is connected to the source terminal of the transistor 551. A gate terminal of the transistor 552 is connected to one terminal of the resistor 554. The ground potential is supplied to a source terminal of the transistor 552. The other terminal of the resistor 554 is connected to the terminal Ldr. Thus, the second amplification control signal Lgd is supplied to the gate terminal of the transistor 552.

In the transistors 551 and 552 connected as described above, in a case where the transistor 551 is turned off and the transistor 552 is turned on, a potential of a connection point to which the terminal Sw is connected becomes the ground potential, and the voltage GVDD is supplied to the terminal Bst. Meanwhile, in a case where the transistor 551 is turned on and the transistor 552 is turned off, the voltage VHV is supplied to a connection point to which the terminal Sw is connected. Thus, voltage VHV+voltage GVDD is supplied to the terminal Bst. That is, as the capacitor 541 is used as a floating power supply and a voltage of the terminal Sw changes to the ground potential or the voltage VHV according to operations of the transistors 551 and 552, the first gate driver 521 that drives the transistor 551 supplies the first amplification control signal Hgd having the voltage VHV as an L level and having the voltage VHV+the voltage GVDD as an H level to a gate terminal of the transistor 551. The transistor 551 performs a switching operation based on the first amplification control signal Hgd.

The second gate driver 522 for driving the transistor 552 outputs the second amplification control signal Lgd having an L level as the ground potential and an H level as the voltage GVDD regardless of operations of the transistors 551 and 552. Then, the transistor 552 performs a switching operation based on the second amplification control signal Lgd.

Thereby, an amplification modulation signal obtained by amplifying the modulation signal Ms, based on the voltage VHV is generated at a connection point between the source terminal of the transistor 551 and the drain terminal of the transistor 552. That is, the transistors 551 and 552 function as an amplification circuit that amplifies a voltage of the modulation signal Ms. As described above, the first amplification control signal Hgd and the second amplification control signal Lgd for driving the transistors 551 and 552 are in an exclusive relationship. That is, the transistor 551 and the transistor 552 are not turned on at the same time.

The low pass filter 560 includes an inductor 561 and a capacitor 562.

One terminal of the inductor 561 is commonly connected to the source terminal of the transistor 551 and the drain terminal of the transistor 552. The other terminal of the inductor 561 is connected to the terminal Com-Out from which the drive signal COM is output and one terminal of the capacitor 562 in common. The ground potential is supplied to the other terminal of the capacitor 562.

In this way, the inductor 561 and the capacitor 562 smoothen the amplification modulation signal supplied to the connection point between the transistor 551 and the transistor 552. Thereby, the amplification modulation signal is demodulated to generate the drive signal COM.

The first feedback circuit 570 includes a resistor 571 and a resistor 572. One terminal of the resistor 571 is connected to the terminal Com-Out. The other terminal of the resistor 571 is connected to the terminal Vfb and one terminal of the resistor 572 in common. The voltage VHV is supplied to the other terminal of the resistor 572. Thereby, the drive signal COM passing through the first feedback circuit 570 from the terminal Com-Out is pulled up and fed back to the terminal Vfb.

The second feedback circuit 580 includes resistors 581 and 582 and capacitors 583, 584, and 585.

One terminal of the capacitor 583 is connected to the terminal Com-Out. The other terminal of the capacitor 583 is connected to one terminal of the resistor 581 and one terminal of the resistor 582 in common. The ground potential is supplied to the other terminal of the resistor 581. Thereby, the capacitor 583 and the resistor 581 function as a high pass filter. A cutoff frequency of the high-pass filter configured by the capacitor 583 and the resistor 581 is set to, for example, approximately 9 MHz.

The other terminal of the resistor 582 is connected to one terminal of the capacitor 584 and one terminal of the capacitor 585 in common. The ground potential is supplied to the other terminal of the capacitor 584. Thereby, the resistor 582 and the capacitor 584 function as a low pass filter. A cutoff frequency of the low pass filter configured by the resistor 582 and the capacitor 584 is set to, for example, approximately 160 MHz.

Since the second feedback circuit 580 is configured by the high pass filter and the low pass filter in this way, the second feedback circuit 580 functions as a band pass filter for making a predetermined frequency range of the drive signal COM pass through.

The other terminal of the capacitor 585 is connected to the terminal Ifb. Thereby, a DC component of the high frequency components of the drive signal COM that pass through the second feedback circuit 580 is cut off and fed back to the terminal Ifb.

However, the drive signal COM is a signal obtained by smoothening the amplification modulation signal using the low pass filter 560. The drive signal COM is integrated and subtracted through the terminal Vfb, and thereafter, is fed back to the adder 512. Thus, self-excited oscillation occurs at a frequency determined by a feedback delay and a feedback transfer function. However, there is a case where since the amount of delay of a feedback path via the terminal Vfb is large, it is sometimes impossible to increase a self-excited oscillation frequency such that accuracy of the drive signal COM can sufficiently be ensured only by feedback via the terminal Vfb. Therefore, by providing a path for feeding back a high frequency component of the drive signal COM via the terminal Ifb separately from a path via the terminal Vfb, it is possible to reduce a delay as viewed from the entire circuit. Thereby, a frequency of the voltage signal As increases as an accuracy of the drive signal COM can be sufficiently secured, as compared with a case where there is no path through the terminal Ifb.

In the drive signal generation circuit 50 described above, the configuration including the modulation circuit 510, the gate drive circuit 520, the LC discharge circuit 530, the output circuit 550, the capacitor 541, and the diode 542 is an example of a drive circuit 51 that generates the above-described drive signal COM.

1.3 Configuration and Operation of Power Supply Switching Circuit

Figure 6:
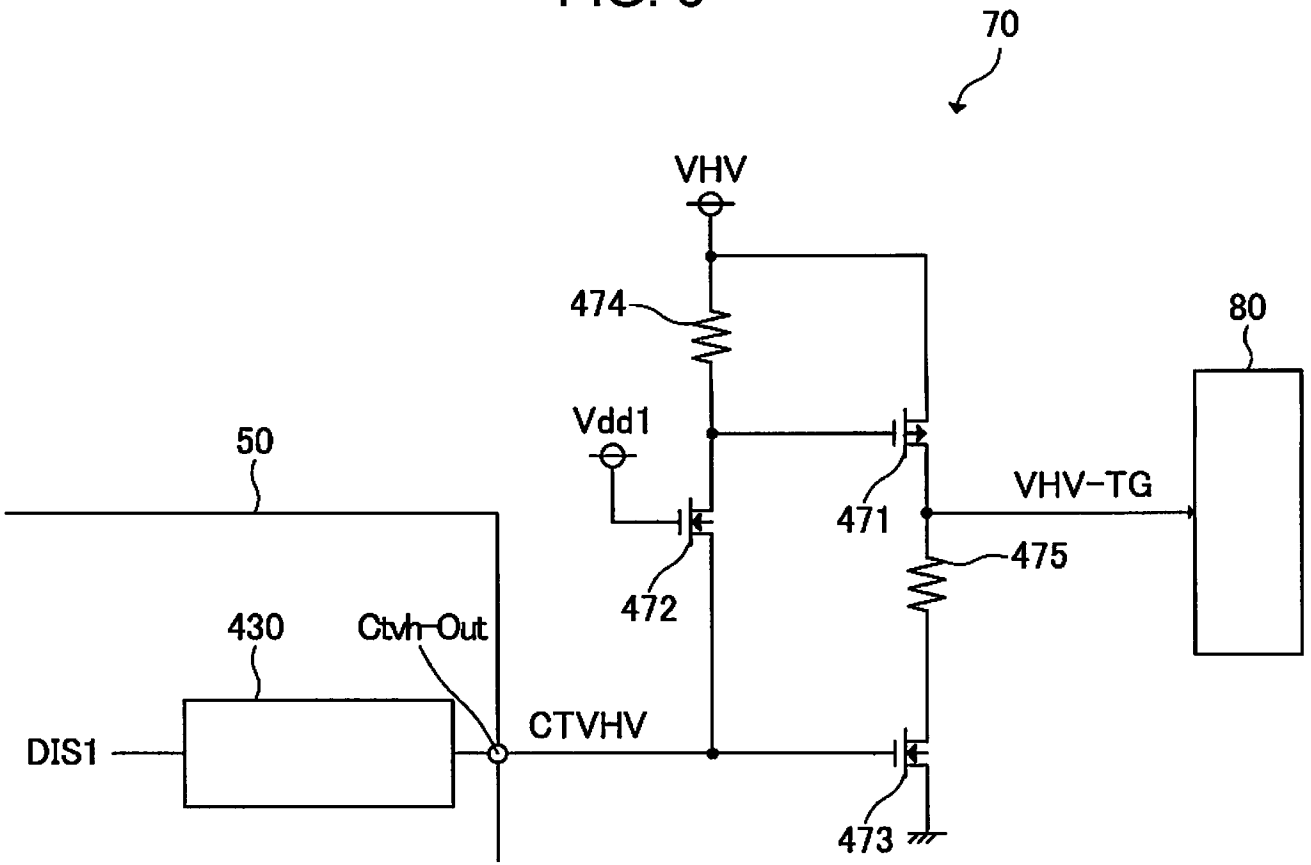
FIG. 6 is a circuit diagram illustrating an electric configuration of a power supply switching circuit.

Next, a configuration and an operation of the power supply switching circuit 70 will be described with reference to FIG. 6. FIG. 6 is a circuit diagram illustrating an electric configuration of the power supply switching circuit 70.

The power supply switching circuit 70 includes transistors 471, 472, and 473 and resistors 474 and 475. In the following description, the transistor 471 is described as a PMOS transistor and the transistors 472 and 473 are described as NMOS transistors.

A source terminal of the transistor 471 is connected to one terminal of the resistor 474 and is supplied with the voltage VHV. A gate terminal of the transistor 471 is connected to the other terminal of the resistor 474 and a drain terminal of the transistor 472 in common. A drain terminal of the transistor 471 is connected to one terminal of the resistor 475.

A voltage Vdd1 is supplied to a gate terminal of the transistor 472. A source terminal of the transistor 472 is connected to a gate terminal of the transistor 473 and is supplied with the power supply control signal CTVHV. Here, the voltage Vdd1 is a DC voltage signal of a certain voltage value.

A drain terminal of the transistor 473 is connected to the other terminal of the resistor 475. The ground potential is supplied to a source terminal of the transistor 473.

The power supply switching circuit 70 configured as described above determines whether or not to supply the voltage VHV to the drive IC 80 as the voltage VHV-TG in response to the power supply control signal CTVHV supplied from the drive signal generation circuit 50.

Specifically, in a case where the discharge control signal DIS1 indicating an inactive state is supplied to the power supply control signal generation circuit 430, the power supply control signal generation circuit 430 sets the terminal Ctvh-Out to the ground potential. Thereby, the power supply control signal CTVHV goes to an L level. Thus, the transistor 473 is turned off, and the transistor 472 is turned on. Thus, the ground potential is supplied to the gate terminal of the transistor 471 via the transistor 472. Thus, the transistor 471 is turned on.

As described above, in a case where the power supply control signal CTVHV is at an L level, the transistor 471 is turned on and the transistor 473 is turned off. Thus, the power supply switching circuit 70 supplies the voltage VHV supplied via the transistor 471 to the drive IC 80 as the voltage VHV-TG.

Meanwhile, in a case where the discharge control signal DIS1 indicating an active state is supplied to the power supply control signal generation circuit 430, the power supply control signal generation circuit 430 sets the terminal Ctvh-Out to high impedance. At this time, a voltage of the terminal Ctvh-Out becomes the voltage Vdd1 supplied via the transistor 472. In other words, the power supply control signal CTVHV goes to an H level. Thereby, the transistor 473 is turned on. At this time, the voltage VHV is supplied to the drain terminal of the transistor 472 and the gate terminal of the transistor 471 via the resistor 474. Thus, the transistor 471 is turned off.

As described above, in a case where the power supply control signal CTVHV is at an H level, the transistor 471 is turned off, and the transistor 473 is turned on. Thus, the power supply switching circuit 70 supplies the ground potential supplied via the resistor 475 and the transistor 472 to the drive IC 80 as the voltage VHV-TG.

1.4 Configuration and Operation of Drive IC

Next, a configuration and an operation of the drive IC 80 will be described.

First, an example of the drive signal COM supplied to the drive IC 80 will be described with reference to FIG. 7. The configuration and operation of the drive IC 80 will be described below with reference to FIGS. 8 to 11.

Figure 7:
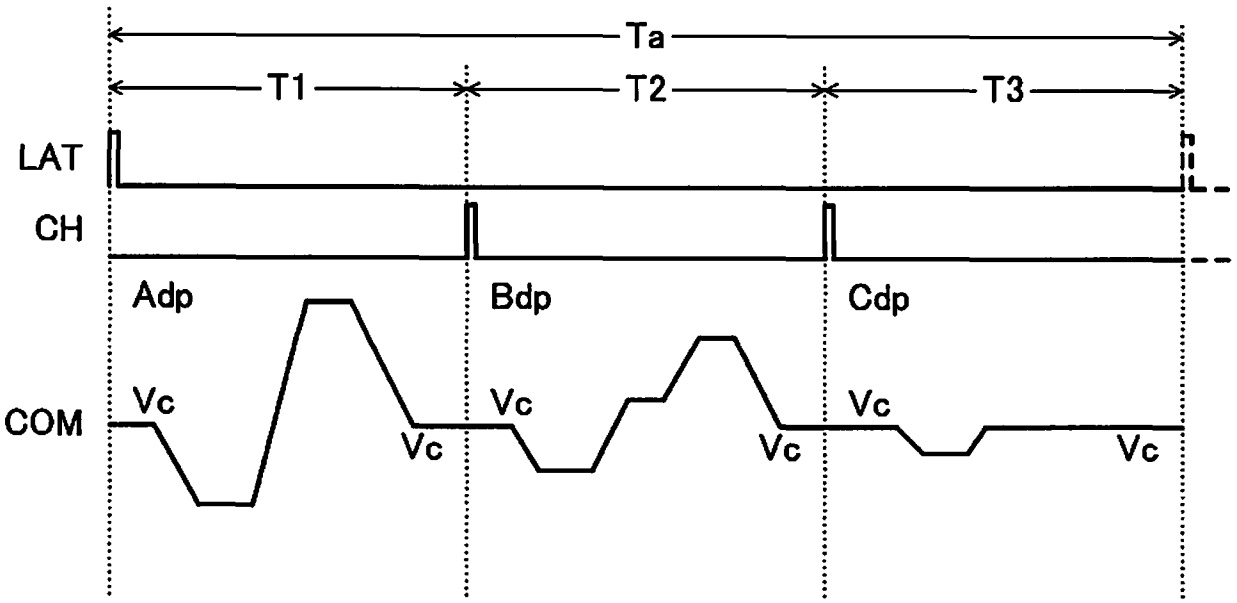
FIG. 7 is a diagram illustrating an example of a drive signal in a print mode.

FIG. 7 is a diagram illustrating an example of the drive signal COM in a print mode. FIG. 7 illustrates a period T1 between a rise of the latch signal LAT and a first rise of the change signal CH, a period T2 between the period T1 and a next rise of the change signal CH, and the period T2, and a period T3 between the period T2 and a next rise of the latch signal LAT. A cycle configured by the periods T1, T2, and T3 is a cycle Ta for forming a new dot on the medium P.

As illustrated in FIG. 7, in the print mode, the drive signal generation circuit 50 generates a voltage waveform Adp during the period T1. In a case where the voltage waveform Adp1 is supplied to the piezoelectric element 60, a predetermined amount of ink, specifically, a medium amount of ink is ejected from the corresponding ejection unit 600.

In addition, the drive signal generation circuit 50 generates a voltage waveform Bdp during the period T2. In a case where the voltage waveform Bdp is supplied to the piezoelectric element 60, a small amount of ink less than the predetermined amount is ejected from the corresponding ejection unit 600.

In addition, the drive signal generation circuit 50 generates a voltage waveform Cdp during the period T3. In a case where the voltage waveform Cdp is supplied to the piezoelectric element 60, the piezoelectric element 60 is displaced to the extent that ink is not ejected from the corresponding ejection unit 600. Thus, the dot is not formed on the medium P. The voltage waveform Cdp is a voltage waveform for preventing a viscosity of the ink from increasing due to a minute vibration of the ink in the vicinity of a nozzle opening portion of the ejection unit 600. In the following description, displacing the piezoelectric element 60 to the extent that ink is not ejected from the ejection unit 600 so as to prevent the viscosity of the ink from increasing is referred to as a "minute vibration".

Here, both a voltage value at a start timing and a voltage value at an end timing of each of the voltage waveform Adp, the voltage waveform Bdp, and the voltage waveform Cdp are a voltage Vc in common. That is, voltage values of the voltage waveforms Adp, Bdp, and Cdp start at the voltage Vc and end at the voltage Vc. Thus, in the print mode, the drive signal generation circuit 50 outputs the drive signal COM having a voltage waveform in which the voltage waveforms Adp, Bdp, and Cdp are continuous during the cycle Ta.

As the piezoelectric element 60 is supplied with the voltage waveform Adp during the period T1 and the voltage waveform Bdp during the period T2, a medium amount of ink and a small amount of ink are ejected from the ejection unit 600 during the cycle Ta. Thereby, a "large dot" is formed on the medium P. In addition, as the piezoelectric element 60 is supplied with the voltage waveform Adp during the period T1 and is not supplied with the voltage waveform Bdp during the period T2, a medium amount of ink is ejected from the ejection unit 600 during the cycle Ta. Thereby, a "medium dot" is formed on the medium P. In addition, as the piezoelectric element 60 is not supplied with the voltage waveform Adp during the period T1 and is supplied with the voltage waveform Bdp during the period T2, a small amount of ink is ejected from the ejection unit 600 during the cycle Ta. Thereby, a "small dot" is formed on the medium P. In addition, as the piezoelectric element 60 is not supplied with the voltage waveforms Adp and Bdp during the periods T1 and T2 and is supplied with the voltage waveform Cdp during the period T3, the ink is not ejected from the ejection unit 600 during the cycle Ta and a minute vibration occurs. In this case, the dot is not formed on the medium P.

Next, an example of the drive signal COM in the standby mode, the transition mode, and the sleep mode will be described. The example of the drive signal COM in the standby mode, the transition mode, and the sleep mode is not illustrated.

In a case of the standby mode, the transition mode and the sleep mode, no ink is ejected to the medium P. Thus, the periods T1, T2, and T3 are not defined. Thus, during the standby mode, the transition mode, and the sleep mode, the latch signal LAT and the change signal CH are signals of an L level.

In the standby mode, the drive signal generation circuit 50 controls such that a voltage value of the drive signal COM approaches a voltage value of the reference voltage signal VBS.

In the sleep mode, the drive signal generation circuit 50 stops an operation. Here, a case where the drive signal generation circuit 50 stops the operation is a case where the drive data signal DRV for stopping generation of the drive signal COM is supplied to the drive signal generation circuit 50, specifically, a case where the drive signal generation circuit 50 outputs a ground potential as the drive signal COM.

In the transition mode, the standby mode is an operation mode shifted to the sleep mode as described above. In the present embodiment, the drive signal generation circuit 50 controls a voltage value of the drive signal COM to approach a voltage value of the reference voltage signal VBS before the mode is shifted to the transition mode and stops an operation after the transition mode is shifted.

Figure 8:
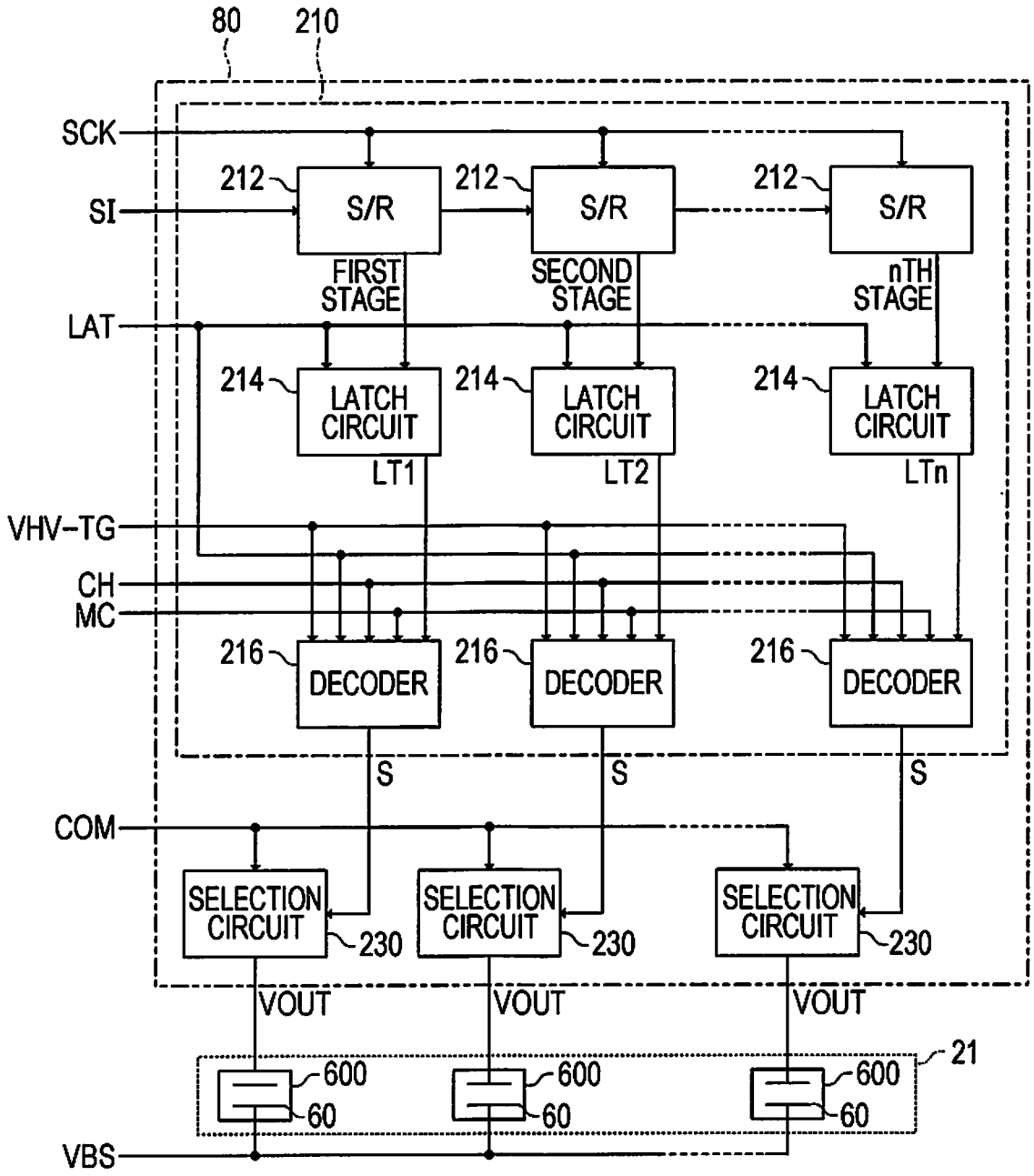
FIG. 8 is a block diagram illustrating an electric configuration of an ejection module and a drive IC.

FIG. 8 is a block diagram illustrating electric configurations of the ejection module 21 and the drive IC 80. As illustrated in FIG. 8, the drive IC 80 includes a selection control circuit 210 and a plurality of selection circuits 230.

The selection control circuit 210 is supplied with the clock signal SCK, the print data signal SI, the latch signal LAT, the change signal CH, the operation mode signal MC, and the voltage VHV-TG. In the selection control circuit 210, a set of a shift register 212 (S/R), a latch circuit 214, and a decoder 216 is provided corresponding to each of the ejection units 600. That is, the head unit 20 is provided with a set of the shift register 212, the latch circuit 214, and the decoder 216 as many as the total number n of the ejection units 600.

The shift register 212 temporarily holds print data [SIH, SIL] of two bits included in the print data signal SI for each corresponding ejection unit 600.

Specifically, the shift registers 212 of the number of stages corresponding to the ejection units 600 are cascade-connected to each other, and the serially supplied print data signal SI is transferred to the subsequent stage in order in response to the clock signal SCK. In FIG. 8, in order to distinguish the shift register 212, the shift registers are denoted as 1, 2, . . . n stages in order from an upstream side to which the print data signals SI is supplied.

Each of the n latch circuits 214 latches the print data [SIH, SIL] held by the corresponding shift register 212 at a rising edge of the latch signal LAT.

Each of the n decoders 216 decodes the print data (SIH, SIL) of two bits latched by the corresponding latch circuit 214 and operation mode data [MCH, MCL] of two bits included in the operation mode signal MC to generate a selection signal S and supplies the selection signal to the selection circuit 230.

The selection circuit 230 is provided corresponding to each of the ejection units 600. That is, the number of selection circuits 230 in one head unit 20 is the same as the total number n of the ejection units 600 included in the head unit 20. The selection circuit 230 controls supply of the drive signal COM to the piezoelectric element 60, based on the selection signal S supplied from the decoder 216.

Figure 9:
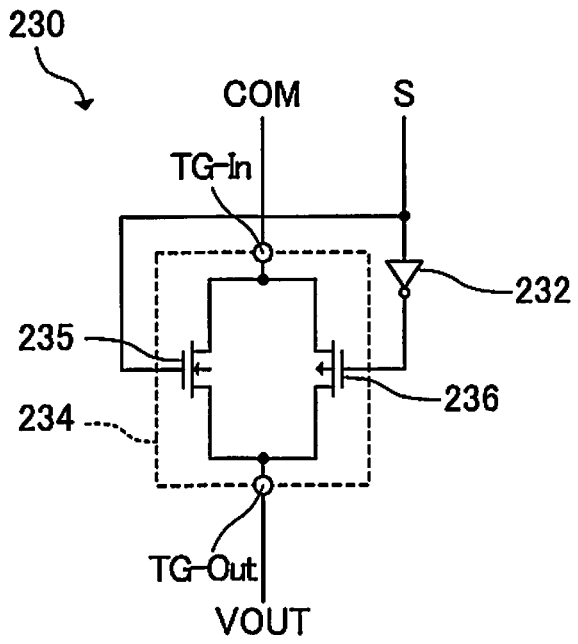
FIG. 9 is a circuit diagram illustrating an electric configuration of a selection circuit.

FIG. 9 is a circuit diagram illustrating an electric configuration of the selection circuit 230 corresponding to one ejection unit 600.

As illustrated in FIG. 9, the selection circuit 230 includes an inverter 232 MOT circuit) and a transfer gate 234. The transfer gate 234 includes a transistor 235 which is an NMOS transistor and a transistor 236 which is a PMOS transistor.

The selection signal S is supplied from the decoder 216 to a gate terminal of the transistor 235. In addition, the selection signal S is logically inverted by the inverter 232 and is also supplied to the gate terminal of the transistor 236.

A drain terminal of the transistor 235 and a source terminal of the transistor 236 are connected to a terminal TG-In. The drive signal COM is supplied to the terminal TG-In. AS the transistor 235 and the transistor 236 are turned on or off in response to the selection signal S, the drive signal VOUT is output from the terminal TG-Out to which the source terminal of the transistor 235 and the drain terminal of the transistor 236 are connected in common and is supplied to the ejection module 21. In the following description, a case where the transistor 235 and the transistor 236 of the transfer gate 234 are controlled to be conductive is referred to as "the transfer gate 234 is turned on", and a case where the transistor 235 and the transistor 236 are controlled to be nonconductive is referred to as "the transfer gate 234 is turned off".

Next, decoded content of the decoder 216 will be described with reference to FIG. 10. FIG. 10 is a diagram illustrating the decode content of the decoder 216.

The print data [SIH, SIL] of two bits, the operation mode data [MCH, MCL] of two bits, the latch signal LAT, and the change signal CH are input to the decoder 216.

In a case where the operation mode data [MCH, MCL] is in the print mode of [1, 1], the decoder 216 outputs the selection signal S of a logic level based on the print data [SIH, SIL] during each of the periods T1, T2, and T3 defined by the latch signal LAT and the change signal CH.

Specifically, in a case where the print data [SIH, SIL] is [1, 1] for defining a "large dot" in the print mode, the decoder 216 outputs the selection signal S which goes to an H level during the period T1, the H level during the period T2, and an L level during the period T3.

In a case where the print data [SIH, SIL] is [1, 0] for defining a "medium dot" in the print mode, the decoder 216 outputs the selection signal S which goes to an H level during the period T1, an L level during the period T2, and the L level during the period T3.

In a case where the print data [SIH, SIL] is [0, 1] for defining a "small dot" in the print mode, the decoder 216 outputs the selection signal S which goes to an L level during the period T1, an H level during the period T2, and the L level during the period T3.

In a case where the print data [SIH, SIL] is [0, 0] for defining a "minute-vibration" in the print mode, the decoder 216 outputs the selection signal S which goes to an L level during the period T1, the L level during the period T2, and an H level during the period T3.

The decoder 216 determines a logic level of the selection signal S regardless of the print data [SIH, SIL] and the periods T1, T2, and T3 in the standby mode, the transition mode, and the sleep mode.

Specifically, the decoder 216 outputs the selection signal S of an H level in a case where the operation mode data [MCH, MCL] is in the standby mode of [1, 0].

In a case where the operation mode data [MCH, MCL] is in the transition mode of [0, 0], the decoder 216 outputs the selection signal S of an L level.

In a case where the operation mode data [MCH, MCL] is in the sleep mode of [0, 1], the decoder 216 outputs the selection signal S of an L level.

Here, the logic level of the selection signal S is shifted to a high amplitude logic based on the voltage VHV-TG by a level shifter (not illustrated).

An operation in which the drive signal VOUT is generated based on the drive signal COM and is supplied to the ejection unit 600 included in the ejection module 21 in the drive IC 80 described above will be described with reference to FIG. 11.

Figure 11:
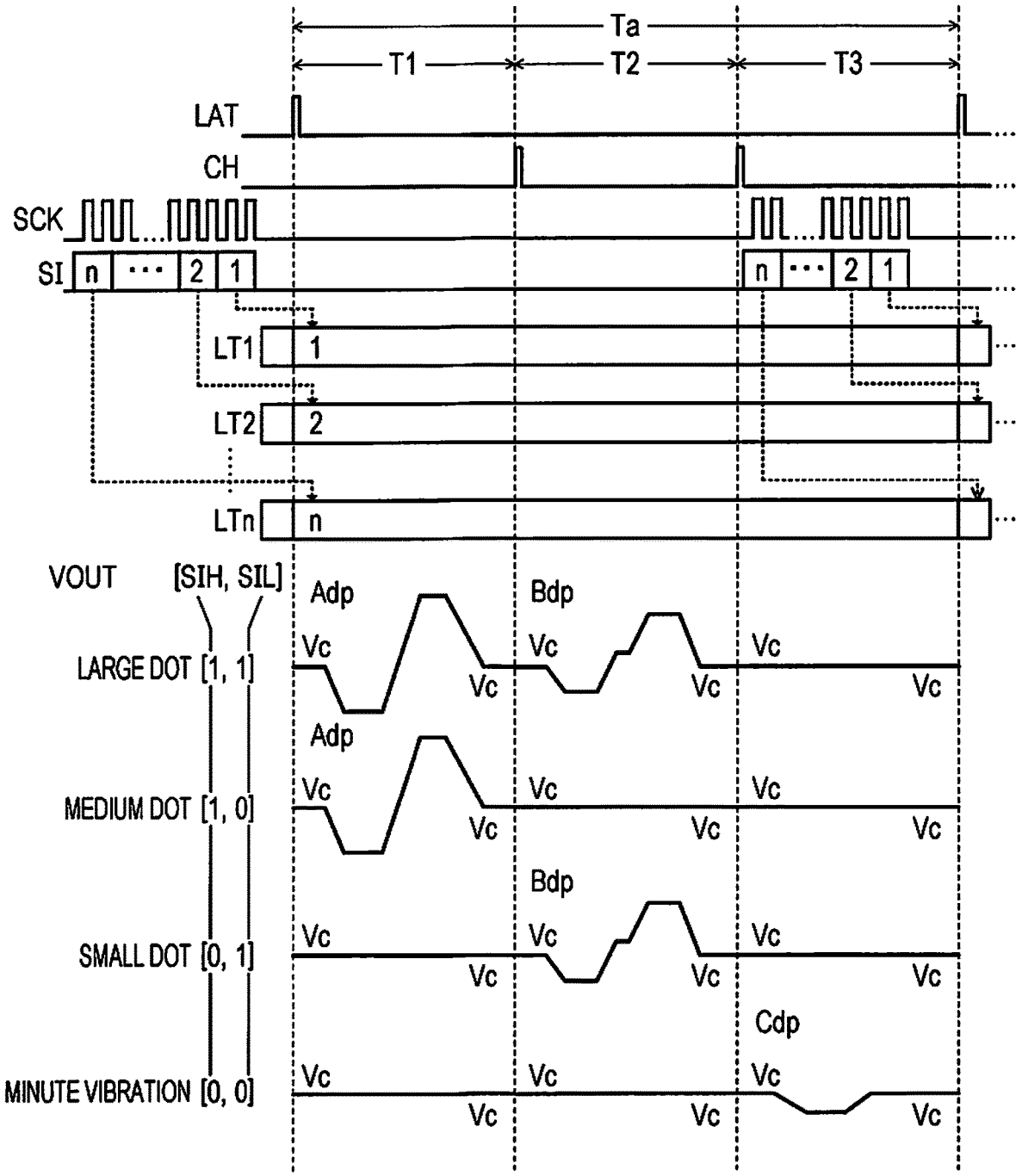
FIG. 11 is a diagram illustrating an operation of the drive IC in a print mode.

FIG. 11 is a diagram illustrating the operation of the drive IC 80 in the print mode.

In the print mode, the print data signals SI are serially supplied in synchronization with the clock signal SCK, and are sequentially transferred in the shift register 212 corresponding to the ejection unit 600. If supplying the clock signal SCK stops, the print data [SIH, SIL] corresponding to the ejection unit 600 is held in each of the shift registers 212. The print data signals SI are supplied in the order corresponding to a last n stage, . . . , a second stages, a first stage of the ejection unit 600 in the shift register 212.

Here, if the latch signal LAT rises, each of the latch circuits 214 latches the print data [SIH, SIL] held in the corresponding shift register 212 all at once. In FIG. 11, LT1, LT2, LTn indicate print data [SIH, SIL] latched by the latch circuit 214 corresponding to the shift registers 212 of the first stage, the second stage, . . . , the nth stage.

The decoder 216 outputs the selection signals S of the logic levels according to the content illustrated in FIG. 10, in each of the periods T1, T2, and T3, depending on a size of the dot defined by the latched print data [SIH, SIL].

In a case where the print data [SIH, SIL] is [1, 1], the selection circuit 230 selects the voltage waveform Adp in the period T1, selects the voltage waveform Bdp in the period T2, and does not select the voltage waveform Cdp in the period T3, according to the selection signal S. As a result, the drive signal VOUT corresponding to the large dot illustrated in FIG. 11 is supplied to the ejection unit 600.

In a case where the print data [SIH, SIL] is [1, 0], the selection circuit 230 selects the voltage waveform Adp in the period T1, does not select the voltage waveform Bdp in the period T2, and does not select the voltage waveform Cdp in the period T3, according to the selection signals S. As a result, the drive signal VOUT corresponding to the medium dot illustrated in FIG. 11 is supplied to the ejection unit 600.

In a case where the print data [SIH, SIL] is [0, 1], the selection circuit 230 selects the voltage waveform does not select the voltage waveform Adp in the period T1, selects the voltage waveform Bdp in the period T2, and does not select the voltage waveform Cdp in the period T3, according to the selection signals S. As a result, the drive signal VOUT corresponding to the small dot illustrated in FIG. 11 is supplied to the ejection unit 600.

In a case where the print data [SIH, SIL] is [0, 0], the selection circuit 230 does not select the voltage waveform Adp in the period T1, does not select the voltage waveform Bdp in the period T2, and selects the voltage waveform Cdp in the period T3, according to the selection signals S. As a result, the drive signal VOUT corresponding to the minute vibration illustrated in FIG. 11 is supplied to the ejection unit 600.

Printing is not performed in the standby mode, the transition mode, and the sleep mode. Accordingly, in the standby mode, the transition mode, and the sleep mode according to the first embodiment, the clock signal SCK and the print data signal SI are also at an L level in addition to the latch signal LAT and the change signal CH. Thus, the shift register 212 and the latch circuit 214 do not operate. Thus, as described above, in the standby mode, the transition mode, and the sleep mode, the decoder 216 determines a logic level of the selection signal S in response to the operation mode signal MC.

In a case where the operation mode data [MCH, MCL] is in the standby mode of [1, 0], the selection circuit 230 selects the drive signal COM having a voltage value equivalent to the reference voltage signal VBS in response to the selection signal S of an H level supplied thereto. As a result, the drive signal VOUT having the same voltage value as the reference voltage signal VBS is supplied to the ejection unit 600.

In a case where the operation mode data [MCH, MCL] is in the transition mode of [0, 0], the selection circuit 230 makes the transfer gate 234 nonconductive in response to the selection signal S of an L level supplied thereto. As a result, the drive signal COM is not supplied to the ejection unit 600 as the drive signal VOUT.

In a case where the operation mode data [MCH, MCL] is in the sleep mode of [0, 1], the selection circuit 230 does not select the drive signal COM as the drive signal VOUT in response to the selection signal S of an L level supplied thereto. As a result, a voltage supplied immediately before is held in the piezoelectric element 60.

1.5 Configuration and Operation of Ejection Unit

Figure 12:
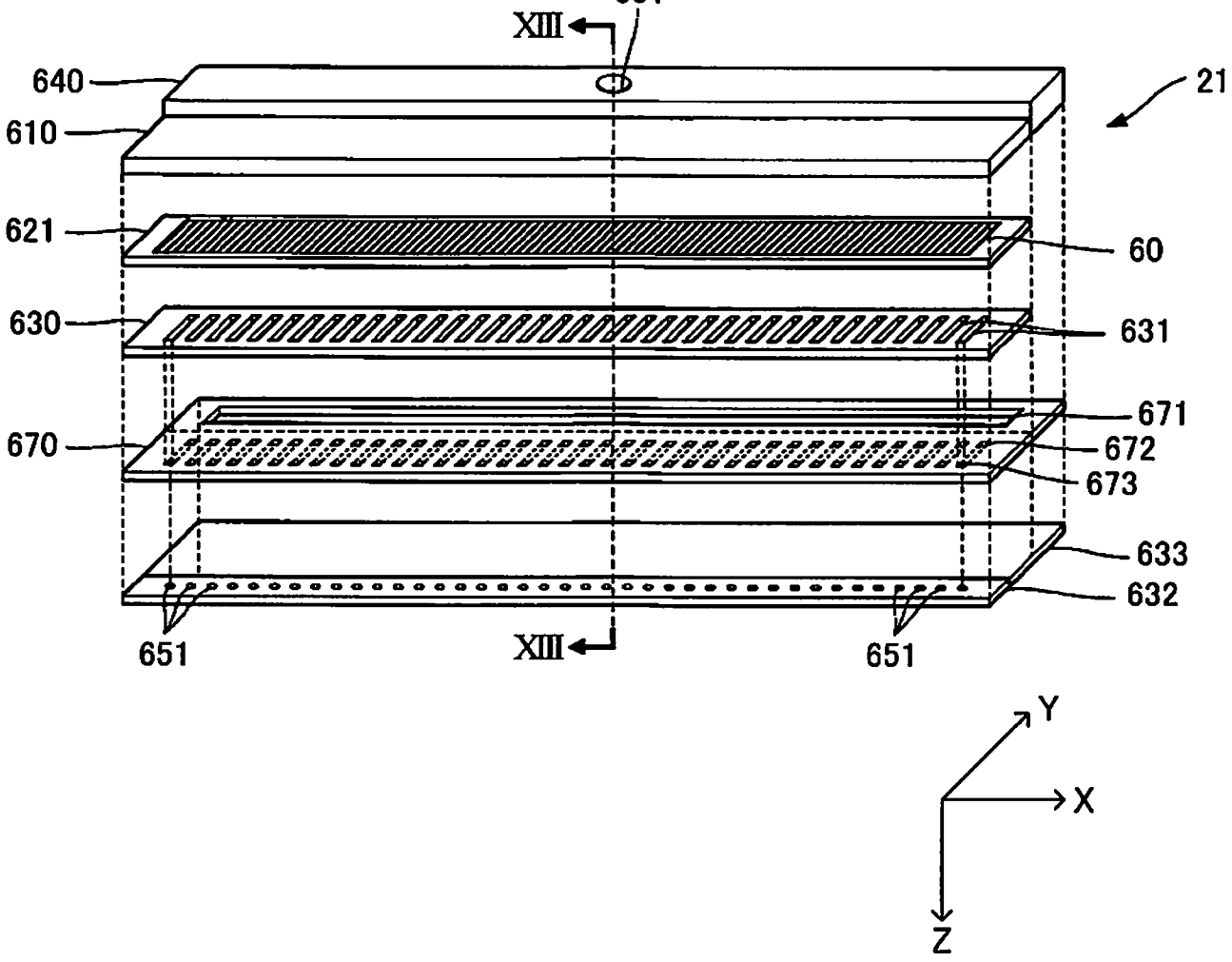
FIG. 12 is an exploded perspective view of the ejection module.
Figure 13:
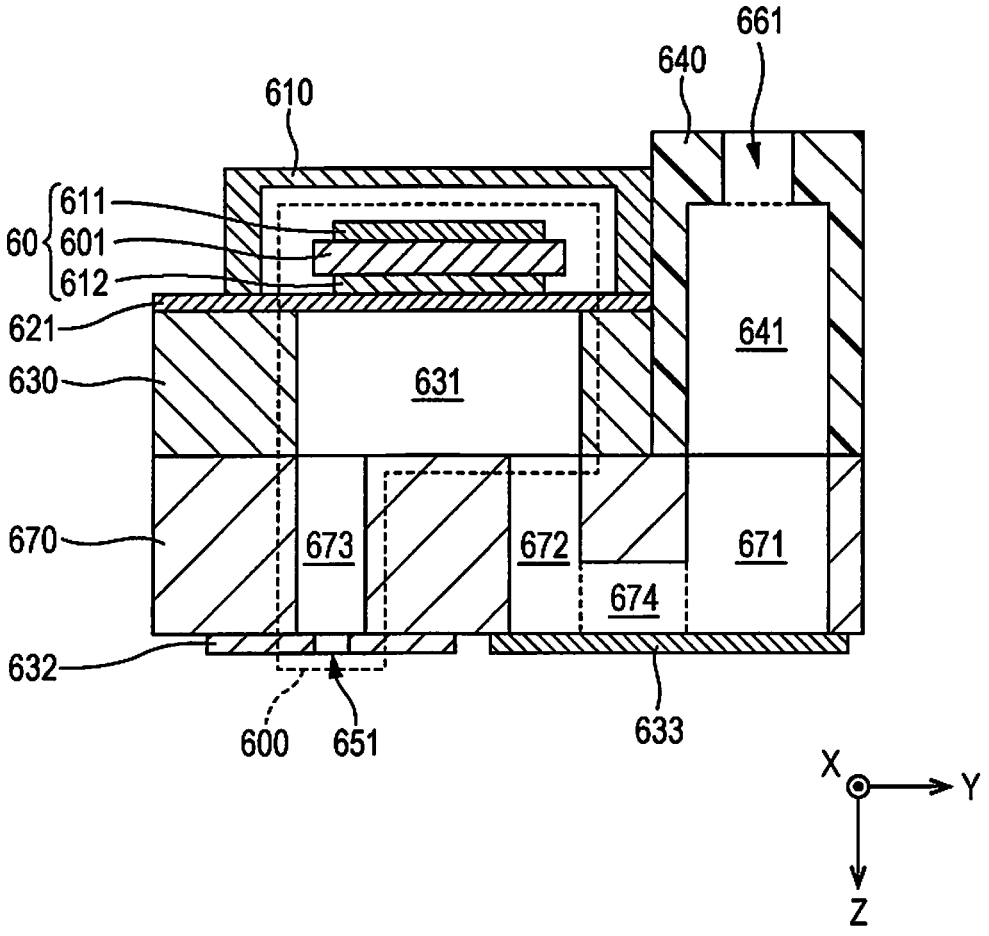
FIG. 13 is a cross-sectional view illustrating a schematic configuration of an ejection unit.

Next, configurations and operations of the ejection module 21 and the ejection unit 600 will be described. FIG. 12 is an exploded perspective view of the ejection module 21. FIG. 13 is a cross-sectional view taken along line XIII-XIII of FIG. 12 and is a cross-sectional view illustrating a schematic configuration of the ejection unit 600.

As illustrated in FIGS. 12 and 13, the ejection module 21 includes a substantially rectangular flow path substrate 670 elongated in the direction X. A pressure chamber substrate 630, a vibration plate 621, a plurality of the piezoelectric elements 60, a housing portion 640, and a sealing body 610 are provided on one surface side of the flow path substrate 670 in the direction Z. A nozzle plate 632 and a vibration absorber 633 are provided on the other surface side of the flow path substrate 670 in the direction Z. Each configuration of the ejection module 21 is a substantially rectangular member elongated in the direction X in the same manner as the flow path substrate 670 and is bonded to each other using an adhesive or the like.

As illustrated in FIG. 12, the nozzle plate 632 is a plate-like member in which a plurality of nozzles 651 are aligned in the direction X. The nozzles 651 are openings which are provided in the nozzle plate 632 and communicate with cavities 631 that will be described below.

The flow path substrate 670 is a plate-like member for forming a flow path of ink. As illustrated in FIGS. 12 and 13, an opening 671, supply flow paths 672, and communication flow paths 673 are formed in the flow path substrate 670. The opening 671 is an elongated through-hole that passes through the flow path substrate in the direction Z, is commonly formed in the plurality of nozzles 651, and extends in the direction X. The supply flow path 672 and the communication flow path 673 are through-holes formed corresponding to each of the plurality of nozzles 651. Furthermore, as illustrated in FIG. 13, a relay flow paths 674 commonly formed in the plurality of supply flow paths 672 are provided on one surface of the flow path substrate 670 in the direction Z. The relay flow paths 674 communicates with the opening 671 and the plurality of supply flow paths 672.

The housing portion 640 is, for example, a structure formed by injection molding of a resin material and is fixed to the other surface of the flow path substrate 670 in the direction Z. As illustrated in FIG. 13, a supply flow path 641 and a supply hole 661 are formed in the housing portion 640. The supply flow path 641 is a recess corresponding to the opening 671 of the flow path substrate 670, and the supply hole 661 is a through-hole that communicates with the supply flow path 641. A space in which the opening 671 of the flow path substrate 670 and the supply flow path 641 of the housing portion 640 communicate with each other functions as a reservoir for storing the ink supplied from the supply hole 661.

The vibration absorber 633 is configured to absorb a pressure vibration occurring inside the reservoir. Specifically, the vibration absorber 633 is fixed to one surface side of the flow path substrate 670 in the direction Z so as to close the opening 671, the relay flow path 674, and the plurality of supply flow paths 672 on the flow path substrate 670 to form a bottom surface of the reservoir. The vibration absorber 633 is configured to include, for example, a compliance substrate which is a flexible sheet member capable of being elastically transformed.

As illustrated in FIGS. 12 and 13, the pressure chamber substrate 630 is a plate-like member in which the plurality of cavities 631 corresponding to the plurality of nozzles 651 are formed. The plurality of cavities 631 have a shape elongated in the direction Y, and are arranged side by side in the direction X. One end portion of the cavity 631 in the direction Y communicates with the supply flow path 672, and the other terminal portion of the cavity 631 in the direction Y communicates with the communication flow path 673.

As illustrated in FIGS. 12 and 13, the vibration plate 621 is fixed to a surface of the pressure chamber substrate 630 opposite to a surface of the pressure chamber substrate to which the flow path substrate 670 is connected. The vibration plate 621 is a plate-like member capable of being elastically transformed. Specifically, as illustrated in FIG. 13, the flow path substrate 670 and the vibration plate 621 face each other at intervals inside the cavity 631. That is, the vibration plate 621 configures an upper surface which is a part of a wall surface of the cavity 631.

The cavity 631 is located between the flow path substrate 670 and the vibration plate 621 and functions as a pressure chamber that applies a pressure to the ink filled in the cavity 631.

As illustrated in FIGS. 12 and 13, the plurality of piezoelectric elements 60 are provided on a surface of the vibration plate 621 on the side opposite to the cavity 631. In other words, the vibration plate 621 is provided between the cavity 631 and the piezoelectric element 60. The plurality of piezoelectric elements 60 are arranged in the direction X so as to correspond to the plurality of cavities 631. As the vibration plate 621 vibrates in conjunction with a transformation of the piezoelectric element 60, a pressure inside the cavity 631 varies, and ink is ejected from the nozzle 651. Specifically, the piezoelectric element 60 is an actuator that is transformed when the drive signal VOUT is supplied, and as illustrated in FIG. 13, the piezoelectric element 60 has a structure in which a piezoelectric body 601 is interposed between a pair of electrodes 611 and 612. The drive signal VOUT is supplied to the electrode 611, and the reference voltage signal VBS is supplied to the electrode 612. In this case, a central portion of the piezoelectric body 601 is transformed together with the vibration plate 621 in the vertical direction with respect to both end portions of the piezoelectric element 60, according to a potential difference between the electrode 611 and the electrode 612. Ink is ejected from the nozzle 651 according to the transformation of the piezoelectric element 60. Here, the vibration plate 621 is displaced by the piezoelectric element 60 and functions as a diaphragm which enlarges and reduces an internal volume of the cavity 631 filled with the ink. The electrode 611 included in the piezoelectric element 60 is an example of the first electrode, and the electrode 612 is an example of the second electrode.

The sealing body 610 illustrated in FIGS. 12 and 13 has a structure which protects the plurality of piezoelectric elements 60 and reinforces mechanical strengths of the pressure chamber substrate 630 and the vibration plate 621, and is fixed to the vibration plate 621 by, for example, an adhesive. The plurality of piezoelectric elements 60 are contained inside a recess formed on a surface of the sealing body 610 facing the vibration plate 621.

In the ejection module 21 configured as described above, the ejection unit 600 is configured to include the piezoelectric elements 60, the cavity 631, the vibration plate 621, and the nozzle 651.

Figure 14:
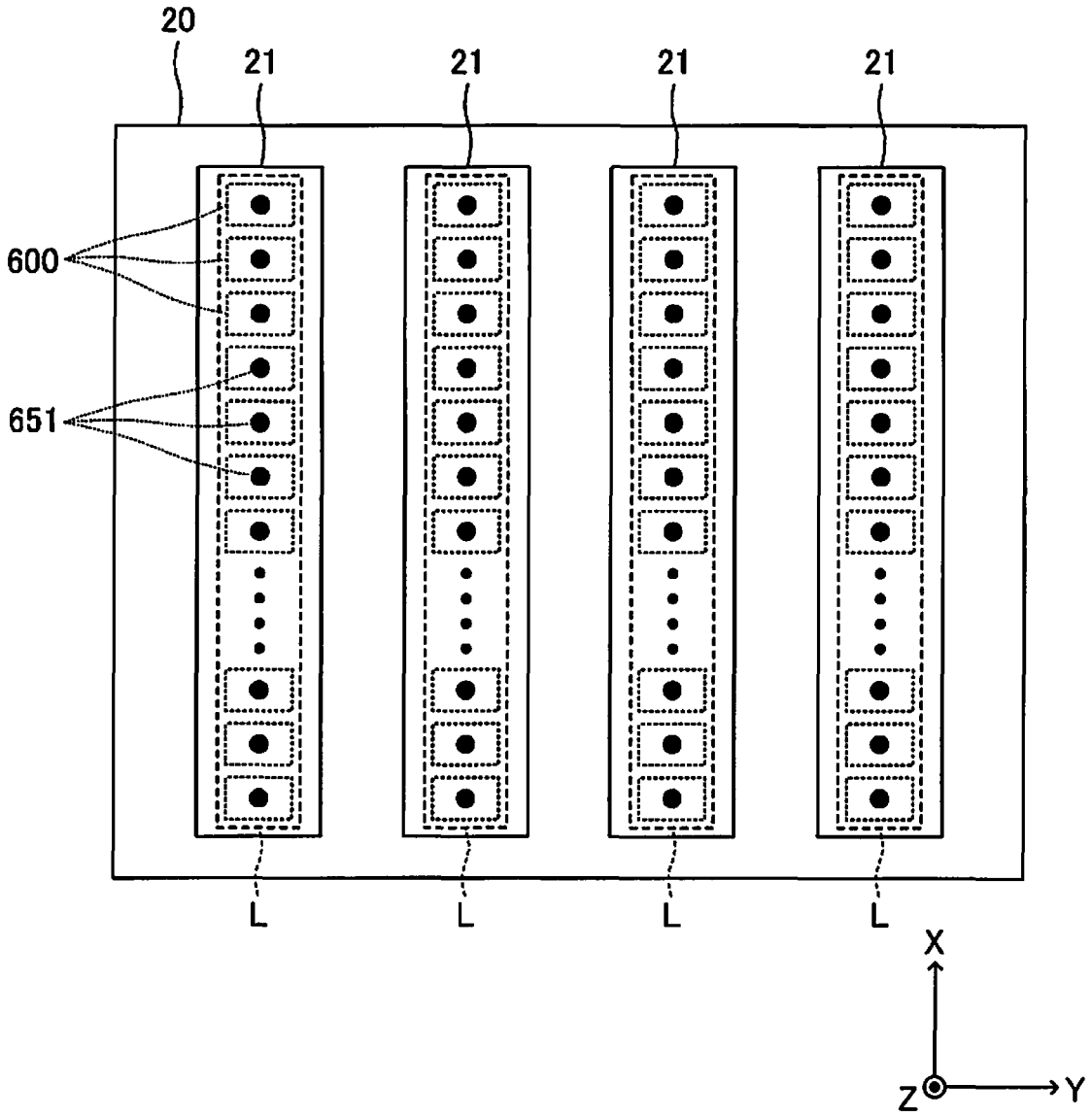
FIG. 14 is a diagram illustrating an example of the ejection module and arrangement of a plurality of nozzles provided in the ejection module.

FIG. 14 is a diagram illustrating an example of arrangements of the ejection modules 21 and the plurality of nozzles 651 provided in the ejection modules 21, in a case where the liquid ejecting apparatus 1 is viewed in a plan view in the direction Z. In FIG. 14, it will be described that the head unit 20 includes four ejection modules 21.

As illustrated in FIG. 14, in each ejection module 21, a nozzle row L configured by the plurality of nozzles 651 arranged in a row in a predetermined direction is formed. Each nozzle row L is configured by n nozzles 651 arranged in a row in the direction X.

The nozzle row L illustrated in FIG. 14 is an example and may have a different configuration. For example, in each nozzle row L, the n nozzles 651 may be arranged in a staggered manner such that locations in the direction Y differ between the even-numbered nozzle 651 and the odd-numbered nozzle 651 which are counted from ends thereof. In addition, each nozzle row L may be formed in a direction different from the direction X. In the first embodiment, the number of rows of the nozzle rows L provided in each ejection module 21 is exemplified as "1", but "two" or more nozzle rows L may be formed in each ejection module 21.

Here, in the first embodiment, the n nozzles 651 forming the nozzle row L are provided at a high density of 300 or more per inch in the ejection module 21. Accordingly, in the ejection module 21, the piezoelectric elements 60 are also provided at a high density corresponding to the n nozzles 651.

In the first embodiment, it is preferable that the piezoelectric body 601 used for the piezoelectric element 60 be a thin film having, for example, a thickness smaller than or equal to 1 μm. Thereby, the amount of displacement of the piezoelectric element 60 with respect to a potential difference between the electrode 611 and the electrode 612 can increase.

Figure 15:
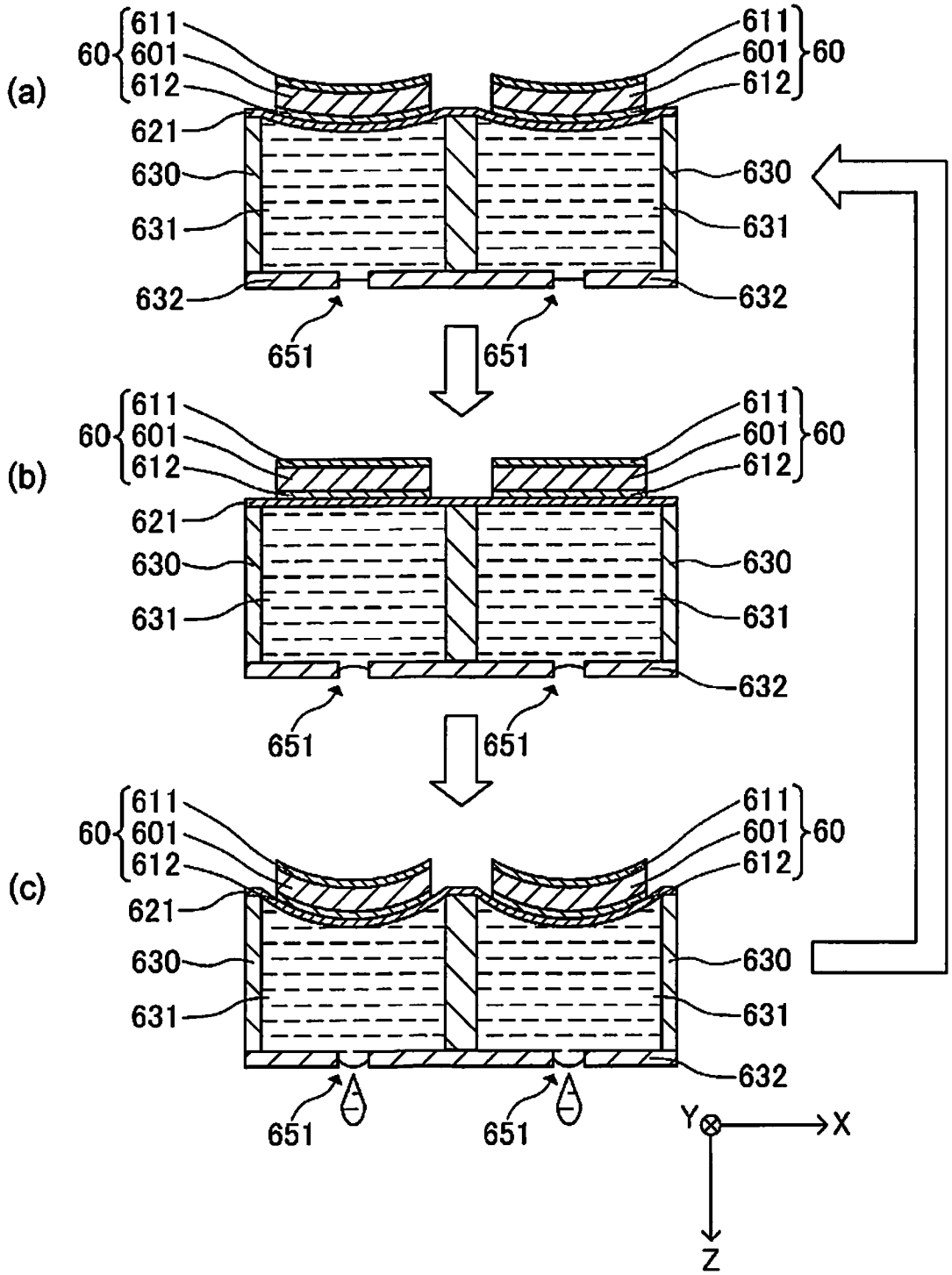
FIG. 15 is a diagram illustrating a relationship between displacement of a piezoelectric element and a vibration plate and ejection.

Here, an ejection operation of ink ejected from the nozzle 651 will be described with reference to FIG. 15. FIG. 15 is a diagram illustrating a relationship between displacements of the piezoelectric element 60 and the vibration plate 621 and ejection, in a case where the drive signal VOUT is supplied to the piezoelectric element 60. FIG. 15 is a cross-sectional view of two piezoelectric elements 60, two cavities 631, and two nozzles 651 included in the ejection module 21 as viewed in the direction Y. (a) of FIG. 15 schematically illustrates displacements of the piezoelectric element 60 and the vibration plate 621 in a case where the voltage Vc is supplied as the drive signal VOUT. (b) of FIG. 15 schematically illustrates displacements of the piezoelectric element 60 and the vibration plate 621 in a case where a voltage value of the drive signal VOUT supplied to the piezoelectric element 60 is controlled to approach the reference voltage signal VBS from the voltage Vc. FIG. 15C schematically illustrates displacements of the piezoelectric element 60 and the vibration plate 621 in a case where the voltage value of the drive signal VOUT supplied to the piezoelectric element 60 is controlled to be away from the reference voltage signal VBS rather than the voltage Vc.

In (a) of FIG. 15, the piezoelectric element 60 and the vibration plate 621 is bent in the direction Z according to a potential difference between the drive signal VOUT supplied to the electrode 611 and the reference voltage signal VBS supplied to the electrode 612. At this time, the electrode 611 is supplied with the voltage Vc as the drive signal VOUT. As described above, the voltage Vc has a voltage value at the start timing and the end timing of the voltage waveforms Adp, Bdp, and Cdp. That is, a state of the piezoelectric element 60 and the vibration plate 621 illustrated in (a) of FIG. 15 is a reference state of the piezoelectric element 60 in the print mode.

In a case where the voltage value of the drive signal VOUT is controlled to approach a voltage value of the reference voltage signal VBS, as illustrated in (b) of FIG. 15, the displacements of the piezoelectric element 60 and the vibration plate 621 occurring in the direction Z are reduced. At this time, an internal volume of the cavity 631 is enlarged, and ink is supplied from the reservoir to the cavity 631.

Thereafter, the voltage value of the drive signal VOUT is controlled to be away from the voltage value of the reference voltage signal VBS. At this time, the displacements of the piezoelectric element 60 and the vibration plate 621 in the direction Z increases as illustrated in (c) of FIG. 15. At this time, the internal volume of the cavity 631 is reduced, and the ink filled in the cavity 631 is ejected from the nozzle 651.

In the first embodiment, as the drive signal VOUT is supplied to the piezoelectric element 60, the states illustrated in FIG. 15 are repeated. Thereby, the ink is ejected from the nozzle 651, and dots are formed on the medium P. The displacements of the piezoelectric element 60 and the vibration plate 621 illustrated in FIG. 15 increase in the direction Z as the potential difference between the drive signal VOUT supplied to the electrode 611 and the reference voltage signal VBS supplied to the electrode 612 increases. In other words, the amount of ejection of the ink ejected from the nozzle 651 is controlled depending on the potential difference between the drive signal VOUT and the reference voltage signal VBS.

The displacements of the piezoelectric element 60 and the vibration plate 621 with respect to the drive signal VOUT illustrated in FIG. 15 are merely an example. For example, in a case where the potential difference between the drive signal VOUT and the reference voltage signal VBS increases, ink may be injected into the cavity 631, and in a case where the potential difference between the drive signal VOUT and the reference voltage signal VBS is reduced, the ink filled in the cavity 631 may be ejected from the nozzle 651.

1.6 Details of Transition Mode and Electric Discharge of Piezoelectric Element

As described above, in the sleep mode, the transfer gate 234 included in the selection circuit 230 is turned off. Ideally, a voltage and a current supplied to the electrode 611 in the sleep mode are blocked by the transfer gate 234. Thus, a voltage immediately before the transfer gate 234 is turned off is held in the electrode 611. Thus, by making the voltage supplied to the electrode 611 approach the voltage of the reference voltage signal VBS supplied to the electrode 612 immediately before the transfer gate 234 is turned off, the displacement occurring in the piezoelectric element 60 in the sleep mode can be reduced.

However, the transfer gate 234 and the piezoelectric element 60 have resistance components. Accordingly, even in a case where the transfer gate 234 is turned off, a leakage current is supplied to the electrode 611 via the resistance components of the transfer gate 234 and the piezoelectric element 60. Accordingly, electric charges caused by the leakage current are accumulated in the electrode 611. Thus, a voltage value of the electrode 611 increases, and an unintentional displacement may occur in the piezoelectric element 60.

Figure 16:
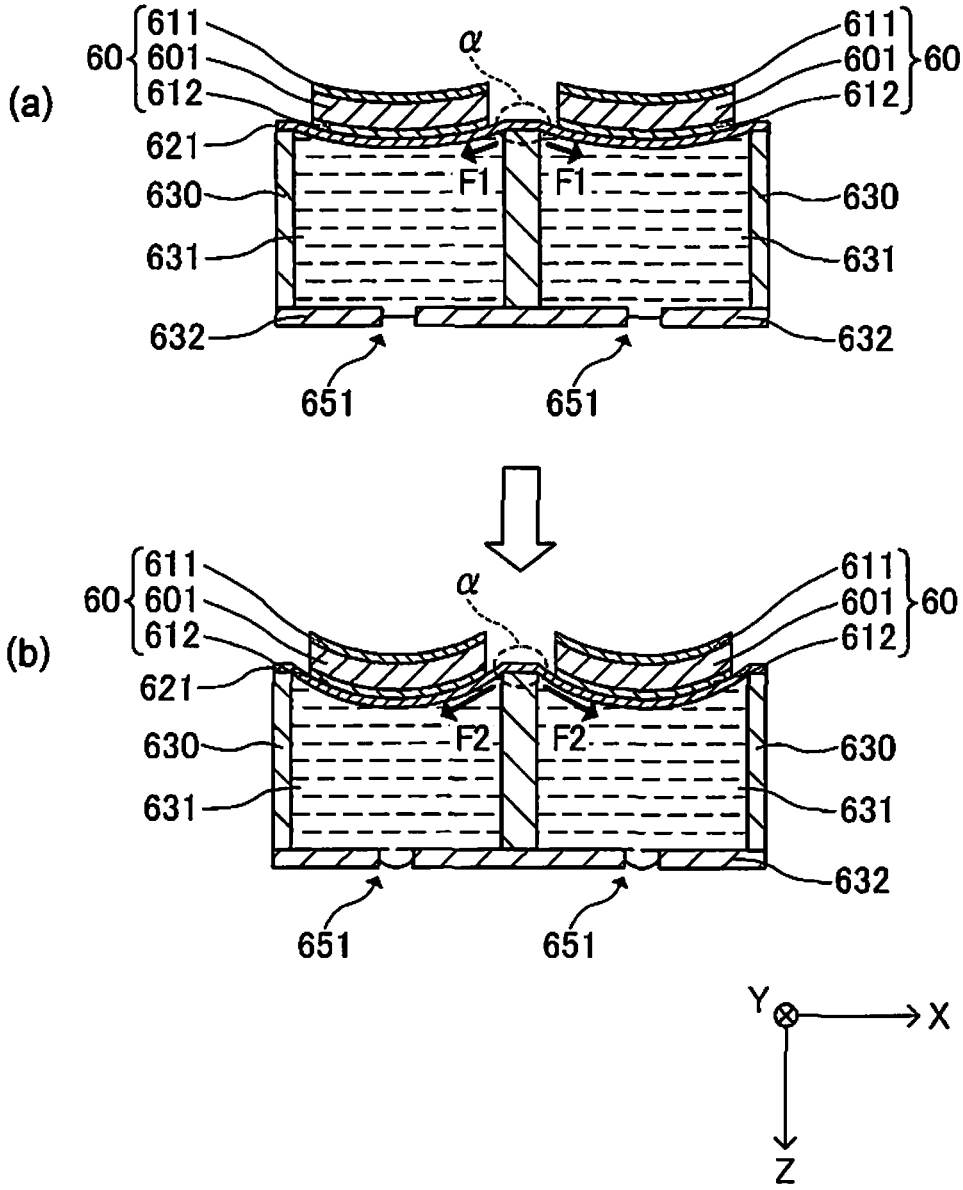
FIG. 16 is diagram schematically illustrating the displacements of the piezoelectric element and the vibration plate in a case where a voltage value of an electrode of the piezoelectric element increases.

FIG. 16 is a diagram schematically illustrating the displacements of the piezoelectric element 60 and the vibration plate 621 in a case where the voltage value of the electrode 611 increases due to the leakage current. FIG. 16 is a cross-sectional view of two piezoelectric elements 60, two cavities 631, and two nozzles 651 included in the ejection module 21 as viewed in the direction Y. (a) of FIG. 16 illustrates the displacements of the piezoelectric element 60 and the vibration plate 621 immediately after the mode is shifted to the sleep mode. (b) of FIG. 16 illustrates the displacements of the piezoelectric element 60 and the vibration plate 621 in a case where electric charges are accumulated in the electrode 611 due to the leakage current generated in the transfer gate 234 and the piezoelectric element 60.

As illustrated in (a) of FIG. 16, the piezoelectric element 60 immediately after the mode is shifted to the sleep mode is displaced based on a potential difference between a voltage of the electrode 611 and a voltage of the electrode 612. At this time, a voltage immediately before the mode is shifted to the sleep mode is held in the electrode 611. That is, the voltage of the electrode 611 immediately after the mode is shifted to the sleep mode is a voltage assumed to be held in the electrode 611. Thus, the piezoelectric element 60 is displaced within an assumed range, and likewise the vibration plate 621 is displaced within an assumed range. At this time, a stress F1 within the assumed range occurs at a contact point a between the vibration plate 621 and the cavity 631.

(a) of FIG. 16 exemplifies a case where the voltage of the electrode 611 and the voltage of the electrode 612 are different immediately before the mode is shifted to the sleep mode, but it is preferable that the voltage of the electrode 611 be equal to the voltage of the electrode 612. In this case, displacement does not occur in the piezoelectric element 60 and the vibration plate 621.

In a case where electric charges are accumulated in the electrode 611 due to a leakage current or the like, the potential difference between the voltage of the electrode 611 and the voltage of the electrode 612 increases, and as illustrated in (b) of FIG. 16, the displacement of piezoelectric element 60 increases. Thus, the displacement of the vibration plate 621 also increases. At this time, a stress F2 larger than expected may occur at the contact point a between the vibration plate 621 and the cavity 631.

The stress occurring at the contact point between the vibration plate 621 and the cavity 631 may be different depending on a location of the contact point between the vibration plate 621 and the cavity 631 in the direction Y. Specifically, the stress occurring at the contact point between the vibration plate 621 and the cavity 631 is larger at a point which is the contact point between the vibration plate 621 and the cavity 631 and in which a displacement of the vibration plate 621 in the direction Z is maximum.

Figure 17:
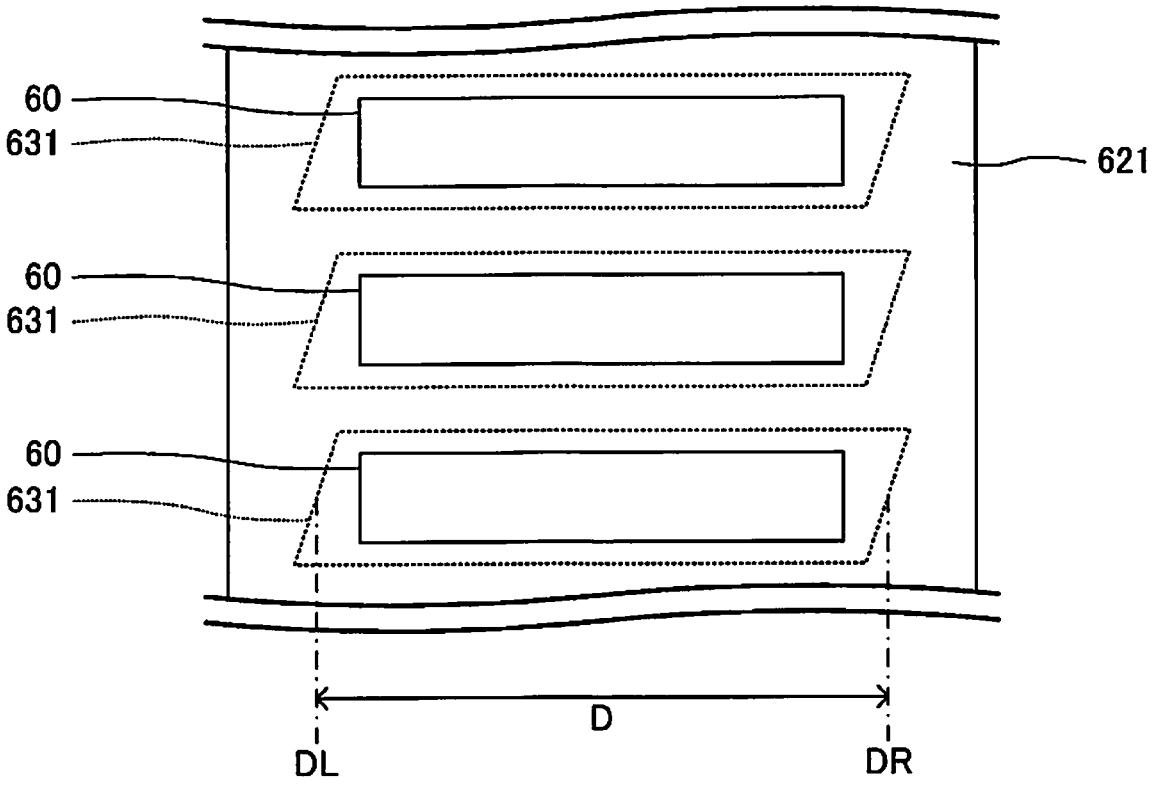
FIG. 17 is a plan view of the vibration plate viewed in a direction Z.

For example, a natural vibration generated in the vibration plate 621 can be used as a factor of the displacement occurring in the vibration plate 621. FIG. 17 is a plan view in a case where the vibration plate 621 is viewed in the direction Z. As illustrated in FIG. 17, the cavity 631 according to the present embodiment has a shape elongated in the direction Y, and a natural vibration in the direction Y may occur in the vibration plate 621 in some cases. The natural vibration occurs in a vibration region D between a first contact point DL where the vibration plate 621 is in contact with the cavity 631 and a second contact point DR.

Figure 18:
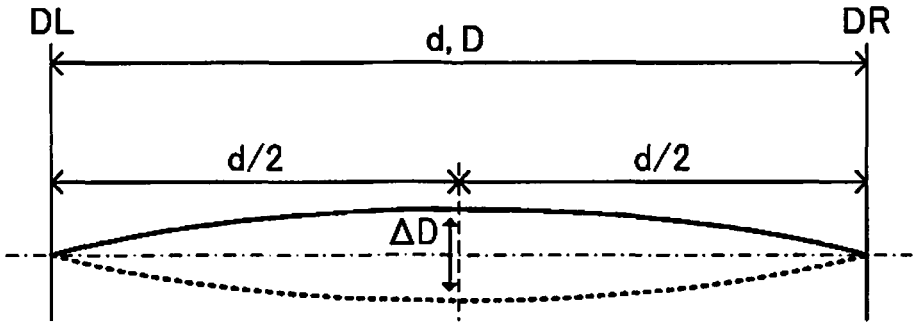
FIG. 18 is a diagram exemplifying a case where a primary natural vibration is generated in the vibration plate.

FIG. 18 is a diagram exemplifying a case where a primary natural vibration occurs in the vibration plate 621. As illustrated in FIG. 18, in a case where the primary natural vibration occurs in the vibration plate 621, a displacement ΔD of the vibration plate 621 due to the natural vibration is maximum at the center of a vibration region D. Specifically, in a case where a distance from the first contact point DL to the second contact point DR in the vibration region D is d, the displacement ΔD of the vibration plate 621 is maximum at a point where a distance from the first contact point DL is d/2 and a distance from the second contact point DR is d/2.

Figure 19:
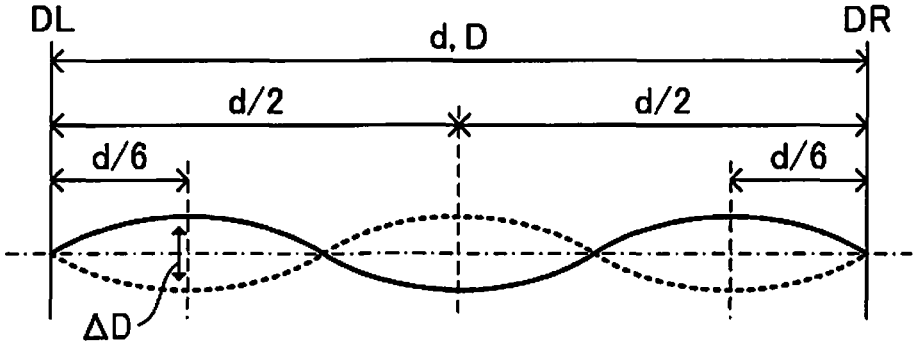
FIG. 19 is a diagram exemplifying a case where a tertiary natural vibration occurs in the vibration plate.

FIG. 19 is a diagram exemplifying a case where a tertiary natural vibration occurs in the vibration plate 621. As illustrated in FIG. 19, in a case where the tertiary natural vibration occurs in the vibration plate 621, the displacement ΔD of the vibration plate 621 due to the natural vibration is maximum at a point where a distance from the first contact point DL is d/2 and a distance from the second contact point DR is d/2, a point where the distance from the first contact point DL is d/6, and a point where the distance from the second contact point DR is d/6.

As described above, in the direction Y, the larger stress F2 may be applied to the contact point a between the vibration plate 621 and the cavity 631 at the point where the displacement ΔD of the vibration plate 621 is maximum.

Furthermore, in the operation mode in which the sleep mode is continued for a long time, the stress F2 may be continuously applied to the contact point a of the vibration plate 621 for a long time, and as a result, a crack may occur in the vibration plate 621. In a case where the mode is shifted to the print mode occurs in a state in which a displacement greater than expected occurs in the vibration plate 621, an excessive load may be applied to the vibration plate 621 along with the displacement of the piezoelectric element 60 when the ink is ejected, and as a result, the crack may occur in the vibration plate 621.

If the crack occurs in the vibration plate 621, the ink filled in the cavity 631 leaks from the crack. Accordingly, fluctuations may occur in the amount of ink ejected for a change in the internal volume of the cavity 631. As a result, ink ejection accuracy is reduced.

In addition, in a case where the ink leaked from the crack adheres to both the electrodes 611 and 612, a current path through the ink is formed between the electrode 611 and the electrode 612. Thereby, a voltage value of the reference voltage signal VBS supplied to the electrode 612 may vary. In the liquid ejecting apparatus 1 according to the first embodiment, the reference voltage signal VBS is commonly supplied to the plurality of electrodes 612. Accordingly, in a case where the voltage value of the reference voltage signal VBS varies, displacements of the plurality of piezoelectric elements 60 are affected. As a result, an ejection accuracy of the entire liquid ejecting apparatus 1 may be affected.

In the first embodiment, in order to reduce an unintentional displacement continuously occurring in the piezoelectric element 60 and the vibration plate 621 for a long time due to an unintentional potential difference occurring in the electrodes 611 and 612 of the piezoelectric element 60, three electric charge means for discharging electric charges of the electrodes 611 and 612 are included.

Figure 20:
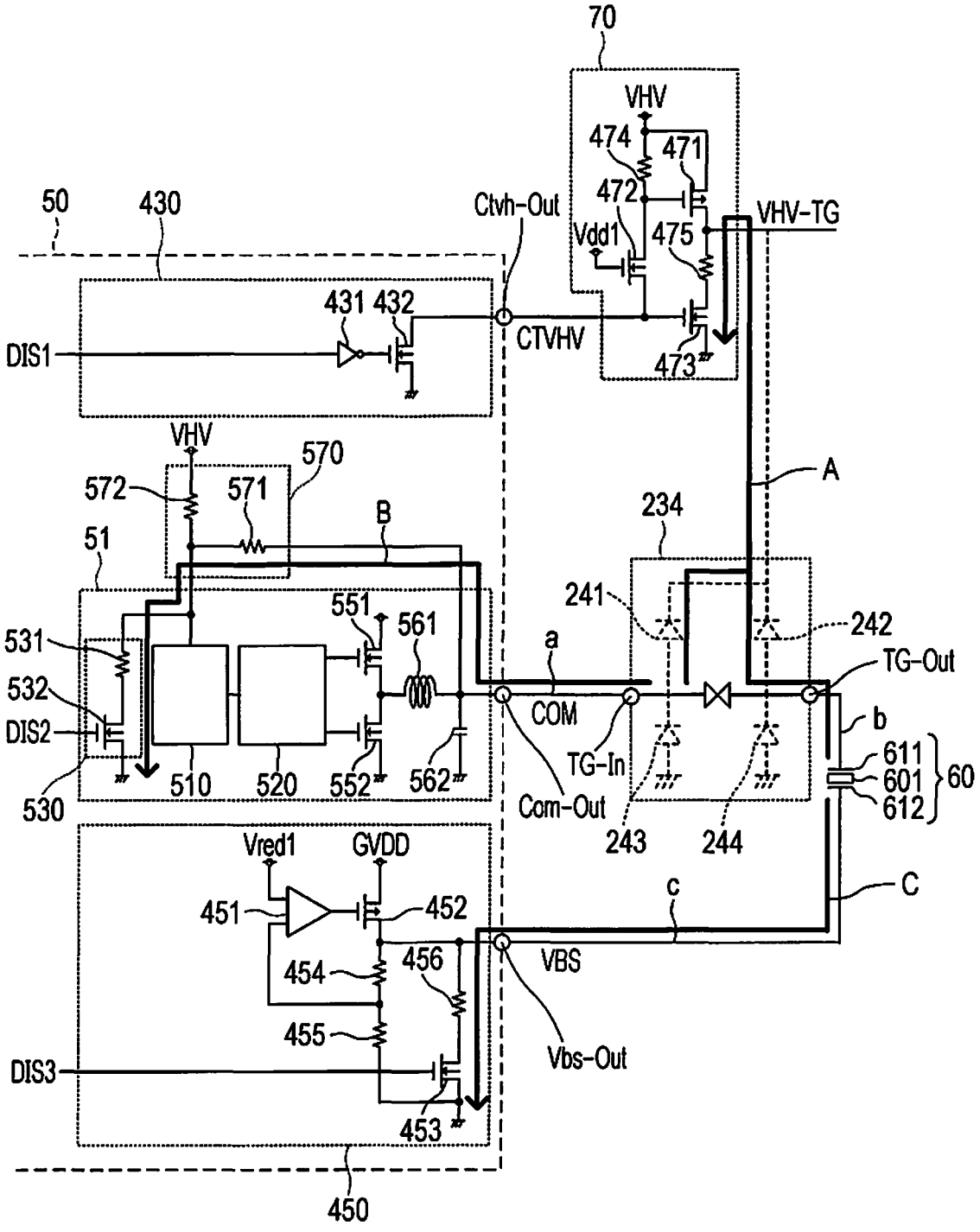
FIG. 20 is a diagram illustrating a discharge means that discharges electric charges of the piezoelectric element.

FIG. 20 is a diagram illustrating discharge means for discharging the electric charges of the piezoelectric element 60.

In FIG. 20, parasitic diodes 241, 242, 243, and 244 formed in the transfer gate 234 are denoted by dashed lines.

The first discharge means discharges electric charges through a first discharge path A illustrated in FIG. 20. Specifically, the first discharge means discharges electric charges accumulated between the terminal TG-Out and the electrode 611 via the plurality of parasitic diodes formed in the transfer gate 234 and electric charges accumulated between the terminal Com-Out and the terminal TG-In.

Here, details of the parasitic diodes 241, 242, 243, and 244 formed in the transfer gate 234 will be specifically described with reference to FIG. 21.

Figure 21:
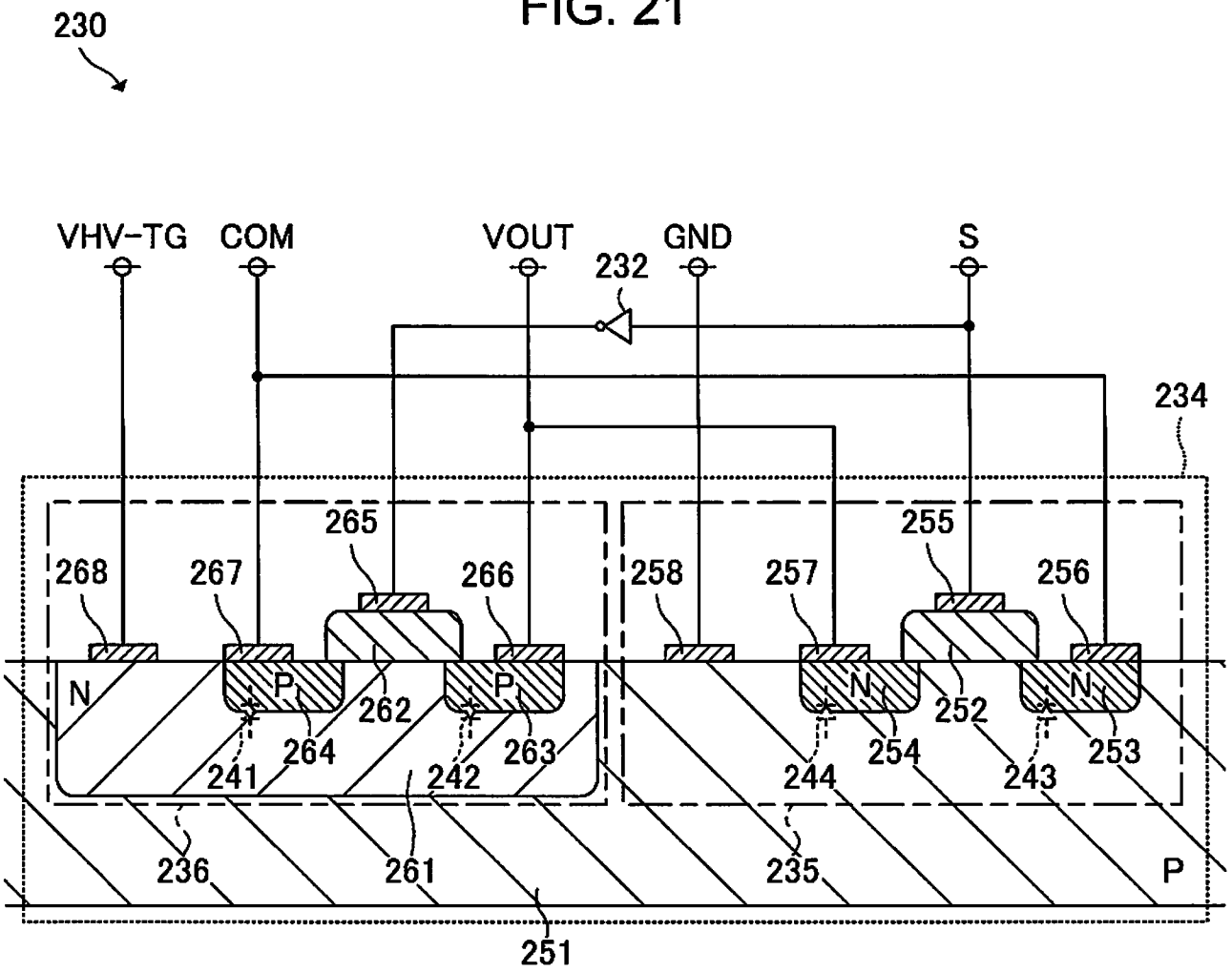
FIG. 21 is a cross-sectional view schematically illustrating a transistor configuring a transfer gate.

FIG. 21 is a cross-sectional view schematically illustrating the transistors 235 and 236 configuring the transfer gate 234.

As illustrated in FIG. 21, the transistor 235 includes polysilicon 252, N-type diffusion layers 253 and 254, and a plurality of electrodes.

The N-type diffusion layers 253 and 254 are formed to be separated from each other on a P substrate 251. The polysilicon 252 is formed between the N-type diffusion layers 253 and 254 via an insulation layer (not illustrated).

An electrode 255 is formed on the polysilicon 252. An electrode 256 is formed on the N-type diffusion layer 253. An electrode 257 is formed on the N-type diffusion layer 254.

The electrode 255 functions as a gate terminal, one of the electrodes 256 and 257 functions as a drain terminal, and the other electrode functions as a source terminal. In the first embodiment, the electrode 256 will be described as the drain terminal and the electrode 257 will be described as the source terminal.

In the transistor 235 configured as described above, a PN junction is formed in each of a contact surface between the P substrate 251 and the N-type diffusion layer 253 and a contact surface between the P substrate 251 and the N-type diffusion layer 254. Thus, in the transistor 235, a parasitic diode 243 having the P substrate 251 as an anode and the N-type diffusion layer 253 as a cathode and a parasitic diode 244 having the P substrate 251 as an anode and the N-type diffusion layer 254 as a cathode are formed.

An electrode 258 is formed on the P substrate 251. Since the transistor 235 is formed on the P substrate 251, the electrode 258 functions as a back gate terminal of the transistor 235. A ground potential is supplied to the electrode 258.

The transistor 236 includes an N well 261, polysilicon 262, P-type diffusion layers 263 and 264, and a plurality of electrodes.

The P-type diffusion layers 263 and 264 are formed to be separated from each other on the N well 261 formed in the P substrate 251. The polysilicon 262 is formed between the P-type diffusion layer 263 and the P-type diffusion layer 264 via an insulation layer (not illustrated).

An electrode 265 is formed on the polysilicon 262. An electrode 266 is formed on the P-type diffusion layer 263. An electrode 267 is formed on the P-type diffusion layer 264.

The electrode 265 functions as a gate terminal, one of the electrodes 266 and 267 functions as a drain terminal, and the other electrode functions as a source terminal. In the first embodiment, the electrode 266 will be described as the drain terminal and the electrode 267 will be described as the source terminal.

In the transistor 236 configured as described above, a PN junction is formed in each of a contact surface between the N well 261 and the P-type diffusion layer 263 and a contact surface between the N well 261 and the P-type diffusion layer 264. Thus, in the transistor 236, a parasitic diode 242 having the P-type diffusion layer 263 as an anode and the N well 261 as a cathode and a parasitic diode 241 having the P-type diffusion layer 264 as an anode and the N well 261 as a cathode are formed.

An electrode 268 is formed on the N well 261. Since the transistor 236 is formed in the N well 261, the electrode 268 functions as a back gate terminal of the transistor 236. The voltage VHV-TG is supplied to the electrode 268.

Returning to FIG. 20, the first discharge means through the first discharge path A including the parasitic diodes 241, 242, 243, and 244 described above will be described.

In the first discharge means, first, the discharge control signal DIS1 of an H level is supplied to the power supply control signal generation circuit 430.

The discharge control signal DIS1 supplied to the power supply control signal generation circuit 430 is supplied to a transistor 432 via an inverter 431. Thereby, the transistor 432 is turned off.

As described above, in a case where the transistor 432 is turned off, a transistor 473 of the power supply switching circuit 70 is turned on. If the transistor 473 is turned on, the voltage VHV-TG becomes the ground potential supplied through the resistor 475. Thereby, the electrode 268 of the transistor 236 configuring the transfer gate 234 becomes the ground potential. Thus, a potential of a node a to which the terminals COM-Out and TG-In are connected becomes the ground potential via the parasitic diode 241. Likewise, a potential of a node b to which the terminals TG-Out and the electrode 611 are connected becomes the ground potential via the parasitic diode 242.

In other words, electric charges accumulated in the node a are discharged via the parasitic diode 241, the resistor 475, and the transistor 473, and likewise, electric charges accumulated in the node b are discharged via the parasitic diode 242, the resistor 475, and the transistor 473.

As described above, in the first discharge means, the power supply switching circuit 70 sets a potential of the voltage VHV-TG to the ground potential in response to the discharge control signal DIS1. Thereby, the electric charges accumulated in the node a and the node b are discharged via the parasitic diodes 241 and 242. Thus, unintentional electric charges accumulated in the electrode 611 are reduced.

The electric charges of the node a and the node b discharged by the first discharge means are electric charges of the terminals TG-In and TG-Out of the transfer gate 234. Thus, the electric charges can be discharged by the first discharge means regardless of whether the transfer gate 234 is turned on or off. Accordingly, it is possible to further reduce a possibility that unintentional electric charges are accumulated in the electrode 611.

The configuration of the power supply switching circuit 70 is not limited to the configuration described above and may be any configuration as long as a potential of the electrode 268 of the transistor 236 can be switched to the ground potential.

Next, second discharge means will be described. In the second discharge means, the electric charges accumulated in the node a are discharged via a second discharge path B including the LC discharge circuit 530.

In a case where the electric charges are discharged by the second discharge means, first, the discharge control signal DIS2 of an H level is supplied to the transistor 532 of the LC discharge circuit 530. Thereby, the transistor 532 is turned on. Thus, a potential of the node a becomes the ground potential supplied through the resistors 571 and 531 and the transistor 532. In other words, the electric charges accumulated in the node a is discharged via the resistors 571 and 531 and the transistor 532.

In a case where an operation of the drive signal generation circuit 50 stops, the voltage VHV may be supplied to the node a via the resistors 572 and 571. In the second discharge means, the electric charges of the node a can be discharged, and thus, it is possible to reduce accumulation of the electric charges caused by the voltage VHV in the node a.

As described above, in the second discharge means, the electric charges of the node a can be discharged, and thus, a potential of the node a can be lowered. Thus, a leakage current generated in the terminal TG-Out from the terminal TG-In of the transfer gate 234 is reduced. That is, an increase in the voltage of the node b due to the leakage current can be reduced. Thus, it is possible to further reduce a possibility that unintentional electric charges are accumulated in the electrode 611.

The LC discharge circuit 530 may have a configuration in which the electric charges of the node a can be discharged, and for example, the LC discharge circuit may be provided at a connection point where the source terminal of the transistor 551 and the drain terminal of the transistor 552 are commonly connected.

Next, third discharge means will be described. The third discharge means discharges electric charges accumulated in a node c connected to the electrode 612 and the terminal Vbs-Out via a third discharge path C including the transistor 453 of the reference voltage signal generation circuit 450.

In a case where the electric charges are discharged by the third discharge means, first, the discharge control signal DIS3 of an H level is supplied to the transistor 453 of the reference voltage signal generation circuit 450. Thereby, the transistor 453 is turned on. Thus, a potential of the node c becomes the ground potential supplied via the resistor 456 and the transistor 453. In other words, the electric charges accumulated in the node c are discharged via the resistor 456 and the transistor 453.

As described above, the piezoelectric element 60 is displaced by a potential difference between a voltage of the electrode 611 and a voltage of the electrode 612. By discharging the electric charges accumulated in the node c by using the third discharge means, supply of an unintentional voltage to the electrode 612 can be reduced. Thus, it is possible to further reduce occurrence of an unintentional displacement in the piezoelectric element 60.

In the first embodiment, discharging the electric charges using the first discharge means, the second discharge means, and the third discharge means as described above is performed in the transition mode. Therefore, a method of discharging the electric charges using the first discharge means, the second discharge means, and the third discharge means according to the first embodiment will be described with reference to FIG. 22.

Figure 22:
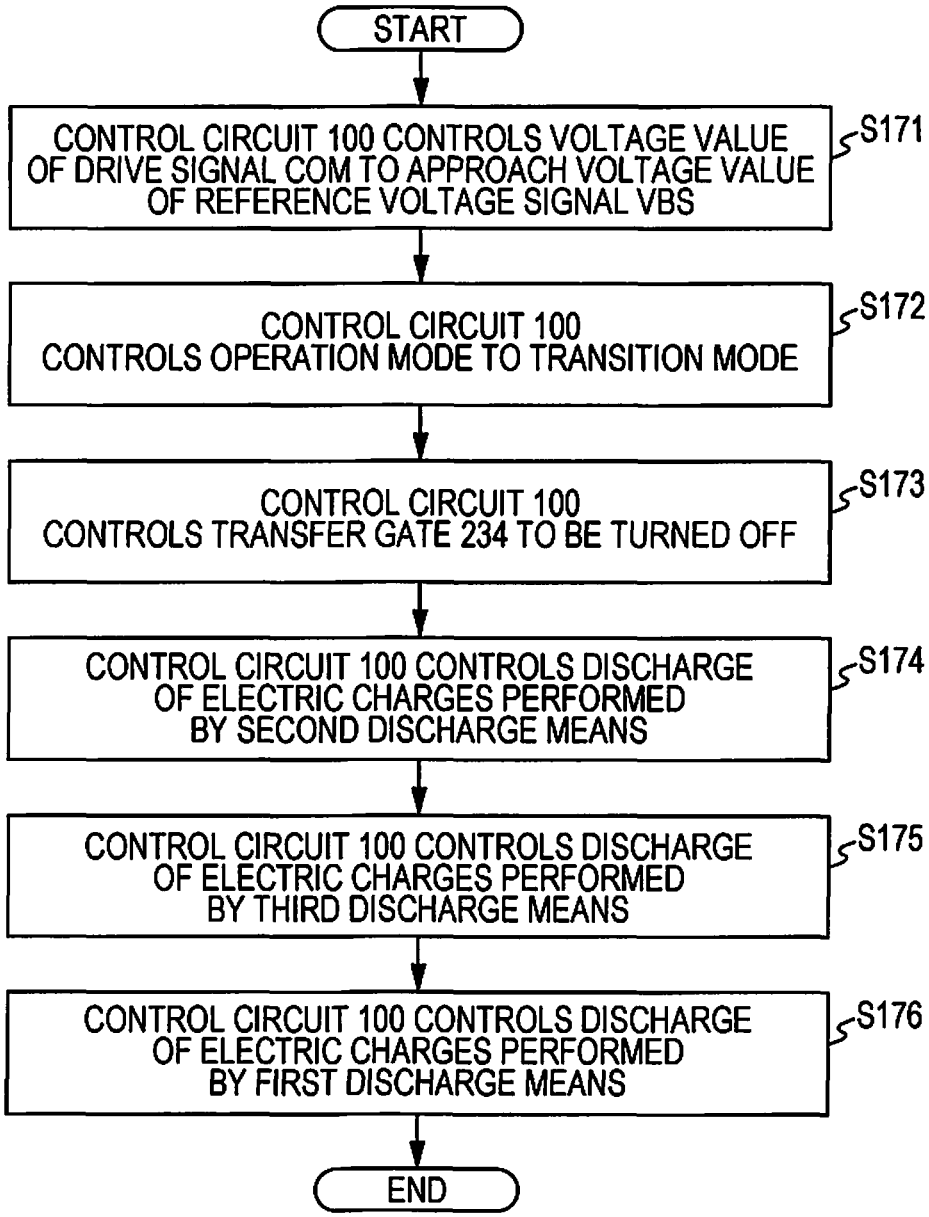
FIG. 22 is a flowchart illustrating an operation in a transition mode.

FIG. 22 is a flowchart illustrating an operation in the transition mode.

First, the control circuit 100 controls a voltage value of the drive signal COM so as to approach a voltage value of the reference voltage signal VBS before the operation mode is shifted to the transition mode (S171). Specifically, the control circuit 100 supplies the drive signal generation circuit 50 with the drive data signal DRV such that the voltage value of the drive signal COM is the voltage value of the reference voltage signal VBS. Then, the drive signal generation circuit 50 controls the voltage value of the drive signal COM so as to approach the voltage value of the reference voltage signal VBS, based on the supplied drive data signal DRV.

In the transition mode, the voltage values of both the drive signal COM and the reference voltage signal VBS may vary in the course of shifting to the sleep mode. Accordingly, as the voltage value of the drive signal COM is controlled to approach the voltage value of the reference voltage signal VBS before the operation mode is shifted to the transition mode, it is possible to reduce a possibility that an unintentional potential difference is generated in the piezoelectric element 60 in the transition mode.

The fact that the voltage value of the drive signal COM is controlled to approach the voltage value of the reference voltage signal VBS preferably means that the voltage value of the drive signal COM is equalized to the voltage value of the reference voltage signal VBS, but in a broad sense, the voltage values may be controlled to approach each other such that an unintentional displacement does not occur in the piezoelectric element 60 due to a potential difference between the drive signal COM and the reference voltage signal VBS. Specifically, it is preferable to control the potential difference between the drive signal COM and the reference voltage signal VBS so as to be less than or equal to 2 V.

In a case where the voltage value of the drive signal COM and the voltage value of the reference voltage signal VBS are sufficiently close to each other, the control circuit 100 controls the operation mode to the transition mode (S172).

After the operation mode is shifted to the transition mode, the control circuit 100 controls the transfer gate 234 to be turned off (S173). Thereby, a voltage supplied to the electrode 611 is held at a voltage immediately before being shifted to the transition mode, that is, a voltage sufficiently close to the voltage of the reference voltage signal VBS.

In a case where a predetermined time elapses after the transfer gate 234 is turned off, the control circuit 100 controls electric charges discharged by the second discharge means (S174). Specifically, the control circuit 100 supplies the drive data signal DRV for generating the discharge control signal DIS2 of an H level to the drive signal generation circuit 50.

The electric charges accumulated in the node a are discharged by the second discharge means after the transfer gate 234 is turned off, a voltage of the node a is decreased. Thus, a leakage current being generated in the transfer gate 234 is reduced, and an increase in the voltage of the electrode 611 caused by the leakage current is reduced. The electric charges may be continuously discharged by the second discharge means until the operation mode is shifted to the print mode or the standby mode.

In a case where a predetermined time elapses after the discharge of the electric charges made by the second discharge means starts, the control circuit 100 controls the discharge of the electric charges made by the third discharge means (S175). Specifically, the control circuit 100 supplies the drive signal generation circuit 50 with the drive data signal DRV for generating the discharge control signal DIS3 of an H level. By discharging the electric charges accumulated in the node c using the third discharge means before the electric charges accumulated in the node b are discharged by using the first discharge means, it is possible to prevent a voltage supplied to the electrode 612 from increasing more than a voltage supplied to the electrode 611. That is, it is possible to reduce occurrence of the displacement in the piezoelectric element 60 in the direction opposite to the displacement occurring in the piezoelectric element 60 during a print operation. Thereby, it is possible to reduce stress occurring in the piezoelectric element 60 and the vibration plate 621.

For example, the control circuit 100 may simultaneously perform the discharge of the electric charges using the second discharge means and the discharge of the electric charges using the third discharge means, and the discharge of the electric charges using the second discharge means may be performed after the discharge of the electric charges is performed by the third discharge means. In addition, the discharge of the electric charges using the third discharge means may be continued until the operation mode is shifted to the print mode or the standby mode.

In a case where a predetermined time elapses after the discharge of the electric charges performed by the second discharge means and the third discharge means are started, the control circuit 100 controls the discharge of electric charge performed by the first discharge means (S176). Specifically, the control circuit 100 supplies the drive data signal DRV for generating the discharge control signal DIS1 of an H level to the drive signal generation circuit 50. Thereby, the electric charges accumulated in the electrode 611 is discharged. Thus, a possibility that an unintentional voltage is generated in the piezoelectric element 60 is reduced, and occurrence of unintentional displacements in the piezoelectric element 60 and the vibration plate 621 is reduced. The discharge of the electric charges performed by the first discharge means may be continued until the operation mode is shifted to the print mode or the standby mode.

In a case where a predetermined time elapses after the discharge of the electric charges performed by the first discharge means, the second discharge means, and the third discharge means starts, the control circuit 100 shifts the operation mode to the sleep mode as illustrated in FIG. 3. The discharge of the electric charges performed by the first discharge means, the second discharge means, and the third discharge means may be continued in the sleep mode.

1.7 Abnormality Detection of Drive Signal

A cause of an unintentional displacement continuously occurring in the piezoelectric element 60 for a long time due to a potential difference caused by accumulation of unintentional electric charges in the piezoelectric element 60 includes the fact that the unintentional electric charges are accumulated in the piezoelectric element 60 in the sleep mode, as described above. The other causes include a factor in which the drive signal COM is not normally output in the print mode and a constant voltage value is continuously output.

Therefore, the liquid ejecting apparatus 1 includes the detection circuit 320 that detects whether or not an output of the drive signal COM is within a predetermined range and detects whether or not the drive signal COM is output as a constant voltage. In addition, the liquid ejecting apparatus 1 includes the determination circuit 350 that determines whether or not the drive signal COM is normal, specifically, whether or not the drive signal COM is continuously output as a constant voltage for a predetermined period, based on a detection result of the detection circuit 320.

A factor that the drive signal COM is continuously output as a constant voltage includes the fact that the original drive signal dA supplied to the drive signal generation circuit 50 is not updated and the fact that a clock signal for updating the original drive signal dA is not supplied. Therefore, in the liquid ejecting apparatus 1 according to the first embodiment, the detection circuit 320 detects whether or not the original drive signal dA is updated and whether or not the clock signal for updating the original drive signal dA is supplied, and the determination circuit 350 determines whether or not the drive signal COM is continuously output as a constant voltage, based on the detection result of the detection circuit 320.

Figure 23:
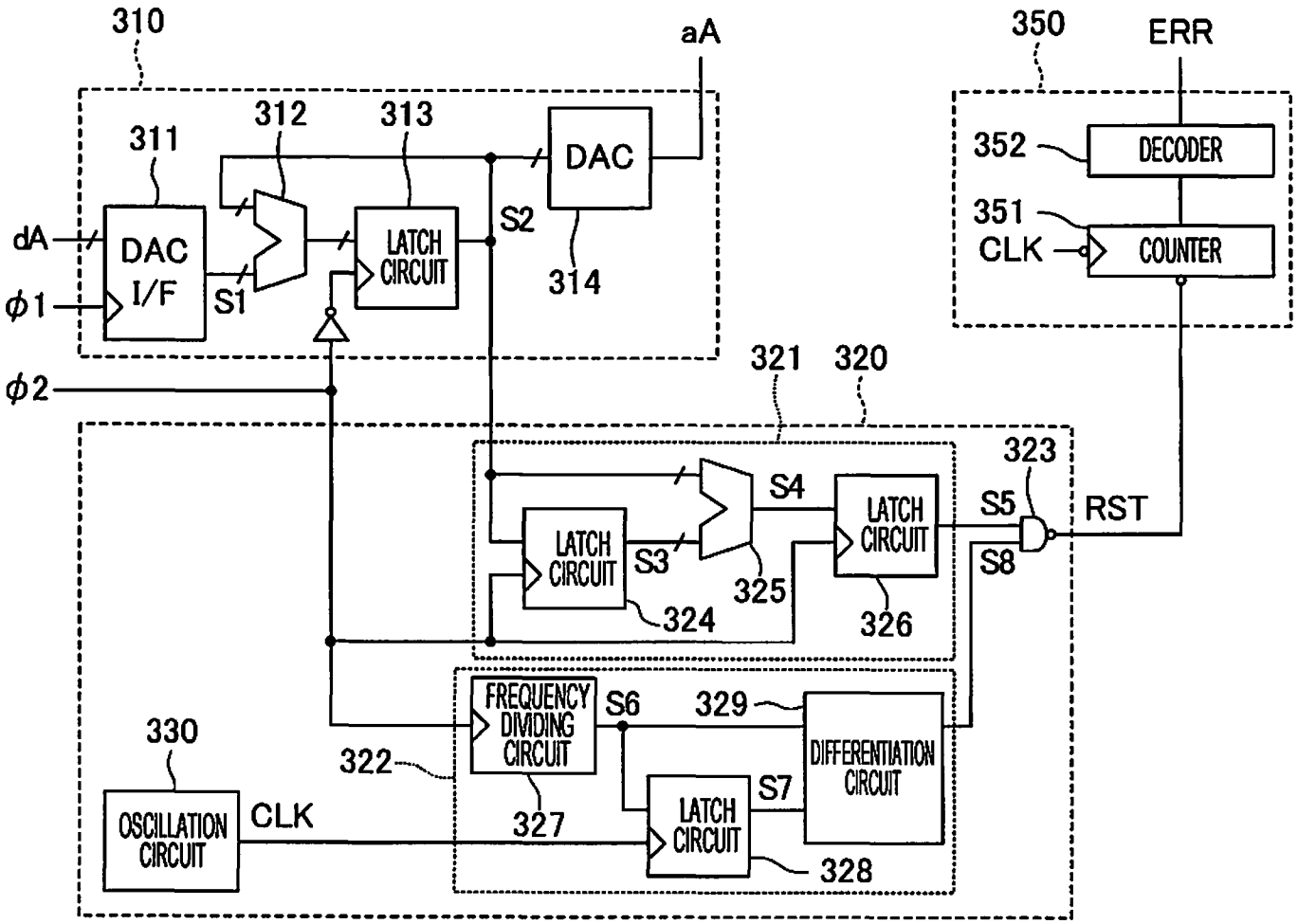
FIG. 23 is a block diagram illustrating electric configurations of a DAC circuit, a detection circuit, and a determination circuit.

Configurations and operations of the detection circuit 320 and the determination circuit 350 according to the first embodiment will be described in detail with reference to FIGS. 23 to 29. FIG. 23 is a block diagram illustrating electric configurations of the DAC circuit 310, the detection circuit 320, and the determination circuit 350.

The DAC circuit 310 includes a DAC interface (I/F) 311, a comparator 312, a latch circuit 313, and a DAC 314.

The DAC interface 311 is supplied with a clock signal ϕ1 and the original drive signal dA. The DAC interface 311 takes in the original drive signal dA according to the clock signal ϕ1 and outputs a signal S1 based on the original drive signal dA to the comparator 312.

The comparator 312 compares the signal S1 as a data signal supplied this time with a signal S2 supplied from the latch circuit 313, which will be described below, as a previously supplied data signal. Specifically, in a case where a result of comparison between the signal S1 and the signal S2 is within a predetermined range, the comparator 312 outputs the signal S1 to the latch circuit 313. Meanwhile, in a case where the result of comparison between the signal S1 and the signal S2 is out of the predetermined range, the comparator 312 outputs a predetermined data signal to the latch circuit 313.

The latch circuit 313 latches the data signal input from the comparator 312 at a falling edge of a clock signal ϕ2. The latch circuit 313 outputs the latched data signal to the DAC 314, the comparator 312, and the detection circuit 320 as the signal S2.

The DAC 314 performs a digital-analog conversion on the signal S2 and outputs converted analog signal to the drive circuit 51 illustrated in FIG. 4 as the analog original drive signal aA.

The detection circuit 320 includes an update detection circuit 321, a clock detection circuit 322, a NAND circuit 323, and an oscillation circuit 330.

The update detection circuit 321 includes latch circuits 324 and 326 and a comparator 325.

The latch circuit 324 latches the signal S2 at a rising edge of the clock signal ϕ2 and outputs the signal S2 to the comparator 325 as a signal S3.

The signal S2 and the signal S3 are input to the comparator 325. Then, the comparator 325 compares the signal S2 with the signal S3. Specifically, in a case where the signal S2 is the same as the signal S3, the comparator 325 outputs a signal of an L level as a signal S4, and in a case where the signal S2 is different from the signal S3, the comparator 325 outputs a signal of an H level as the signal S4.

The latch circuit 326 latches the signal S4 at the rising edge of the clock signal ϕ2. Then, the latch circuit 326 outputs the latched signal S4 to the NAND circuit 323 as a signal S5 which is an output signal of the update detection circuit 321.

The comparator 325 may compare all data bits of the input data signals and may compare whether the input data signals are the same or different from each other. In addition, the comparator may compare, for example, only specific data bits and may compare whether the input data signals are the same or different from each other. Specifically, the comparator may compare only high level bits or low level bits of the input data signal.

The clock detection circuit 322 includes a frequency dividing circuit 327, a latch circuit 328, and a differentiation circuit 329.

The frequency dividing circuit 327 outputs a signal S6 obtained by frequency-dividing the clock signal ϕ2.

The latch circuit 328 latches a signal S6 at a rising edge of the clock signal CLK supplied from the oscillation circuit 330, and outputs the latched signal as a signal S7.

The differentiation circuit 329 receives the signal S6 output from the frequency dividing circuit 327 and the signal S7 output from the latch circuit 328. The differentiation circuit 329 calculates and outputs an exclusive logical sum of the input data signals. That is, the differentiation circuit 329 outputs a signal of an H level as a signal S8 in a case where a logic level of the signal S6 is different from a logic level of the signal S7, and outputs a signal of an L level as a signal S8 in the same case. Then, the differentiation circuit 329 outputs the signal S8 to the NAND circuit 323 as an output signal of the clock detection circuit 322.

In a case where a logic level of the signal S5 output from the update detection circuit 321 and a logic level of the signal S8 output from the clock detection circuit 322 are both H level, the NAND circuit 323 outputs a reset signal RST of an L level. In a case where a logic level of at least one of the signals S5 and S8 is an L level, the NAND circuit 323 outputs the reset signal RST of an H level. The reset signal RST is supplied to the determination circuit 350 as an output signal of the detection circuit 320.

The determination circuit 350 includes a counter 351 and a decoder 352.

In a case where the reset signal RST of an H level is input, the counter 351 increments a count value at a falling edge of the clock signal CLK and outputs the count value to the decoder 352. In addition, in a case where the reset signal RST of an L level is input, the counter 351 resets the count value to 0 and outputs the count value to the decoder 352.

In a case where the count value input from the counter 351 exceeds a predetermined value, that is, in a case where a signal of an H level is continuously input to the determination circuit 350 for a predetermined period, the decoder 352 determines that the drive signal COM is continuously output as a constant voltage and outputs an error signal ERR.

A method of detecting whether or not the original drive signal dA of the detection circuit 320 is updated and a method of detecting whether or not the clock signal 42 is supplied will be specifically described with reference to FIGS. 24 to 27.

Figure 24:
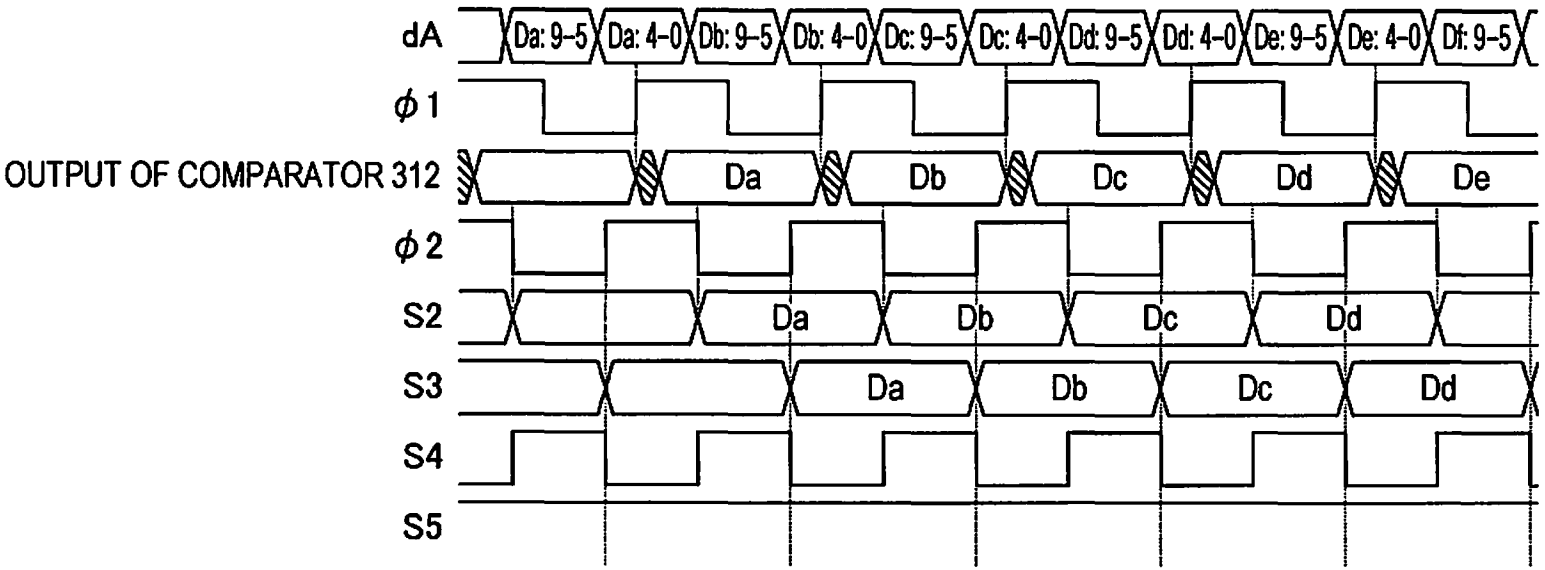
FIG. 24 is a timing chart illustrating an operation of the detection circuit in a case where an original drive signal is updated.

FIG. 24 is a timing chart illustrating an operation of the detection circuit 320 in a case where the original drive signal dA is updated.

The DAC interface 311 takes in the supplied original drive signal dA based on the clock signal 41 to generate the signal S1. The signal S1 is supplied to the comparator 312. Specifically, the DAC interface 311 sequentially takes in 5-bit data signal Da [9-5] and the 5-bit data signal Da [4-0] which are supplied as the original drive signal dA, based on the clock signal ϕ1 and combines the data signals, thereby, generating the signal S1.

The comparator 312 compares the signal S1 with the signal S2 input from the latch circuit 313. The comparator 312 outputs a data signal Da based on the comparison result.

The latch circuit 313 latches the data signal Da output from the comparator 312 at a falling edge of the clock signal ϕ2 as the signal S2.

The latch circuit 324 latches the data signal Da latched by the latch circuit 313 at the rising edge of the clock signal ϕ2 as the signal S3.

The signal S2 and the signal S3 are input to the comparator 325, and in a case the input signals are the same, the comparator 325 outputs a signal of an L level, and in a case where the input signals are different from each other, the comparator outputs a signal of an H level.

Specifically, the latch circuit 324 latches the data signal Da at the rising edge of the clock signal ϕ2 as the signal S3. At this time, the latch circuit 313 holds the data signal Da as the signal S2. Thus, the same data signal Da is supplied to the comparator 325. As a result, the comparator 325 outputs a signal of an L level as the signal S4.

The latch circuit 313 latches a data signal Db at a falling edge of the next clock signal ϕ2 as the signal S2. At this time, the latch circuit 324 holds the data signal Da as the signal S3. Thus, the data signal Da and the data signal Db, which are different data signals, are input to the comparator 325. As a result, the comparator 325 outputs a signal of an H level.

The latch circuit 326 latches the signal S4 at the rising edge of the clock signal ϕ2 before the latch circuit 324 latches the signal S2. Thus, the latch circuit 326 latches a signal of an H level as the signal S5 and outputs the latched signal as an output signal of the update detection circuit 321 to the NAND circuit 323.

Figure 25:
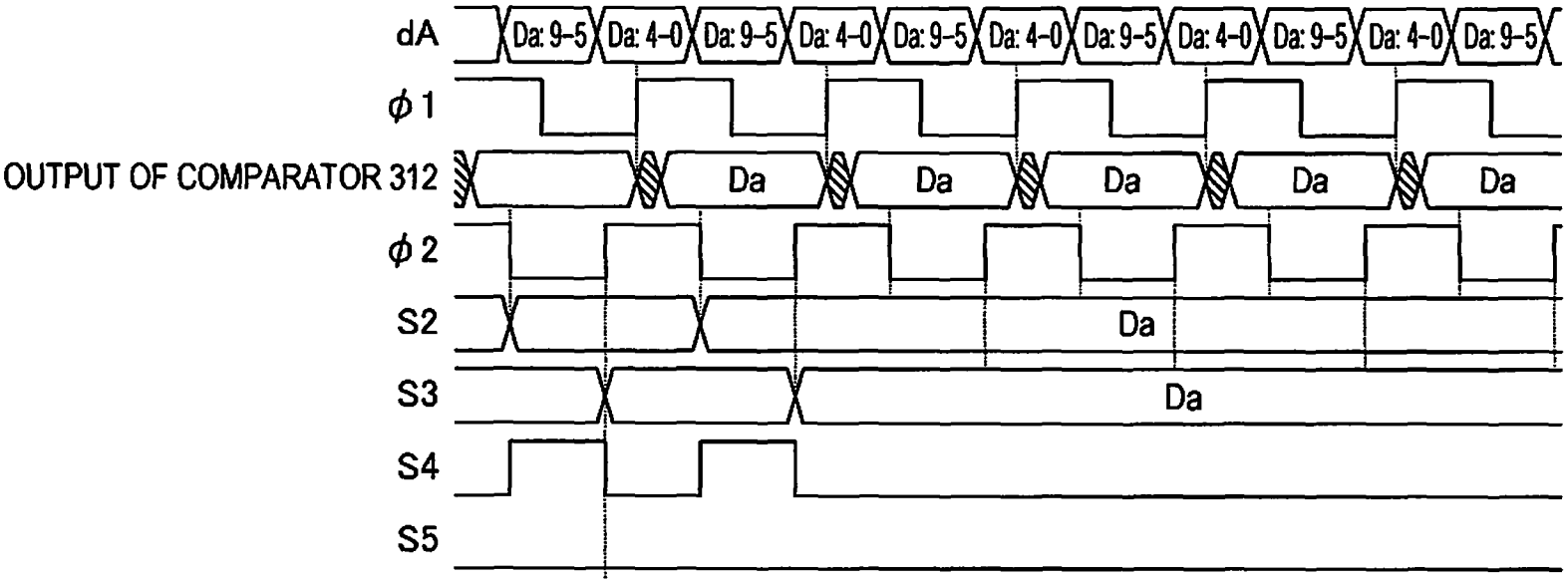
FIG. 25 is a timing chart illustrating the operation of the detection circuit in a case where the original drive signal is not updated.

Next, an operation of the detection circuit 320 in a case where the original drive signal dA is not updated will be described with reference to FIG. 25. FIG. 25 is a timing chart illustrating the operation of the detection circuit 320 in a case where the original drive signal dA is not updated.

In the same manner as in a case where the original drive signal dA is updated, the DAC interface 311 sequentially takes in the supplied original drive signals dA based on the clock signal ϕ1 and combines the original drive signals, thereby, generating the signal S1.

The comparator 312 compares the signal S1 with the signal S2 input from the latch circuit 313. Then, the comparator 312 outputs the data signal Da based on the comparison result.

The latch circuit 313 latches the data signal Da output from the comparator 312 at the falling edge of the clock signal ϕ2 as the signal S2.

The latch circuit 324 latches the data signal Da at the rising edge of the clock signal ϕ2 as the signal S3. At this time, the latch circuit 313 holds the data signal Da as the signal S2. Thus, the same data signal Da is supplied to the comparator 325. As a result, the comparator 325 outputs a signal of an L level as the signal S4.

In a case where the original drive signal dA is not updated, the latch circuit 313 latches the data signal Da again at the falling edge of the next clock signal ϕ2 as the signal S2. At this time, the latch circuit 324 holds the data signal Da as the signal S3. Thus, the same data signal Da is input to the comparator 325. As a result, the comparator 325 outputs a signal of an L level.

The latch circuit 326 latches the signal S4 at the rising edge of the clock signal ϕ2 before the latch circuit 324 latches the signal S2. Thus, the latch circuit 326 latches a signal of an L level as the signal S5 and supplies the latched signal to the NAND circuit 323 as an output signal of the update detection circuit 321.

As described above, in a case where the original drive signal dA is updated, the update detection circuit 321 outputs a signal of an H level to the NAND circuit 323 as the signal S5, and in a case where the original drive signal dA is not updated, the update detection circuit 321 outputs a signal of an L level to the NAND circuit 323 as the signal S5.

Figure 26:
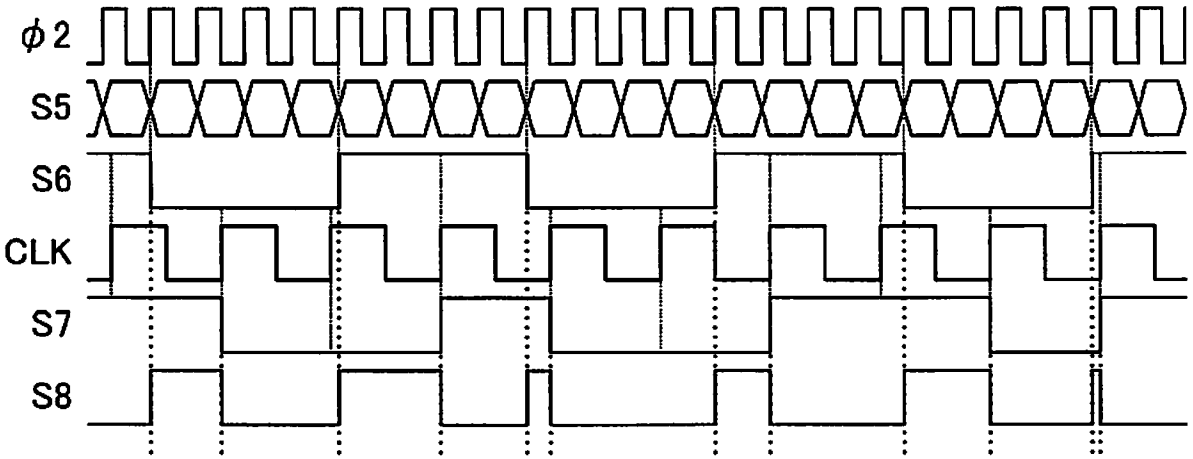
FIG. 26 is a timing chart illustrating the operation of the detection circuit in a case where a clock signal is supplied.
Figure 27:
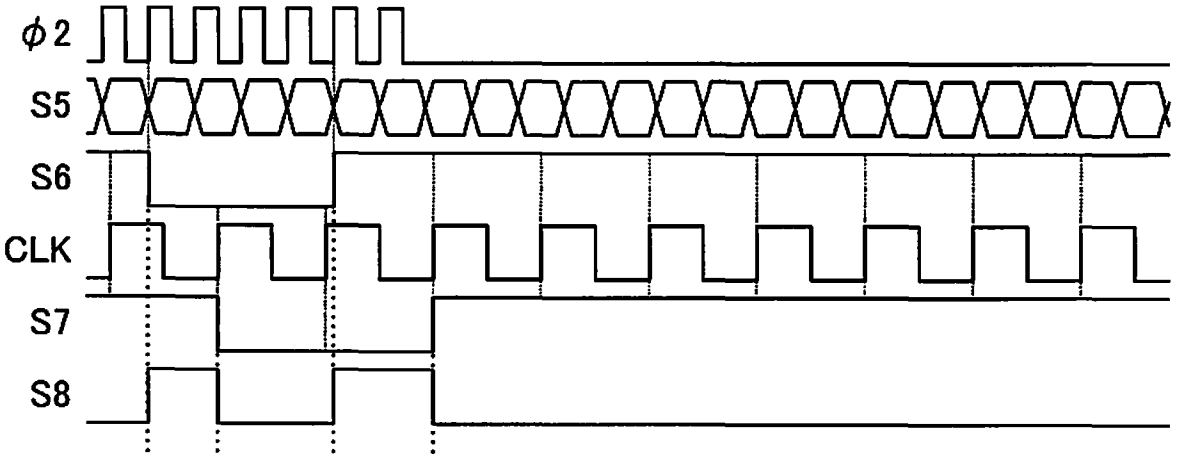
FIG. 27 is a timing chart illustrating the operation of the detection circuit in a case where the clock signal is not supplied.

Next, a method of detecting whether or not the clock signal ϕ2 is supplied will be described in detail with reference to FIGS. 26 and 27. FIG. 26 is a timing chart illustrating an operation of the detection circuit 320 in a case where the clock signal ϕ2 is supplied.

The frequency dividing circuit 327 outputs the signal S6 obtained by frequency-dividing the clock signal ϕ2.

The latch circuit 328 latches the signal S6 at the rising edge of the clock signal CLK as the signal S7.

In the first embodiment, the clock signal CLK has a cycle different from the cycle of the clock signal ϕ2. That is, in a case where the clock signal ϕ2 is normally input, timing occurs at which a logic level of the signal S6 is different from a logic level of the signal S7.

Thus, in a case where the logic level of the signal S6 changes based on the clock signal ϕ$2 during a period until the clock signal CLK rises next after the latch circuit 328 latches the signal S6 at the rising edge of the clock signal CLK, the logic levels of the signals S6 and S7 input to the differentiation circuit 329 are different from each other.

In a case where the logic levels of the signals S6 and S7 are the same as each other, the differentiation circuit 329 outputs the signal S8 of an L level to the NAND circuit 323 as an output signal of the clock detection circuit 322. In addition, in a case where the logic levels of the signal S6 and the signal S7 are different from each other, the differentiation circuit 329 outputs the signal S8 of an H level to the NAND circuit 323 as the output signal of the clock detection circuit 322. That is, in a case where the clock signal ϕ2 is supplied, the clock detection circuit 322 alternately outputs a signal of an H level and a signal of an L level as the signal S8.

Next, an operation of the detection circuit 320 in a case where the clock signal ϕ2 is not supplied will be described with reference to FIG. 27. FIG. 27 is a timing chart illustrating the operation of the detection circuit 320 in a case where the clock signal ϕ2 is not supplied.

In a case where the clock signal ϕ2 is not supplied, the frequency dividing circuit 327 continuously outputs the signal S6 of an H level or an L level. In the description on FIG. 27, it is described that a signal of an H level is output as the signal S6, but the signal may be a signal of an L level.

The latch circuit 328 latches the signal S6 at the falling edge of the clock signal CLK as the signal S7.

The signal S6 of an H level and the signal S7 of an H level are input to the differentiation circuit 329. Thus, the signal S8 of an L level is supplied to the NAND circuit 323 as an output signal of the clock detection circuit 322.

As described above, in a case where the clock signal ϕ2 is supplied, the clock detection circuit 322 outputs an output signal in which H level and L level are alternately generated to the NAND circuit 323 as the signal S8. In a case where the clock signal ϕ2 is not supplied, the clock detection circuit 322 continuously outputs the output signal of an L level to the NAND circuit 323 as the signal S8.

The signal S5 output from the update detection circuit 321 and the signal S8 output from the clock detection circuit 322 are input to the NAND circuit 323. In a case where both the output signal of the update detection circuit 321 and the output signal of the clock detection circuit 322 are signals of an H level, the NAND circuit 323 outputs a reset signal RST of L level.

As described above, in a case where the original drive signal dA is updated, the update detection circuit 321 outputs an output signal of an H level to the NAND circuit 323 as the signal S5, and in a case where the original drive signal dA is not updated, the update detection circuit 321 outputs an output signal of an L level to the NAND circuit 323 as the signal S5. In addition, in a case where the clock signal ϕ2 is supplied, the clock detection circuit 322 alternately outputs the output signal of an H level and the output signal of an L level to the NAND circuit 323 as the signal S8, and in a case where the clock signal ϕ2 is not supplied, the clock detection circuit 322 continuously outputs the output signal of an L level to the NAND circuit 323 as the signal S8.

Thus, in a case where the original drive signal dA is updated, in a case where the clock signal ϕ2 is supplied, and in a case where the signal of an H level is output, the NAND circuit 323 outputs the reset signal RST of an L level. In the other states, the NAND circuit 323 outputs the reset signal RST of an H level.

Figure 28:
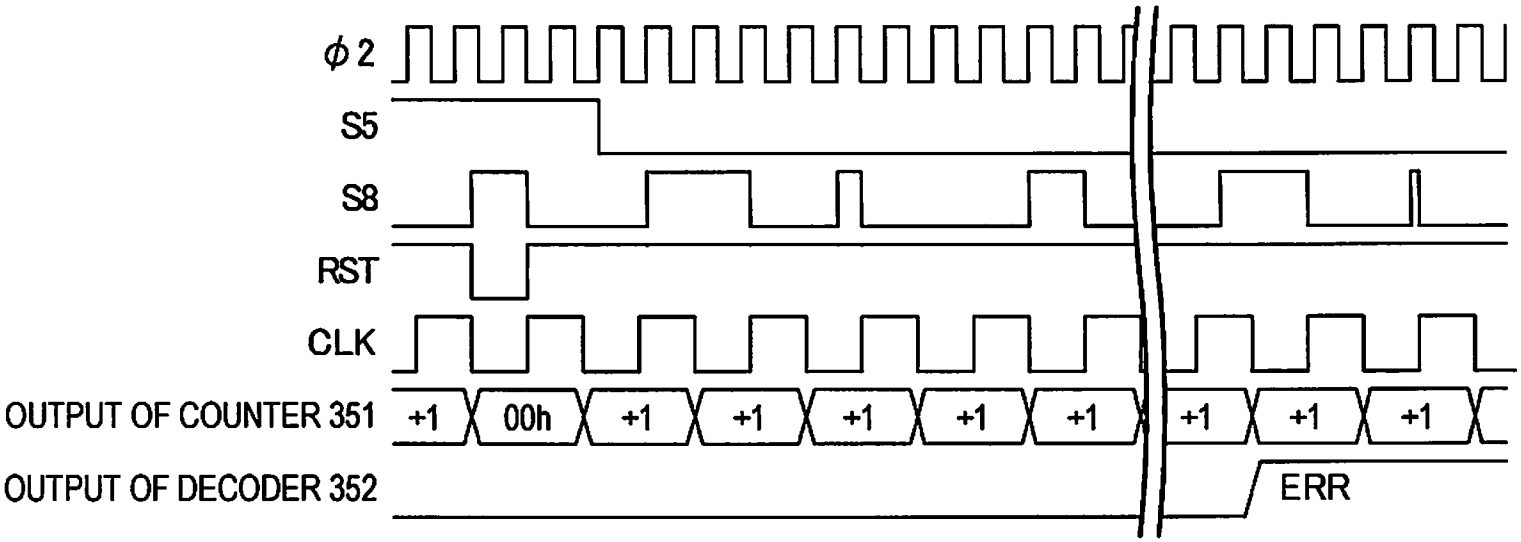
FIG. 28 is a timing chart illustrating an operation of the determination circuit associated with a detection operation of the original drive signal in an update detection circuit.
Figure 29:
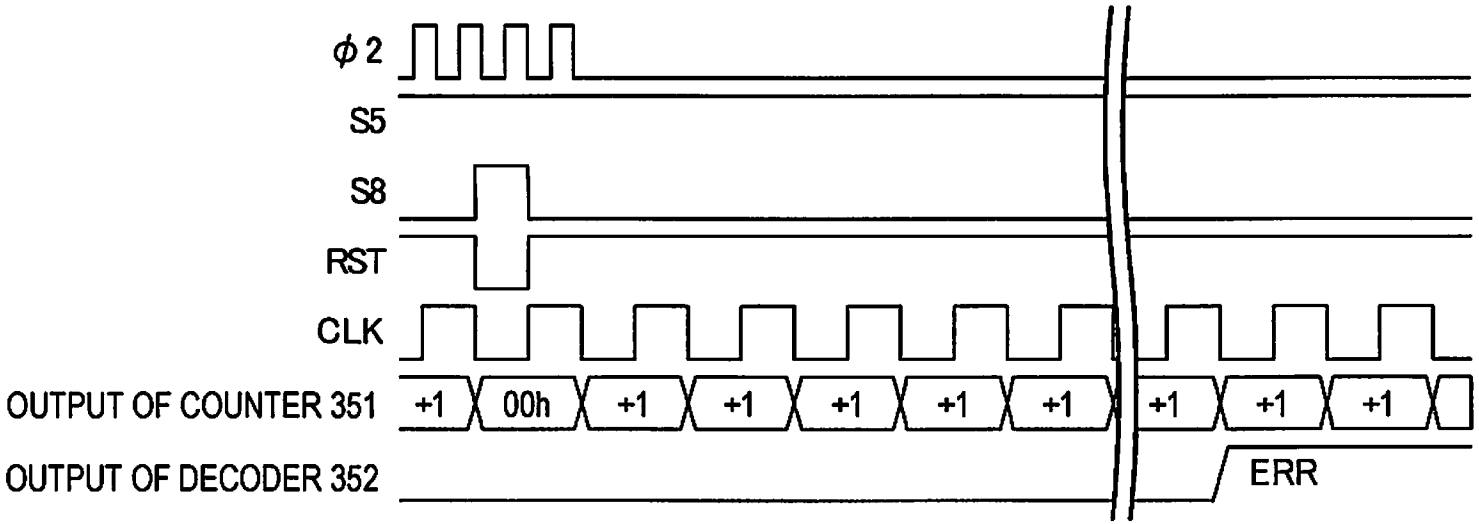
FIG. 29 is a timing chart illustrating an operation of the determination circuit associated with a detection operation of a clock signal in a clock detection circuit.

Next, an operation of the determination circuit 350 will be described with reference to FIGS. 28 and 29. FIG. 28 is a timing chart illustrating the operation of the determination circuit 350 associated with a detection operation of the original drive signal dA of the update detection circuit 321.

As described above, in a case where the original drive signal dA is updated, the update detection circuit 321 outputs a signal of an H level as the signal S5.

In a case where the signal S5 which is input is a signal of an H level and the signal S8 is a signal of an H level, the NAND circuit 323 outputs a signal of an L level. At this time, a count value output from the counter 351 is reset to 0.

In a case where the original drive signal dA is not updated, the update detection circuit 321 outputs a signal of an L level as the signal S5.

In a case where the signal S5 which is input is a signal of an L level, the NAND circuit 323 outputs a signal of an H level regardless of a logic level of the signal S8. At this time, the count value output from the counter 351 is incremented at a falling edge of the clock signal CLK.

The count value output from the counter 351 is output to the decoder 352. In a case where the count value exceeds a predetermined value, the decoder 352 outputs an error signal ERR.

Next, an operation of the determination circuit 350 corresponding to the detection operation of the clock signal ϕ2 of the clock detection circuit 322 will be described with reference to FIG. 29. FIG. 29 is a timing chart illustrating the operation of the determination circuit 350 associated with the detection operation of the clock signal ϕ2 of the clock detection circuit 322.

As described above, in a case where the clock signal ϕ2 is supplied, the clock detection circuit 322 alternately outputs the signal S8 having a logic level of an H level and the signal S8 of an L level at the above-described timing. In a case where a logic level of the signal S8 is an H level and the signal S5 is output as a signal of an H level, the NAND circuit 323 outputs a signal of an L level. Thereby, a count value output from the counter 351 is reset to 0.

In a case where the clock signal ϕ2 is not supplied, the clock detection circuit 322 continuously outputs a signal of an L level as the signal S8.

In a case where the logic level of the signal S8 is an L level, the NAND circuit 323 outputs a signal of an H level regardless of the logic level of the signal S5. At this time, the count value output from the counter 351 is incremented at the falling edge of the clock signal CLK.

The count value output from the counter 351 is input to the decoder 352. In a case where the count value exceeds a predetermined value, the decoder 352 outputs the error signal ERR.

As described above, in a case where at least one of the update of the original drive signal dA and the supply of the clock signal ϕ2 is not performed, the determination circuit 350 outputs the error signal ERR. Thereby, the determination circuit 350 determines whether or not the drive signal COM is continuously output as a constant voltage signal in the print mode. Thereby, it is possible to detect and determine that the drive signal COM is continuously output as a constant voltage signal in the print mode, and thereby, the drive signal can be reduced based on the detection and determination results. Thus, as an unintentional DC voltage is continuously supplied to the piezoelectric element 60, it is possible to reduce an unintentional displacement which is continuously applied to the piezoelectric element 60 and the vibration plate 621.

As illustrated in FIG. 2, the error signal ERR is supplied to the control circuit 100. For example, the control circuit 100 shifts the operation mode to the transition mode, based on the error signal ERR. At this time, as illustrated in FIG. 22, the voltage value of the drive signal COM is controlled to approach the voltage value of the reference voltage signal VBS. Then, electric charges of at least one of the electrode 611 and the electrode 612 of the piezoelectric element 60 are discharged. Thereby, it is possible to further reduce an unintentional voltage which is continuously supplied to the piezoelectric element 60, and an unintentional displacement which is continuously applied to the piezoelectric element 60 and the vibration plate 621.

Here, each of the voltage waveforms Adp, Bdp, and Cdp of the drive signal COM has a period during which a constant voltage value is generated, as illustrated in FIG. 7. Thus, the time from when the count value is reset to 0 to when the count value reaches a predetermined count value and the decoder 352 outputs the error signal ERR is much longer than the time when each of the voltage waveforms Adp, Bdp, and Cdp of the drive signal COM outputs a constant voltage.

1.8 Action Effect

As described above, in the liquid ejecting apparatus 1 according to the first embodiment, the detection circuit 320 compares the supplied original drive signal dA with the previous original drive signal dA to detect whether or not the original drive signal dA is updated, and also detects whether the clock signal ϕ2 is supplied. Thereby, the detection circuit 320 can detect whether or not the drive signal COM is output as a constant voltage.

The determination circuit 350 measures a period during which the drive signal COM is output as a constant voltage in response to the clock signal CLK, based on a detection result of the detection circuit 320. Thus, it is possible to reduce a continuous output of the drive signal COM as a constant voltage for a long time.

Thus, it is possible to reduce for the drive signal COM of a constant voltage to be continuously applied to the piezoelectric element 60 for a long time as an unintentional DC voltage. Thus, occurrence of an unintentional displacement in the piezoelectric element 60 and the vibration plate 621 is reduced.

In the first embodiment, the detection circuit 320 detects whether or not a voltage of the drive signal COM is output as a constant voltage, based on the digital original drive signal dA. Thereby, influence of noise or the like which is generated in the drive signal generation circuit 50 is reduced, and a detection accuracy can be increased.

In the liquid ejecting apparatus 1 according to the first embodiment, in a case where the drive signal COM supplied to the piezoelectric element 60 is continuously output as a constant voltage for a long time, a voltage value of the drive signal COM supplied to the electrode 611 is controlled to approach a voltage value of the reference voltage signal VBS supplied to the electrode 612. Thus, occurrence of an unintentional potential difference between the electrodes 611 and 612 of the piezoelectric element 60 is further reduced, and a possibility that an unintentional displacement occurs in the piezoelectric element 60 and the vibration plate 621 is further reduced.

Furthermore, in the liquid ejecting apparatus 1 according to the first embodiment, in a case where the drive signal COM supplied to the piezoelectric element 60 is continuously output as a constant voltage for a long time, an operation mode is shifted to the transition mode based on the error signal ERR. Thus, electric charges of the electrodes 611 and 612 are discharged. Thus, it is possible to reduce occurrence of an unintentional potential difference between the electrodes 611 and 612 of the piezoelectric element 60, and to further reduce a possibility that an unintentional displacement occurs in the piezoelectric element 60 and the vibration plate 621.

In addition, in the first embodiment, the drive signal generation circuit 50 is provided with the drive circuit 51 that generates the drive signal COM, the detection circuit 320 that detects whether or not the drive signal COM is output as a constant voltage, and a determination circuit that determines whether or not the drive signal COM is continuously output as a constant voltage on the basis of a detection result of the detection circuit 320. Accordingly, it is possible to detect generation, detection, and determination of the drive signal COM regardless of a control unit. Thus, it is possible to reduce a possibility that generation, detection, and determination are delayed.

2 Second Embodiment

Figure 31:
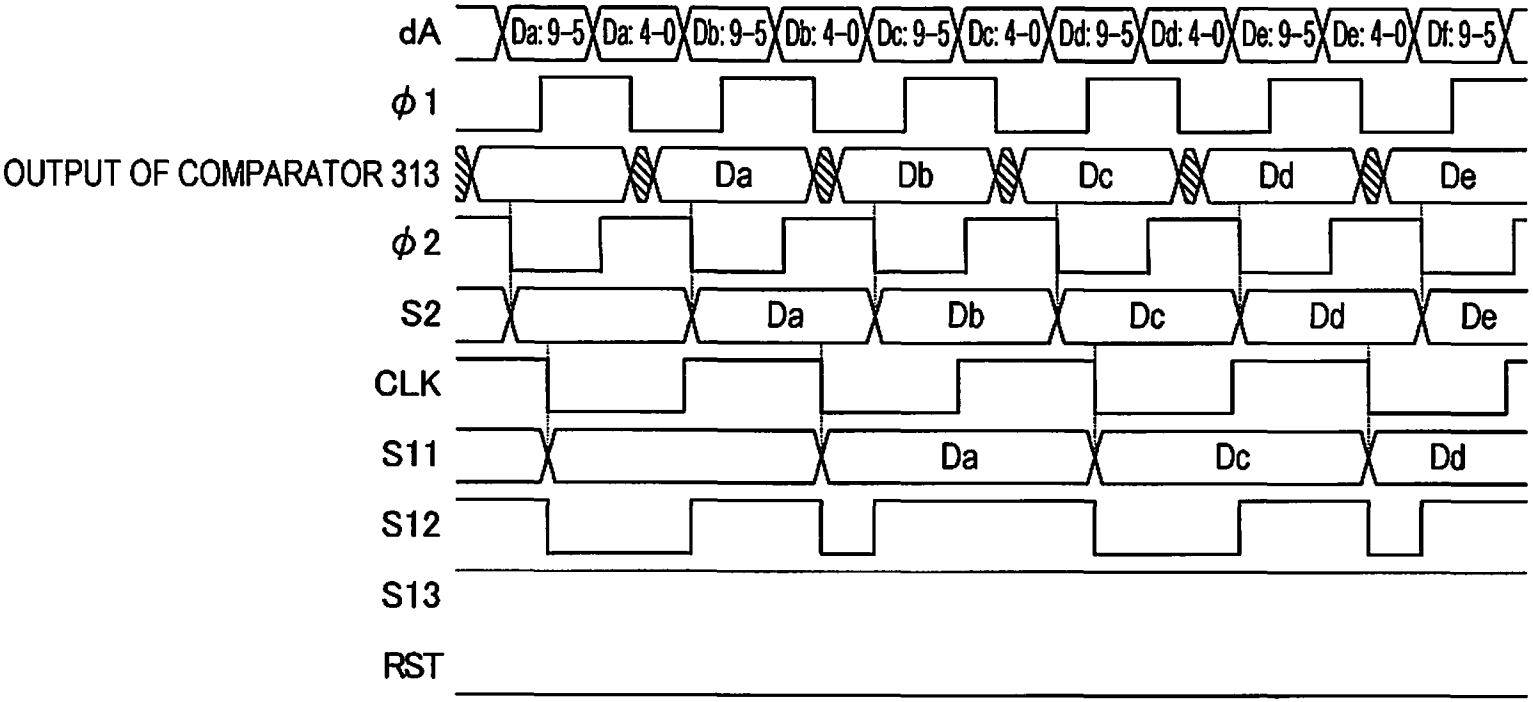
FIG. 31 is a timing chart illustrating an operation of the detection circuit in a case where an original drive signal according to the second embodiment is updated.
Figure 32:
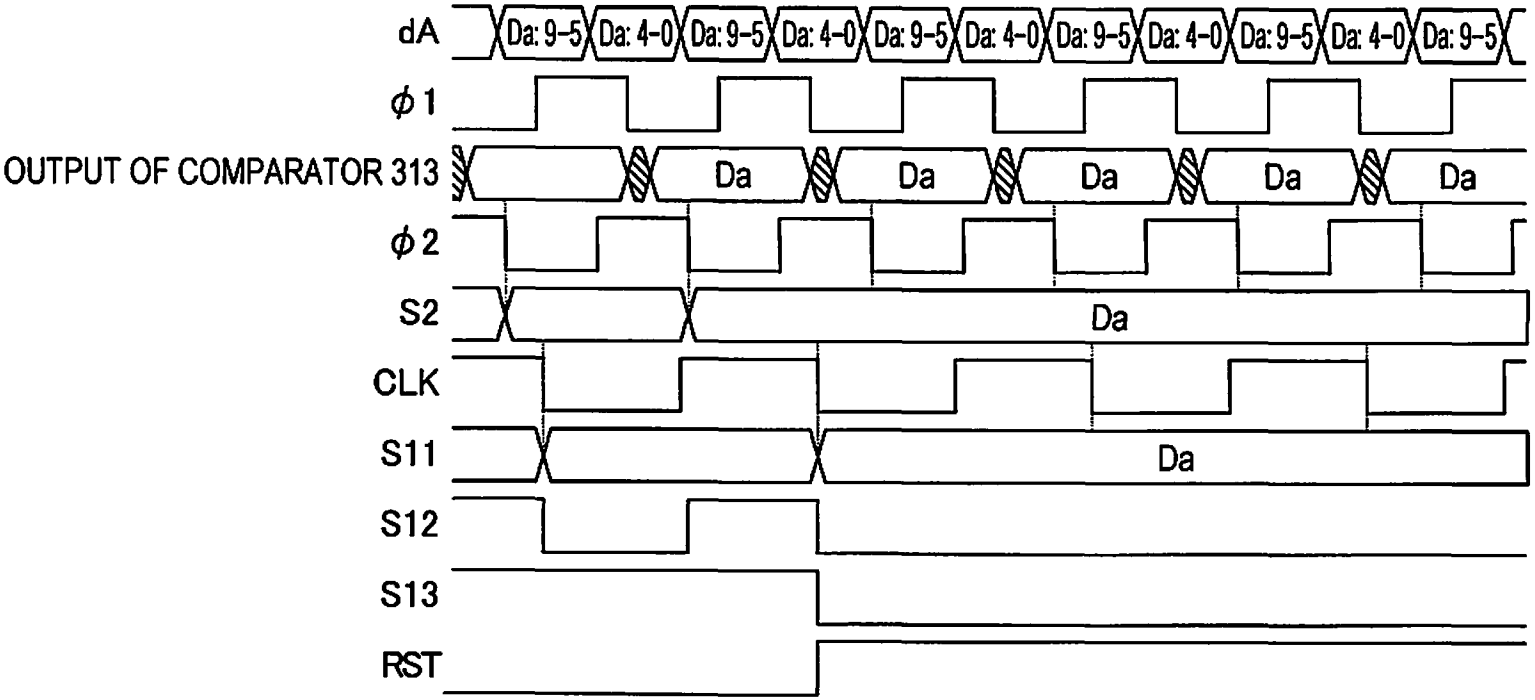
FIG. 32 is a timing chart illustrating the operation of the detection circuit in a case where the original drive signal according to the second embodiment is not updated.

Next, a liquid ejecting apparatus 1 according to a second embodiment will be described with reference to FIGS. 30 to 32.

The liquid ejecting apparatus 1 according to the second embodiment is different from the liquid ejecting apparatus 1 according to the first embodiment in the configuration of the detection circuit 320. In the following description, descriptions overlapping with the description on the first embodiment will be omitted or simplified, and content different from the first embodiment will be mainly described.

Figure 30:
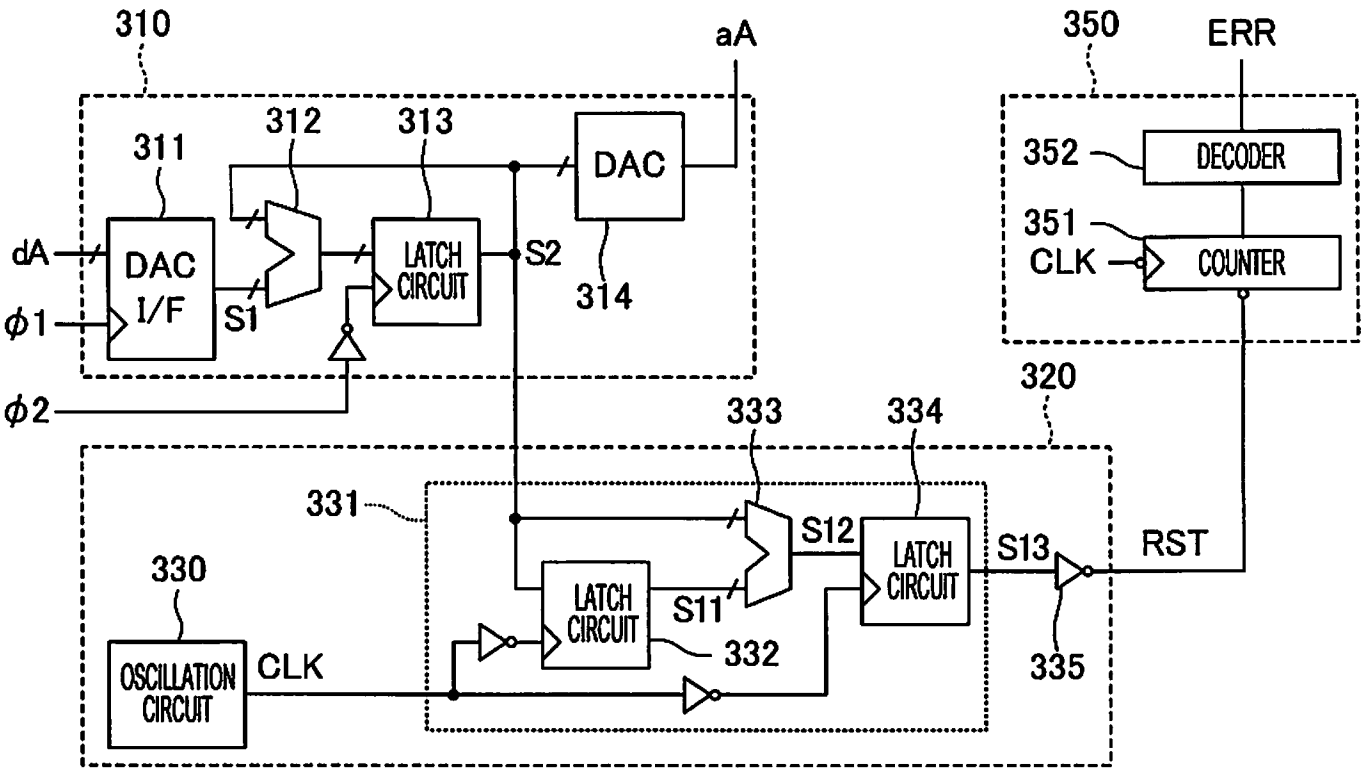
FIG. 30 is a block diagram illustrating electric configurations of a DAC circuit, a detection circuit, and a determination circuit according to the second embodiment.

FIG. 30 is a block diagram illustrating electric configurations of the DAC circuit 310, the detection circuit 320, and the determination circuit 350 according to the second embodiment.

In the same manner as in the first embodiment, the DAC circuit 310 includes the DAC interface (I/F) 311, the comparator 312, the latch circuit 313, and the DAC 314. The DAC circuit 310 generates the analog original drive signal aA based on the supplied original drive signal dA and outputs the signal S2 latched by the latch circuit 313 to the detection circuit 320.

The detection circuit 320 includes the DATA update detection circuit 331, an inverter 335, and the oscillation circuit 330.

The DATA update detection circuit 331 includes the latch circuits 332 and 334 and the comparator 333.

The latch circuit 332 latches the signal S2 at a falling edge of the clock signal CLK output from the oscillation circuit 330 as the signal S11. In the second embodiment, a cycle of the clock signal CLK is different from a cycle of the clock signal 42.

The comparator 333 receives the signal S2 and the signal S11. Then, the comparator 333 compares whether or not the signal S2 is the same as the signal S11, and outputs the signal S12, based on the comparison result. Specifically, the comparator 333 outputs a signal of an L level as the signal S12 in a case where the signal S2 is the same as the signal S11, and outputs a signal of an H level as the signal S12 in a case where the signal S2 is different from the signal S11.

The latch circuit 334 latches the signal S12 at a rising edge of the clock signal CLK. The latch circuit 334 outputs the signal S13 to the inverter 335 as an output signal of the DATA update detection circuit 331.

The inverter 335 inverts a logic level of the signal S13 and outputs the signal S13 to the determination circuit 350 as the reset signal RST.

In the same manner as in the first embodiment, the determination circuit 350 includes the counter 351 and the decoder 352.

In a case where the reset signal RST is at an H level, the counter 351 increments a count value and outputs the count value to the decoder 352. In addition, in a case where the reset signal RST is at an L level, the count value is reset to 0 and is output to the decoder 352.

In a case where the count value input from the counter 351 exceeds a predetermined value, the decoder 352 generates the error signal ERR which is output from the determination circuit 350.

Here, a method of detecting whether or not the original drive signal dA is updated will be described in detail with reference to FIGS. 31 and 32. FIG. 31 is a timing chart illustrating an operation of the detection circuit 320 in a case where the original drive signal dA is updated.

An operation of each component included in the DAC circuit 310 is the same as the operation in the first embodiment, and a description thereon is omitted.

The latch circuit 332 latches a data signal Da held by the latch circuit 313 as the signal S2 at a falling edge of the clock signal CLK generated by the oscillation circuit 330, and outputs the latched signal as the signal S11. At this time, the latch circuit 313 holds the data signal Da as the signal S2. Thus, the same data signal Da is supplied to the comparator 333. As a result, the comparator 333 outputs a signal of an L level as the signal S12.

In a case where the original drive signal dA is updated, the latch circuit 313 latches the data signal Db at the falling edge of the clock signal $\phi$2 as the signal S2. At this time, the latch circuit 332 holds the data signal Da as the signal S11. Thus, the data signal Db functioning as the signal S2 and the data signal Da functioning as the signal S11 are supplied to the comparator 333. As a result, the comparator 333 outputs a signal of an H level as the signal S12.

The latch circuit 334 latches the signal S12 at the falling edge of the clock signal CLK before the latch circuit 332 latches the signal S2. As a result, the latch circuit 334 outputs a signal of an H level functioning as the signal S13 to the inverter 335 as an output signal of the DATA update detection circuit 331.

The inverter 335 inverts a logic level of the signal of an H level output from the DATA update detection circuit 331 and outputs the reset signal RST of an L level to the determination circuit 350.

Next, a detection method in a case where the original drive signal dA is not updated will be described in detail with reference to FIG. 32. FIG. 32 is a timing chart illustrating the operation of the detection circuit 320 in a case where the original drive signal dA is not updated.

An operation of each component included in the DAC circuit 310 is the same as the operation in the first embodiment, and description on the operation will be omitted.

The latch circuit 332 latches the data signal Da held by the latch circuit 313 at the falling edge of the clock signal CLK as the signal S2 and outputs the data signal as the signal S11.

At this time, the latch circuit 313 holds the data signal Da as the signal S2. Thus, the same data signal Da is supplied to the comparator 333. As a result, the comparator 333 outputs a signal of an L level as the signal S12.

In a case where the original drive signal dA is not updated, the latch circuit 313 latches the data signal Da at the falling edge of the clock signal $\phi$2, based on the same original drive signal dA. At this time, the latch circuit 332 holds the data signal Da as the signal S11. Thus, the same data signal is continuously input to the comparator 333. As a result, the comparator 333 outputs a signal of an L level as the signal S12.

The latch circuit 334 latches the signal S12 at the falling edge of the clock signal CLK before the latch circuit 332 latches the signal S2. As a result, the latch circuit 334 outputs a signal of an L level functioning as the signal S13 to the inverter 335 as an output signal of the DATA update detection circuit 331.

The inverter 335 inverts a logic level of the signal of an L level output from the DATA update detection circuit 331 and outputs the reset signal RST of an H level to the determination circuit 350.

In a case where the reset signal RST of an L level is input, the determination circuit 350 updates the original drive signal dA and resets the count value that is output to the decoder 352 by the counter 351. Meanwhile, in a case where the reset signal RST of an H level is input, the determination circuit 350 increments the count value output to the decoder 352 by the counter 351 at the falling edge of the clock signal CLK. In a case where the decoder 352 determines that the count value exceeds a predetermined value, the determination circuit 350 outputs the error signal ERR.

As described above, the determination circuit 350 according to the second embodiment outputs the error signal ERR in a case where the original drive signal dA is not updated. Thus, in the same manner as in the first embodiment, it is possible to reduce a continuous output of the drive signal COM as a constant voltage in the print mode.

In the second embodiment, the latch circuit 313 latches a signal at the falling edge of the clock signal $\phi$2. Thus, in a case where the clock signal $\phi$2 is not supplied, the signal S2 is not updated.

That is, the detection circuit 320 according to the second embodiment also detects whether or not the clock signal $\phi$2 is supplied based on the comparison between the signal S2 and the signal S11 supplied to the comparator 333. Thus, with a simpler configuration than the configuration of the detection circuit 320 according to the first embodiment, whether or not the original drive signal dA is updated can be detected, and whether or not the clock signal $\phi$2 is supplied can be detected. Thus, the liquid ejecting apparatus 1 according to the second embodiment can realize the same action effect as in the first embodiment by using the smaller configuration.

3 Third Embodiment

Next, a liquid ejecting apparatus 1 according to a third embodiment will be described with reference to FIGS. 33 and 34.

The liquid ejecting apparatus 1 according to the third embodiment is different from the first embodiment and the second embodiment in that the detection circuit 320 detects whether or not the drive signal COM is constant based on the drive signal COM output from the drive signal generation circuit 50. Hereinafter, descriptions overlapping with the description on the first embodiment and the second embodiment will be omitted or simplified, and content different from the contents of the first embodiment and the second embodiment will be mainly described.

Figure 33:
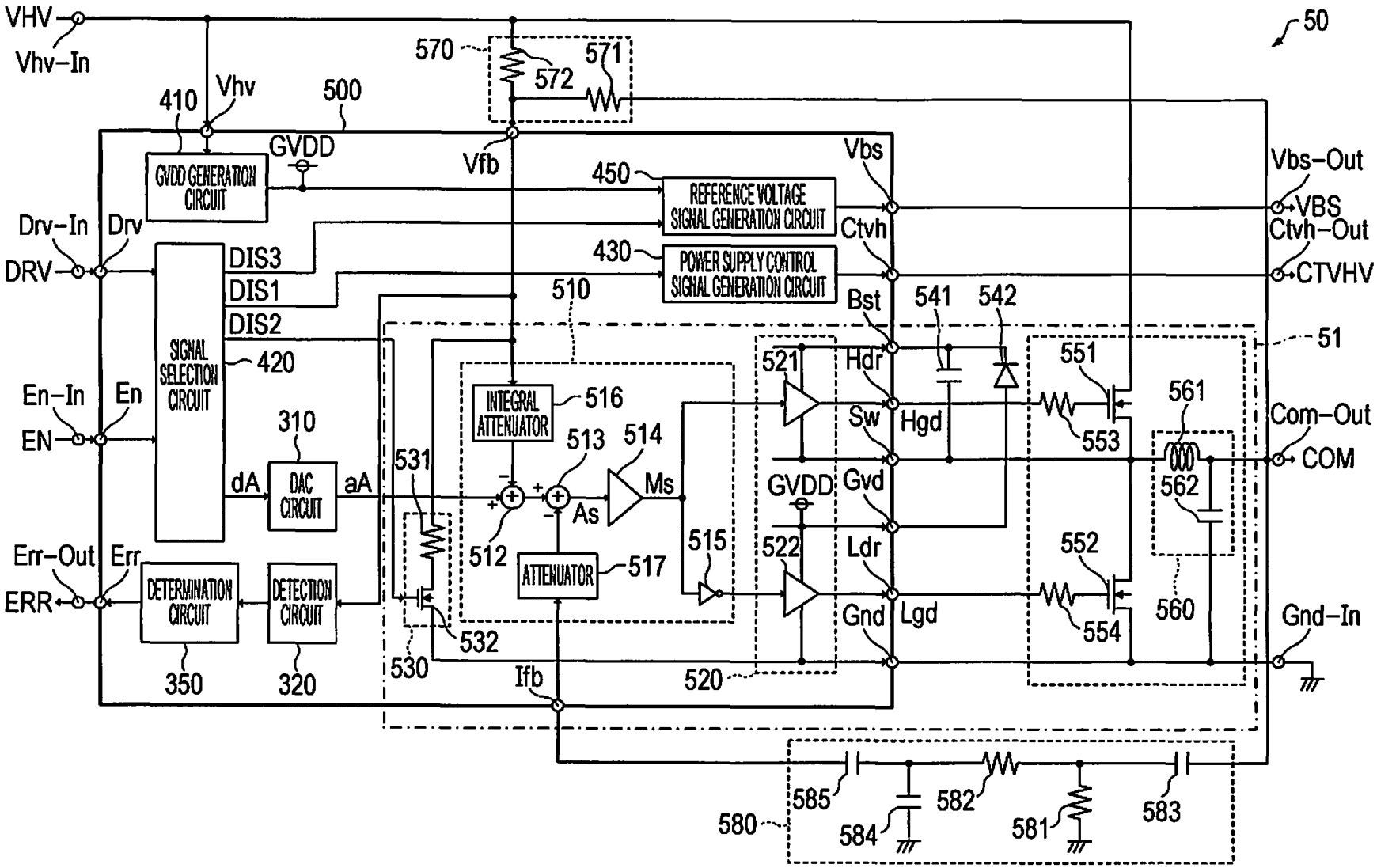
FIG. 33 is a block diagram illustrating a circuit configuration of a drive signal generation circuit according to a third embodiment.

FIG. 33 is a block diagram illustrating a circuit configuration of a drive signal generation circuit 50 according to the third embodiment. As illustrated in FIG. 33, the detection circuit 320 according to the third embodiment detects whether or not the drive signal COM is constant by detecting a signal based on the drive signal COM fed back via the terminal Vfb.

Figure 34:
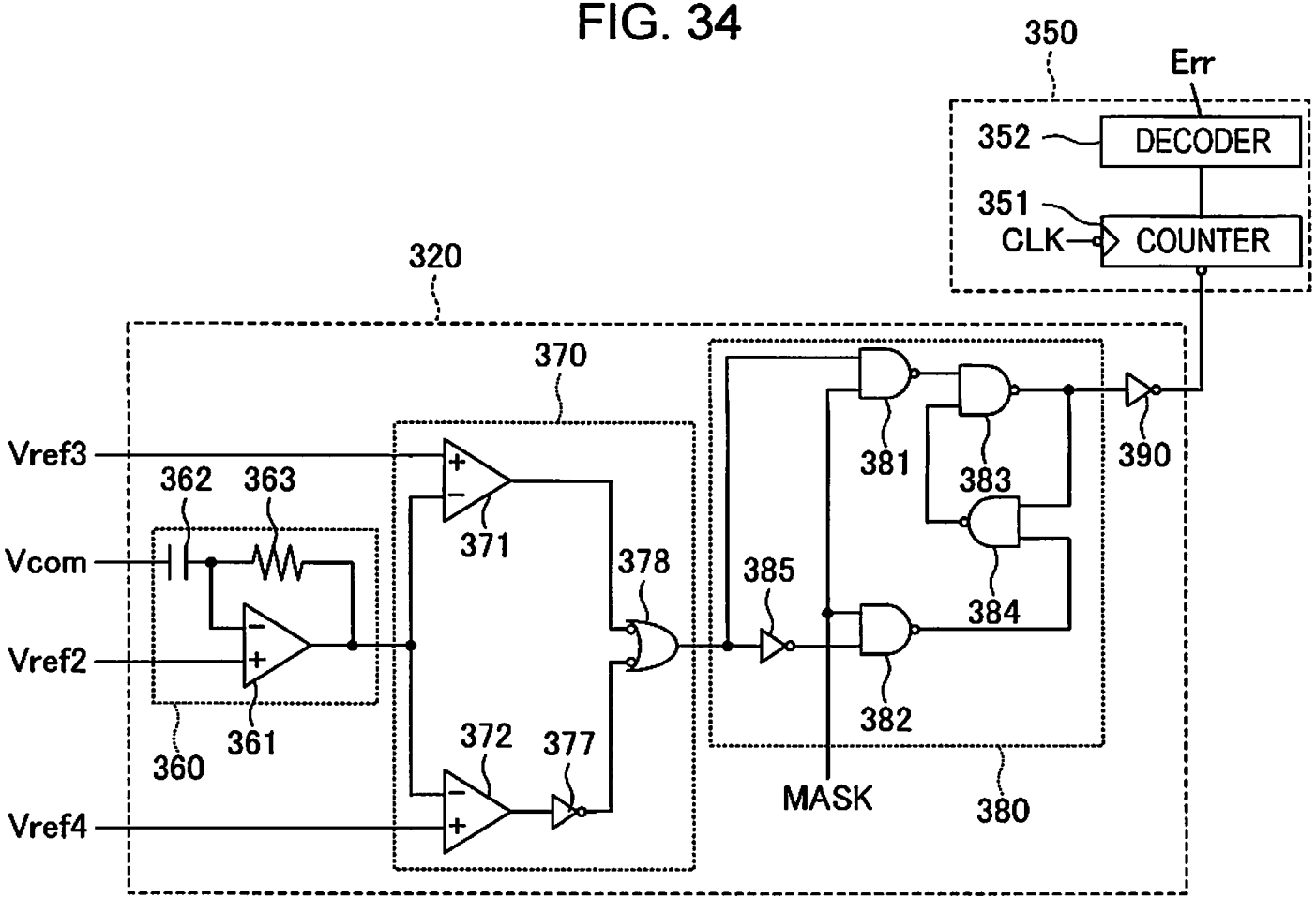
FIG. 34 is a circuit diagram illustrating an electric configuration of a detection circuit according to a third embodiment.

FIG. 34 is a circuit diagram illustrating an electric configuration of the detection circuit 320 according to the third embodiment.

The detection circuit 320 according to the third embodiment includes a differentiation circuit 360, a window comparator circuit 370, a holding circuit 380, and an inverter 390.

The differentiation circuit 360 includes a comparator 361, a capacitor 362, and a resistor 363.

A voltage Vref2 is supplied to an input terminal (+) of the comparator 361. The input terminal (−) of the comparator 361 is connected to one terminal of the capacitor 362 and one terminal of the resistor 363. An output terminal of the comparator 361 is connected to the other terminal of the resistor 363.

The terminal Vfb of the integrated circuit 500 illustrated in FIG. 33 is connected to the other terminal of the capacitor 362. A voltage Vcom is supplied to the other terminal of the capacitor 362 via the terminal Vfb in response to the drive signal COM.

In the differentiation circuit 360 configured as described above, a constant voltage signal based on the voltage Vref2 is output from an output terminal of the comparator 361 in a case where a voltage value of the voltage Vcom is not varied. Meanwhile, in a case where the voltage value of the voltage Vcom varies, a voltage signal having a substantially pulse shape corresponding to the variation is output from the output terminal of the comparator 361.

The window comparator circuit 370 includes comparators 371 and 372, an inverter 377, and an OR circuit 378.

The OR circuit 378 inverts each of signals supplied to two input terminals thereof, calculates a logical sum of the inverted signals, and outputs the calculated value.

The output signal of the differentiation circuit 360 is supplied to an input terminal (−) of the comparator 371. A voltage Vref3 is supplied to an input terminal (+) of the comparator 371. One of input terminals of the OR circuit 378 is connected to the output terminal of the comparator 371.

The output signal of the differentiation circuit 360 is supplied to an input terminal (−) of the comparator 372. A voltage Vref4 smaller than the voltage Vref3 is connected to an input terminal (+) of the comparator 372. An input terminal of the inverter 377 is connected to an output terminal of the comparator 372. An output terminal of the inverter 377 is connected to the other input terminal of the OR circuit 378.

In the window comparator circuit 370 configured as described above, in a case where a voltage value of a voltage signal input from the differentiation circuit 360 is larger than any of voltage values of the voltages Vref3 and Vref4, both the comparator 371 and the comparator 372 output signals of L levels.

In this case, the OR circuit 378 is supplied with a signal of an L level output from the comparator 371 and a signal of an H level obtained by inverting a signal of an L level output from the comparator 372 using the inverter 377. Thus, the OR circuit 378 outputs a signal of an H level.

In a case where the voltage value of the voltage signal input from the differentiation circuit 360 is smaller than a voltage value of either the voltages Vref3 or the voltage Vref4, both the comparators 371 and 372 output signals of H levels.

In this case, the OR circuit 378 is supplied with a signal of an H level output from the comparator 371 and a signal of an L level obtained by inverting the signal of an H level output from the comparator 372 using the inverter 377. This, the OR circuit 378 outputs a signal of an H level.

In a case where a voltage value of a voltage signal input from the differentiation circuit 360 is smaller than a voltage value of the voltage Vref3 and larger than the voltage Vref4, the comparator 371 outputs a signal of an H level, and the comparator 372 outputs a signal of an L level.

In this case, the OR circuit 378 is supplied with a signal of an H level output from the comparator 371 and a signal of an H level obtained by inverting the signal of an L level output from the comparator 372 using the inverter 377. Thus, the OR circuit 378 outputs a signal of an L level.

As described above, in a case where the voltage value of the voltage signal input from the differentiation circuit 360 is between the voltage Vref3 and the voltage Vref4, the window comparator circuit 370 outputs a signal of an L level, and in a case where the voltage value of the voltage signal input from the differentiation circuit 360 is not between the voltage Vref3 and the voltage Vref4, the window comparator circuit 370 outputs a signal of an H level. The voltage value between the voltage Vref3 and the voltage Vref4 functions as a detection threshold as to whether or not the drive signal COM is within a predetermined range. The voltage Vre2 input to the differentiation circuit 360 is set to a voltage value which is larger than the voltage Vref4 and is smaller than the voltage Vref3.

The holding circuit 380 includes NAND circuits 381, 382, 383, and 384 and an inverter 385.

An output of the window comparator circuit 370 is supplied to one input terminal of the NAND circuit 381, and a control signal MASK is supplied to the other input terminal of the NAND circuit 381. An output terminal of the NAND circuit 381 is connected to one of the input terminals of the NAND circuit 383.

The output of the window comparator circuit 370 is supplied to one input terminal of the NAND circuit 382 via the inverter 385, and the control signal MASK is supplied to the other input terminal of the NAND circuit 382. An output terminal of the NAND circuit 382 is connected to one of input terminals of the NAND circuit 384.

Here, the control signal MASK is a signal for controlling a state of the holding circuit 380 irrespective of the output of the window comparator circuit 370. In the present embodiment, the control signal MASK is described as a signal of an H level.

The other input terminal of the NAND circuit 383 is connected to an output terminal of the NAND circuit 384. An output terminal of the NAND circuit 383 is Connected to the other input terminal of the NAND circuit 384 and an input terminal of the inverter 390.

In a case where a signal of an H level is input from the window comparator circuit 370 to the holding circuit 380 configured as described above, the NAND circuit 381 outputs a signal of an L level, the NAND circuit 382 outputs a signal of an H level, the NAND circuit 383 outputs a signal of an H level, and the NAND circuit 384 outputs a signal of an L level. As a result, a signal of an H level is held by the NAND circuits 383 and 384 as an output of the holding circuit 380.

In a case where a signal of an L level is output from the window comparator circuit 370, the NAND circuit 381 inputs a signal of an H level, the NAND circuit 382 outputs a signal of an L level, the NAND circuit 383 outputs a signal of an L level, and the NAND circuit 384 outputs a signal of an H level. As a result, a signal of an L level is held by the NAND circuits 383 and 384 as an output of the holding circuit 380.

The signal held as the output of the holding circuit 380 is output to the determination circuit 350 via the inverter 390.

In the same manner as in the first embodiment, in a case where a signal of an H level is supplied, the determination circuit 350 increments a count value output from the counter 351 at a falling edge of the clock signal CLK, and in a case where a signal of an L level is supplied, the determination circuit 350 resets the count value output from the counter 351. In a case where the count value exceeds a predetermined value, the decoder 352 outputs the error signal ERR.

In the detection circuit 320 configured as described above, in a case where a voltage of the drive signal COM varies, the differentiation circuit 360 outputs a voltage signal having a substantially pulse shape corresponding to the variation of the voltage. In a case where a voltage value of the voltage signal having the pulse shape is larger than a voltage value of the voltage Vref3 or smaller than a voltage value of the voltage Vref4, the window comparator circuit 370 outputs a signal of an H level. Thus, the holding circuit 380 outputs a signal of an H level, and a signal of an L level is supplied to the determination circuit 350. Thus, in a case where a voltage value of the drive signal COM varies more than a predetermined range, the determination circuit 350 resets the count value of the counter 351.

In a case where the drive signal COM keeps a constant voltage, the differentiation circuit 360 outputs a voltage signal of a constant potential, based on the voltage Vref2. A voltage value of the voltage signal of the constant potential based on the voltage Vref2 is smaller than the voltage Vref3 and larger than the voltage Vref4. Thus, the window comparator circuit 370 outputs a signal of an L level. Thus, the holding circuit 380 outputs a signal of an L level, and a signal of an H level is supplied to the determination circuit 350. Thus, in a case where the drive signal COM continuously keeps a constant voltage, the determination circuit 350 outputs the error signal ERR to the control circuit 100.

The liquid ejecting apparatus 1 illustrated according to the third embodiment can directly detect a voltage waveform of the drive signal COM generated by the drive circuit 51 in the print mode. Thus, it is possible to improve a detection accuracy as to whether or not the drive signal COM is constant, with respect to the first embodiment and the second embodiment.

The invention includes substantially the same configuration (for example, a configuration in which a function, a method, and a result are the same, or a configuration in which an object and an effect are the same) as the configuration described in the first embodiment to the third embodiment. In addition, the invention includes a configuration in which a non-essential part of the configuration described in the embodiment is replaced. In addition, the invention includes a configuration that achieves the same action effect as the configuration described in the embodiment, or a configuration that can achieve the same object. In addition, the invention includes a configuration in which a well-known technique is added to the configuration described in the embodiment.

What is claimed is:

1. A liquid ejecting apparatus comprising:

a drive circuit that outputs a drive signal;

a piezoelectric element that includes a first electrode to which the drive signal is supplied and a second electrode to which a reference voltage signal is supplied and that is displaced by a potential difference between the first electrode and the second electrode;

a cavity that is filled with a liquid ejected from a nozzle according to the displacement of the piezoelectric element;

a vibration plate that is provided between the cavity and the piezoelectric element;

a detection circuit that detects whether or not a voltage variation of the drive signal is continuously within a predetermined range for a predetermined period; and a determination circuit that determines that the drive signal is not normal and outputs an error signal in response to the detection circuit detecting that the voltage variation of the drive signal is continuously within the predetermined range for the predetermined period.

2. The liquid ejecting apparatus according to claim 1, wherein, in a case where the determination circuit determines that the drive signal is not normal, the drive circuit controls a voltage value of the drive signal to approach a voltage value of the reference voltage signal.

3. The liquid ejecting apparatus according to claim 1, wherein, in a case where the determination circuit determines that the drive signal is not normal, the determination circuit outputs a signal for discharging an electric charge of at least one of the first electrode and the second electrode.

4. The liquid ejecting apparatus according to claim 1, wherein the detection circuit detects whether or not the voltage variation of the drive signal is continuously, within the predetermined range for the predetermined period, based on an original drive signal which is origin of the drive signal.

5. The liquid ejecting apparatus according to claim 4, wherein the original drive signal is a digital signal.

6. The liquid ejecting apparatus according to claim 1, wherein the detection circuit detects whether or not the voltage variation of the drive signal is continuously within the predetermined range for the predetermined period, based on the drive signal.

7. A drive signal generation circuit which is used in a liquid ejecting apparatus including a piezoelectric element that is displaced by a potential difference that is generated between a first electrode and a second electrode, a cavity that is filled with a liquid ejected from a nozzle according to the displacement of the piezoelectric element, and a vibration plate which is provided between the cavity and the piezoelectric element, the circuit comprising:

a drive circuit that outputs a drive signal which is to be supplied to the first electrode of the piezoelectric element;

a detection circuit that detects whether or not a voltage variation of the drive signal is continuously within a predetermined range for a predetermined period; and a determination circuit that determines that the drive signal is not normal and outputs an error signal in response to the detection circuit detecting that the voltage variation of the drive signal is continuously within the predetermined range for the predetermined period.

* * * * *